United States Patent [19]

Shimizu et al.

[11] 4,394,426

[45] * Jul. 19, 1983

[54] PHOTOCONDUCTIVE MEMBER WITH α-SI(N) BARRIER LAYER

[75] Inventors: Isamu Shimizu, Yokohama; Shigeru Shirai, Yamato; Eiichi Inoue, Tokyo, all of Japan

[73] Assignee: Canon Kabushiki Kaisha, Tokyo, Japan

[ * ] Notice: The portion of the term of this patent subsequent to Nov. 16, 1999, has been disclaimed.

[21] Appl. No.: 304,568

[22] Filed: Sep. 22, 1981

[30] Foreign Application Priority Data

| | | | |
|---|---|---|---|
| Sep. 25, 1980 | [JP] | Japan | 55-134114 |
| Sep. 25, 1980 | [JP] | Japan | 55-134115 |
| Sep. 25, 1980 | [JP] | Japan | 55-134116 |
| Sep. 30, 1980 | [JP] | Japan | 55-137149 |
| Sep. 30, 1980 | [JP] | Japan | 55-137150 |
| Sep. 30, 1980 | [JP] | Japan | 55-137151 |

[51] Int. Cl.[3] ..... G03G 5/082; G03G 5/14

[52] U.S. Cl. ..... 430/65; 430/60; 430/63; 430/66; 430/67; 430/84; 430/128; 427/74; 252/501.1; 357/2

[58] Field of Search ..... 430/60, 63, 65, 66, 430/67, 84, 128, 131, 132; 427/74; 252/501.1; 357/2

[56] References Cited

U.S. PATENT DOCUMENTS

| | | | |
|---|---|---|---|
| 3,650,737 | 3/1972 | Maissel et al. | 430/67 |
| 4,217,374 | 8/1980 | Ovshinsky et al. | 427/74 X |
| 4,225,222 | 9/1980 | Kempter | 355/3 DR |
| 4,226,898 | 10/1980 | Ovshinsky et al. | 427/39 |
| 4,253,882 | 3/1981 | Dalal | 427/74 X |
| 4,265,991 | 5/1981 | Hirai et al. | 430/67 X |
| 4,289,822 | 9/1981 | Shimada et al. | 427/74 X |
| 4,317,844 | 3/1982 | Carlson | 427/39 |
| 4,359,514 | 11/1982 | Shimizu et al. | 430/65 |
| 4,365,013 | 12/1982 | Ishioka et al. | 430/84 X |

*Primary Examiner*—Roland E. Martin, Jr.

*Attorney, Agent, or Firm*—Fitzpatrick, Cella, Harper & Scinto

[57] ABSTRACT

A photoconductive member comprise a support, a photoconductive layer constituted of an amorphous material containing silicon atoms as matrix and containing hydrogen atoms or halogen atoms, and an intermediate layer provided between them, said intermediate layer having a function to bar penetration of carriers from the side of the support into the photoconductive layer and to permit passage from the photoconductive layer to the support of photocarriers generated in the photoconductive layer by projection of electromagnetic waves and movement of the photocarriers toward the side of the support, and said intermediate layer being constituted of an amorphous material containing silicon atoms and carbon atoms as constituents. A photoconductive member having a support, a photoconductive layer constituted of an amorphous material containing silicon atoms as matrix and containing hydrogen atoms or halogen atoms as a constituent, and an intermediate layer provided between said support and said photoconductive layer, is characterized in that said intermediate layer is constituted of an amorphous material containing silicon atoms and nitrogen atoms as constitution elements. A photoconductive member having a support, a photoconductive layer constituted of an amorphous material containing silicon atoms as matrix and containing hydrogen atoms or halogen atoms as a constituent, and an intermediate layer provided between said support and said photoconductive layer, characterized in that said intermediate layer is constituted of an amorphous material containing silicon atoms and carbon atoms as constitution element.

98 Claims, 17 Drawing Figures

PHOTOCONDUCTIVE MEMBER WITH α-SI(N) BARRIER LAYER

BACKGROUND OF THE INVENTION

1. Field of the Invention

This invention relates to a photoconductive member having a sensitivity to an electromagnetic wave such as light (herein used in a broad sense, including ultraviolet rays, visible light, infrared rays, X-rays and gamms-rays).

2. Description of the Prior Art

Photoconductive materials, which constitute image forming members for electrophotography in solid state image pickup devices or in the filed of image formation, or photoconductive layers in manuscript reading devices, are required to have a high sensitivity, a high SN ratio [Photocurrent($I_p$)/Dark current($I_d$)], spectral characteristics corresponding to those of an electromagnetic wave to be irradiated, a good light-response, a desired dark resistance value as well as no harm to human bodies during usage. Further, in an image pickup device, it is also required that the residual image should easily be treated within a predetermined time. In particular in the case of image forming member for electrophotography to be assembled in an electrophotographic device to be used in an office as office apparatus, the aforesaid harmless characteristic is very important.

From the standpoint as mentioned above, amorphous silicon (hereinafter referred to as a—Si) has recently attracted attention as a photoconductive material. For example, German Laid-open Patent Publication Nos. 2746967 and 2855718 disclose applications of a—Si for use in image forming members for electrophotography, and British Laid-open Patent Publication No. 2029642 an application of a—Si for use in a photoelectric conversion reading device. However, the photoconductive members having photoconductive layers constituted of a—Si of prior art have various electrical, optical and photoconductive characteristics such as dark resistance value, photosensitivity and light-response as well as environmental characteristics in use such as weathering resistance and humidity resistance, which should further be improved. Thus, in a practical solid state image pickup device, reading device or an image forming member for electrophotography and the like, they cannot effectively be used also in view of their productivity and possibility for their mass production.

For instance, when applied in an image forming member or a solid state image pickup device, residual potential is frequently observed to be remained during use thereof. When such a photoconductive member is repeatedly used for a long time, ther will be caused various inconveniences such as accumulation of fatigues by repeated uses or so called ghost phenomenon wherein residual images are formed.

Further, according to a number of experiments by the present inventors from a—Si material constituting the photoconductive layer of an image forming member for electrophotography, while it has a number of advantages, as compared with Se, Zn or organic photoconductive materials (OPC) such as PVCz, TNF and the like of prior art, is also found to have several problems to be solved. Namely, even if charging treatment is applied for formation of electrostatic images on the photoconductive layer of an image forming member for electrophotography having a photoconductive member constituted of a mono-layer of a—Si which has been endowed with characteristics for use in a solar battery of prior art, dark decay is markedly rapid, whereby it is difficult to apply a conventional photographic process. This tendency is further pronounced under a humid atmosphere to such an extent in some cases that no charge is retained at all before development.

Thus, it is required in designing of a photoconductive material to make efforts to obtain desirable electrical, optical and photoconductive characteristics along with the improvement of a—Si materials per se.

The present invention was accomplished to solve the above mentioned problems. The followings have been found as a result of extensive studies made comprehensively from the standpoints of applicability and utility of a—Si as a photoconductive member for image forming members for electrophotography, image pickup devices or reading devices. It has now been found that a photoconductive member manufactured to have a layer structure comprising a photoconductive layer of a so called hydrogenated amorphous silicon hydride (hereinafter referred to as a—Si:H), which is an amorphous material containing hydrogen in a matrix of silicon, or a so called halogenated amorphous silicon (hereinafter referred to as a—Si:X), which is an amorphous material containing halogen atoms (X) in a matrix of silicon atoms, and a specific intermediate layer interposed between said photoconductive layer and a support which supports said photoconductive layer, is not only practically useful but also superior in substantially all in comparison with the photoconductive members of prior art, especially markedly excellent characteristics as a photoconductive member for electrophotography. The present invention is based on this finding.

SUMMARY OF THE INVENTION

The primary object of the present invention is to provide a photoconductive member having constantly stable electrical, optical and photoconductive characteristics, which is an all-environment type substantially without limitations with respect to the environment under which it is used, being markedly resistant to light-fatigue without deterioration after repeated uses and free entirely or substantially from residual potentials observed.

Another object of the present invention is to provide a photoconductive member, having a high photosensitivity with a spectral sensitive region covering substantially all over the region of visible light, and having also a rapid light-response.

Still another object of the present invention is to provide a photoconductive member, which is sufficiently capable of bearing charges at the time of charging treatment for formation of electrostatic image to the extent such that a conventional electrophotographic screen can be applied when it is provided for use as an image forming member for electrophotography, and which has excellent electrophotographic characteristics of which substantially no deterioration is observed even under a highly humid atmosphere.

Further, still another object of the present invention is to provide a photoconductive member for electrophotography capable of providing easily a high quality image which is high in concentration, clear in halftone and high in definition.

A photoconductive member of the present invention comprises a support, a photoconductive layer constituted of an amorphous material, containing silicon atoms as matrix and containing hydrogen atoms or halogen atoms, and an intermediate layer provided between them. The said intermediate layer has a function to bar penetration of carriers from the said of the support into the photoconductive layer and to permit passage from the photoconductive layer to the support of photocarriers generated in the photoconductive layer by projection of electromagnetic waves and movement of the photocarriers toward the side of the support, and the said intermediate layer being constituted of an amorphous material containing silicon atoms and nitrogen atoms as constituents.

DETAILED DESCRIPTION OF THE PREFERRED EMBODIMENTS

Figure 1:
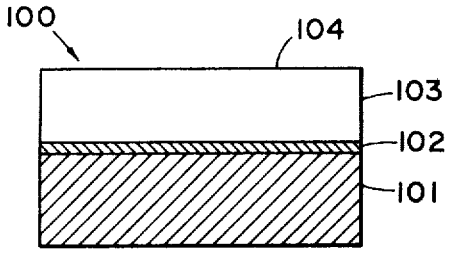
FIGS. 1 through 12 show schematic sectional views of the embodiments of the photoconductive members according to the present invention, respectively.

Referring now to the drawing, the photoconductive members according to the present invention are to be described in detail below.

FIG. 1 shows a schematic sectional view for illustrating the basic embodiment of the photoconductive member of the invention.

The photoconductive member 100 shown in FIG. 1 is one of the most basic embodiment, having a layer structure comprising a support 101 for photoconductive member, an intermediate layer 102 provided on said support and a photoconductive layer 103 provided in direct contact with said intermediate layer 102.

The support 101 may be either electroconductive, electrical or insulating. As the electroconductive material, use is made of metals such as NiCr, stainless steel, Al, Cr, Mo, Au, Ir, Nb, V, Ti, Pt, Pd, etc. or alloys thereof.

As insulating supports, use is conventionally made of films or sheets of synthetic resins, including polyester, polyethylene, polycarbonate, cellulose acetate, polypropylene, polyvinyl chloride, polyvinylidene chloride, polystyrene, polyamide, etc., glasses, ceramics, papers and the like. These insulating supports may suitably have at least one surface subjected to electroconductive treatment, and it is desirable to provide other layers on the side at which said electroconductive treatment has been applied.

For example, a glass may be provided electroconductivity by applying a thin film of NiCr, Al, Cr, Mo, Au, Ir, Nb, Ta, V, Ti, Pt, Pd, $In_2O_3$, $SnO_2$, ITO($IN_2O_3$+-$SnO_2$) thereon. Alternatively, a synthetic resin film such as polyester film can be subjected to the electroconductive treatment on its surface by vapor deposition, electron-beam deposition or sputtering of a metal such as NiCr, Al, Ag, Pb, Zn, Ni, Au, Cr, Mo, Ir, Nb, Ta, V, Ti, Pt, and the like or by laminating treatment with the said metal. The support may be shaped in any form such as cylinders, belts, plates or others, and its form may be determined as desired. For example, when the photoconductive member 100 is to be used as an image forming member for electrophotography, it may desirably be formed into an endless belt or a cylinder for use in continuous high speed copying. The support may have a thickness, which is conveniently determined so that a photoconductive member as desired may be formed. When the photoconductive member is required to have a flexibility, the support is made as thin as possible, so far as the function of a support can be maintained. However, in such a case, the thickness is generally 10μ or more from the points of fabrication and handling of the support as well as its mechanical strength.

The intermediate layer 102 is constituted of a non-photoconductive amorphous material containing silicon atoms and nitrogen atoms (a—$Si_xN_{1-x}$, where $0<x<1$), which has the function of a so called barrier layer capable of barring effectively penetration of carriers into the photoconductive layer 103 from the side of the support 101 and of permitting the photocarriers, generated by irradiation of an electromagnetic wave in the photoconductive layer 103, to easily migrate toward the support 101 from the side of the photoconductive layer 103.

The intermediate layer 102 constituted of a—-$Si_xN_{1-x}$ may be formed by the sputtering method, the ion implantation method, the ion plating method, the electron-beam method or the like. These production methods are suitably selected depending on the factors such as production conditions, the degree of loading of installation capital investment, production scale, the desirable characteristics of the photoconductive members to be prepared, etc. For the advantages of relatively easy control of the conditions for preparation of photoconductive members having desired characteristics as well as easy feasibleness of introduction of nitrogen atoms together with silicon atoms into the intermediate layer 102 to be prepared, it is preferred to use the sputtering method, the electron-beam method or the ion plating method.

For formation of the intermediate layer 102 by the sputtering method, a single crystalline or polycrystalline Si wafer, $Si_3N_4$ wafer or a wafer containing Si and $Si_3N_4$ mixed therein is used as target and subjected to sputtering in an atmosphere of various gases.

For example, when Si wafer and $Si_3N_4$ wafer are used as target, a gas for sputtering such as He, Ne, Ar and the like is introduced into a deposition chamber to form a gas plasma therein and is used for sputtering of Si wafer and $Si_3N_4$ wafer. Alternatively, one sheet target of a molded mixture of Si and $Si_3N_4$ may be used and by introducing a gas for sputtering into a device system, sputtering may be effected in an atmosphere of the gas.

When the electron-beam method is used, there are respectively placed single crystalline or polycrystalline high purity silicon and high purity silicon nitride ($Si_3N_4$) in two boats for deposition, and each may independently be irradiated by an electron-beam to effect concurrently vapor deposition of both materials. Alternatively, crystalline silicon and silicon nitride ($Si_3N_4$) placed in the same single boat for deposition may be irradiated by a single electron-beam to effect vapor deposition. The ratio of silicon atoms to nitrogen atoms in the composition contained in the intermediate layer 102 is controlled in the former case by varying the acceleration voltage of electron beams applied on the silicon and silicon nitride, respectively, and by the predetermined mixing ratio of crystalline silicon to silicon nitride in the latter.

When the ion plating method is used, various gases are introduced into a vapor deposition tank and a high frequency electric field is applied on the coil previously rolled around the tank to effect a glow discharging, under which state Si and $Si_3N_4$ may be vapor deposited by utilizing the electron beam method.

The intermediate layer 102 in the present invention is formed carefully so that the characteristics required may be given exactly as desired.

That is, a substance constituted of silicon atoms (Si) and nitrogen atoms (N) can structurally take a form from a crystalline to amorphous state, exhibiting an electrical properties from electroconductive through semiconductive to insulating, and from photoconductive to non-conductive, indivisually. Hence, in the present invention, the conditions for preparation of a—$Si_xN_{1-x}$ are severely selected so that there may be formed a—$Si_xN_{1-x}$ which is non-photoconductive at least to the light in the so called visible light region.

Since the formation of the intermediate layer 102 of this invention is to bar penetration of carriers from the side of the support 101 into the photoconductive layer 103, while permitting easily the photocarriers, generated in the photoconductive layer 103, to be migrated and passed therethrough to the side of the support 101, a—$Si_xN_{1-x}$ constituting the intermediate layer 102 is desirably formed so as to exhibit insulating behaviors at least in the visible light region.

As another critical element in the conditions for preparation of a-$Si_xN_{1-x}$ so as to have a mobility value with respect to passing carriers to the extent that passing of photocarriers generated in the photoconductive layer 103 may be passed smoothly through the intermediate layer 102, there may be mentioned the support temperature during preparation thereof.

In order words, in forming an intermediate layer 102 constituted of a—$Si_xN_{1-x}$ on the surface of the support 101, the support temperature during the layer formation is an important factor affecting the structure and characteristics of the layer formed. In the present invention, the support temperature during the layer formation is severely controlled so that the a—$Si_xN_{1-x}$ having the intended characteristics may be prepared exactly as desired.

In order to effectively achieve the present invention, the support temperature during formation of the intermediate layer 102, which is selected conveniently within an optimum range depending on the method employed for formation of the intermediate layer 102, is desired generally 20° to 200° C., preferably 20° to 150° C.

For formation of the intermediate layer 102, it is advantageous to adopt the sputtering method or the electron beam method, since these methods can afford severe controlling of the atomic ratios constituting each layer or layer thicknesses with relative ease as compared with other methods, when forming continuously the photoconductive layer 103 on the intermediate layer in the same system, and further a third layer formed on the photoconductive layer 102, if desired. In case of forming the intermediate layer 102 according to these layer forming methods, the discharging power during layer formation may also be mentioned as one of the important factors influencing the characteristics of a—$Si_xN_{1-x}$ to be prepared, similarly as the support temperature as described above.

In such methods for preparation of the intermediate layer, the discharging power condition for preparing effectively a—$Si_xN_{1-x}$ having characteristics in order to achieve the object of the present invention requires generally 50 W to 250 W, preferably 80 W to 150 W.

The content of the nitrogen atoms (N) in the intermediate layer 102 in the photoconductive member of this invention is also one of the important factor for forming the intermediate layer 102 with desired characteristics to achieve the object of the invention, similarly as the condition for preparation of the intermediate layer 102. That is, the content of nitrogen atoms (N) in the intermediate layer 102 is, based on silicon atoms (Si), generally 43 to 60 atomic %, preferably 43 to 50 atomic %. As expressed differently, in terms of the previous representation a—$Si_xN_{1-x}$, x is generally 0.43 to 0.60, preferably 0.43 to 0.50.

The range of the layer thickness of the intermediate layer 102 is also another important factors to effectively achieve the object of this invention.

That is, if the thickness of the intermediate layer is too thin, the function of barring penetration of carriers from the side of the support 101 into the photoconductive layer 103 cannot sufficiently be fulfilled. On the contrary, if the thickness is too thick, the propability of the photocarriers generated in the photoconductive layer 103 to be passed to the side of the support 101 is very small. Thus, in any of the cases, the objects of this invention cannot effectively be achieved.

The layer thickness to effectively achieve the objects of this invention is generally in the range of from 30 to 1000 Å, preferably from 50 to 600 Å, most preferably from 50 to 300 Å.

In the present invention, in order to achieve its objects effectively, the photoconductive layer 103 laminated on the intermediate layer 102 is constituted of a—Si:H having the semi-conductor characteristics as shown below.

① p-type a—Si:H—Containing only acceptor; or containing both donor and acceptor with higher concentration of acceptor (Na);

② $p^-$-type a—Si:H—A type of ①, which contains acceptor at low concentration (Na), for example, being doped with an appropriate quantity of p-type impurities;

③ n-type a—Si:H—containing only donor; or containing both donor and acceptor with higher concentration of donor (Nd);

④ $n^-$-type a—Si:H—A type of ③, which contains donor at low concentration (Nd), for example, being doped lightly with n-type impurities or non-doped;

⑤ i-type a—Si:H—Where $Na \simeq Nd \simeq O$ or $Na \simeq Nd$.

In the present invention, a—Si:H constituting the photoconductive layer 103, since it is provided through the intermediate layer 102 on the support, can be used material having relatively lower electric resistivity. But, for obtaining better results, the dark resistivity of the photoconductive layer formed may preferably be $5\times10^9$ Ωcm or more, most preferably $10^{10}$ Ωcm or more.

In particular, the limitation for the dark resistivity values is an important factor when using the prepared photoconductive member as an image forming member for electrophotography, as a high sensitive reading device or a image pickup device to be used under low illuminance regions, or as a photoelectric converter.

In the present invention, for providing a photoconductive layer constituted of a—Si:H, hydrogen atoms (H) are incorporated into the layer with a method stated below during formation of such a layer.

The expression "H is incorporated in the layer" herein mentioned means the state, in which "H is bonded to Si", or in which "H is ionized to be incorporated in the layer" or in which "H is incorporated as $H_2$ in the layer".

As the method for incorporating hydrogen atoms (H) into the photoconductive layer, for example, a silicon compound such as silanes (silicon hydrides), including $SiH_4$, $Si_2H_6$, $Si_3H_8$, $Si_4H_{10}$ and so on is introduced in a gaseous state into a deposition device system when forming a layer, and decomposing these compounds by the glow decomposition method to be incorporated in the layer simultaneously with the growth of the layer.

In forming the photoconductive layer by the glow decomposition method, when a silicon hydride such as $SiH_4$, $Si_2H_6$, $Si_3H_8$, $Si_4H_{10}$ and so on is used as the starting material for supplying silicon atoms (Si), hydrogen atoms (H) are inherently incorporated in the layer when it is formed by decomposition of the gas of these compounds.

When the reactive sputtering method is used, $H_2$ gas is introduced into the system wherein sputtering is effected in an atmosphere of an inert gas such as He or Ar or a gas mixture containing these gases as the base, using Si as target; or alternatively a gas of silicon hydride such as $SiH_4$, $Si_2H_6$, $Si_3H_8$, $Si_4H_{10}$ and so on or a gas such as $B_2H_6$, $PH_3$ to concurrently effect doping, may be introduced thereinto.

According to the experience by the present inventors, it has been found that the content of hydrogen atoms (H) in the photoconductive layer constituted of a—Si:H is one of the major factors which will determine whether the photoconductive layer formed is practically useful.

In the present invention, in order that the photoconductive layer formed is sufficiently useful in practical applications, the content of hydrogen atoms (H) in the photoconductive layer is generally 1 to 40 atomic %, preferably 5 to 30 atomic %. The content of hydrogen atoms (H) in the layer can be controlled by the deposition support temperature or/and the quantity of the starting material for incorporation of hydrogen atoms (H) to be introduced into the deposition device, discharging power or others.

In order to make the photoconductive layer n-type, p-type, or i-type, n-type impurity, p-type impurity or both can be doped into the layer in a controlled amount during formation of the layer by the glow discharge or the reaction sputtering method.

As the impurity to be doped into the photoconductive layer to make it p-type, there may be mentioned preferably an element of the Group III-A in the Periodic table, for example, B, Al, Ga, In, Tl, etc.

On the other hand, for obtaining a n-type, there may preferably be used an element of the Group VA in the Periodic table, such as N, P, S, As, Sb, Bi, and the like.

In case of a—Si:H, the so called non-doped a—Si:H, which is formed without doping of the n-type impurity or the p-type impurity, will generally show slightly the tendency of n-type ($n^-$-type). Accordingly, in order to obtain an i-type a—Si:H, it is necessary to dope an appropriate, although very small, quantity of p-type impurity in the non-doped a—Si:H. Since a photoconductive member for electrophotography is required to have a sufficiently large dark resistivity, it is desirable to constitute a photoconductive layer of non-doped a—Si:H or an i-type a—Si:H in which a p-type impurity such as B, is doped in a small quantity.

The impurities as described above are contained in the layer in an amount on the order of ppm, and therefore it is not necessary to pay such a great attention to the pollution caused thereby as in case of the principal ingredients constituting the photoconductive layer, but it is also preferable to use a substance which is as less pollutive as possible. From such a standpoint, also in view of the electrical and optical characteristics of the layer formed, a material such as B, Ga, P, Sb and the like is most preferred. In addition, for example, it is also possible to control the layer to n-type by interstitial doping of Li or others through thermal diffusion or implantation.

The amount of the impurity to be doped into the photoconductive layer, which is determined suitably depending on the electrical and optical characteristics desired, but in the range of, in case of an impurity of the Group IIIA in the Periodic table, generally from $10^{-6}$ to $10^{-3}$ atomic ratio, preferably from $10^{-5}$ to $10^{-4}$ atomic ratio to silicon atoms, and, in case of an impurity of the Group VA in the Periodic table, generally from $10^{-8}$ to $10^{-3}$ atomic ratio, preferably from $10^{-8}$ to $10^{-4}$ atomic ratio to silicon atoms.

Figure 2:
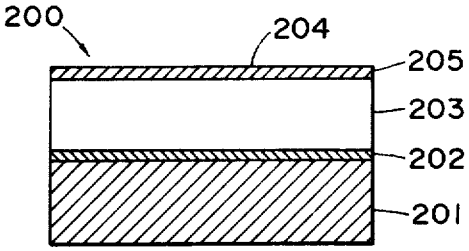

FIG. 2 shows a schematic sectional veiw of another embodiment of the photoconductive member of this invention. The photoconductive member 200 as shown in FIG. 2 has the same layer structure as the photoconductive member 100 as shown in FIG. 1, except that the upper layer 205 having the same function as the intermediate layer 202 is provided on the photoconductive layer 203.

That is, the photoconductive member 200 has an intermediate layer 202 a—$Si_xN_{1-x}$ formed of the same material as in the intermediate layer 102 so as to have the same function, a photoconductive layer 203 constituted of a—Si:H similar to the photoconductive layer 203, and the upper layer 205 having the free surface 204, which is provided on said photoconductive layer 203.

The upper layer 205 has the following functions. For example, when the photoconductive member 200 is used in a manner so as to form charge images by applying charging treatment on the free surface 204, the upper layer functions to bar injection of charges to be retained on the free surface 204 into the photoconductive layer 203, and, when irradiated by an electromagnetic wave, also to permit easily passage of the photocarriers generated in the photoconductive layer 203 or the charges at portions irradiated by an electromagnetic wave so that the carriers may be recombined with the charges.

The upper layer 205 may be constituted of a—$Si_xN_{1-x}$ having the same characteristics as that of the intermediate layer 202. Moreover, the upper layer may be constituted of an amorphous material comprising any one of silicon atoms (Si), carbon atoms (C), nitrogen atoms (N), and oxygen atoms (O), which are the matrix atoms constituting the photoconductive layer 203, or the amorphous material containing further at least one of hydrogen atoms (H) and halogen atoms (X); for example, a—$Si_xC_{1-x}$ containing at least one of hydrogen atoms (H) and halogen atoms (X), a—$Si_yN_{1-y}$, a—$Si_zN_{1-z}$ containing at least one of hydrogen atoms (H) and halogen atoms (X), a—$Si_aO_{1-a}$, a—$Si_bO_{1-b}$ containing at least one of hydrogen atoms (H) and halogen atoms (X).

Further, the upper layer may also be constituted of an inorganic insulating material such as $Al_2O_3$ etc. or an organic insulating material such as polyester, poly-p-xylylene, polyurethane, etc. However, in view of the productivity, mass productivity as well as the electrical and environmental stabilities during use, the material constituting the upper layer 205 is desirably a—$Si_xN_{1-x}$ having the same characteristics as that of the intermediate layer 202, a—$Si_xN_{1-x}$ containing at least one of hydrogen atoms (H) and halogen atoms (X), a—$Si_yC_{1-y}$, or a—$Si_zC_{1-z}$ containing at least one of hydrogen atoms and halogen atoms. In addition to those mentioned above, other materials suitable for constituting the upper layer 205 may include amorphous materials as matrix containing at least two of C, N and O together with silicon atoms, and also containing at least one of halogen atoms and hydrogen atoms. As the halogen atom, there may be mentioned F, Cl, Br, etc., but an amorphous material containing F is effective with respct to thermal stability.

When the photoconductive member 200 is used in such a manner as irradiation of an electromagnetic wave is applied to which the photoconductive layer 203 makes sensitive on the side of the upper layer 205, selection of the material constituting the upper layer 205 and determination of its layer thickness are conducted carefully so that a sufficient amount of the electromagnetic wave irradiated may reach the photoconductive layer 203 to cause generation of photocarriers with good efficiency.

The upper layer 205 may be formed by use of the same method and the same material as those in preparation of the intermediate layer 102. It is also possible to use the glow discharge method similarly as in formation of the photoconductive layer 103 or 203. Further, it can be formed according to the reactive sputtering method, using a gas for introduction of hydrogen atoms, a gas for introduction of halogen atoms or both thereof.

As the starting materials to be used for forming the upper layer 205, there may be employed those mentioned above which are used for the intermediate layer 102. In addition, the effective starting material convertible to the starting gas for introduction of halogen atoms is various halogen compounds, preferably a halogen gas, a halide or interhalogen compound which is gaseous or gasifiable.

Alternatively, it is also effective in the present invention to use gaseous or gasifiable silicon compound containing halogen atoms which may produce silicon atoms (Si) and halogen atoms (X) simultaneously.

Typical examples of halogen compounds preferably used in the present invention may include halogen gases such as fluorine, chlorine, bromine or iodine gas and interhalogen compounds such as BrF, ClF, $ClF_3$, $BrF_5$, $BrF_3$, $IF_7$, $IF_5$, ICl, IBr, and the like.

As the silicon compound containing halogen atoms, silicon halides such as $SiF_4$, $Si_2F_6$, $SiCl_4$, $SiBr_4$, or the like are preferred.

When the upper layer 205 is formed according to the glow discharge method by use of a silicon compound containing halogen atoms, it is not necessary to use a silicon hydride gas as the source gas capable of supplying Si. In forming the upper layer 205 according to the glow discharge method, the procedure basically comprises feeding a starting gas for supplying Si such as silicon hydride or a silicon halide, a gas of a starting material for introduction of carbon atoms, oxygen atoms or nitrogen atoms and, if necessary, a gas such as Ar, $H_2$, He, etc. at a predetermined mixing ratio in a suitable amount into the deposition chamber for forming the photoconductive member, followed by excitation of glow discharge to form a plasma atmosphere of these gases, thereby forming an upper layer on the photoconductive layer.

Each of the gases for introduction of respective atoms may be used not only a single species but also a mixture of plural species at a predetermined ratio.

In case of the reaction sputtering method, sputtering may be effected by using a target of Si in a plasma atmosphere of a gas comprising desired starting substances so as to be introduced as desirable atoms to form the upper layer. When, for example, halogen atoms are to be introduced into the upper layer formed, a gas of the aforesaid halogen compound or the silicon compound containing halogen atoms may be introduced into the deposition chamber to form a plasma atmosphere therein. Likewise, for introducing carbon atoms, oxygen atoms or nitrogen atoms into the upper layer, a corresponding starting gas for these atoms may be introduced into the deposition chamber.

Alternatively, the upper layer can be formed according to the reaction sputtering method by using a single crystalline or polycrystalline Si wafer, $Si_3N_4$ wafer, a wafer containing Si and $Si_3N_4$ mixed therein, $SiO_2$ wafer or a wafer containing Si and $SiO_2$ mixed therein as target, and effecting sputtering of these in various gas atmospheres so that desired upper layer may be formed. For example, when Si wafer is used as target, the starting gas for introduction of N and H, for example, $H_2$ and $N_2$ or $NH_3$, which may optionally be diluted with a diluting gas, if desired, are introduced into the deposition chamber for sputtering to form a gas plasma of these gases and effect sputtering of the aforesaid Si wafer. As other methods, by use of separate targets of Si and $Si_3N_4$ or one sheet of a mixture of Si and $Si_3N_4$, sputtering can be effected in a gas atmosphere containing at least hydrogen atoms (H).

In the present invention, as the starting material for introduction of halogen atoms in forming the upper layer, the halogen compounds or silicon compounds containing halogens as mentioned above can effectively be used. In addition, it is also possible to use effectively a gaseous or gasifiable halide containing hydrogen atom such as hydrogen halide, including HF, HCl, HBr, HI and the like or halogen-substituted silicon hydride, including $SiH_2F_2$, $SiH_2Cl_2$, $SiHCl_3$, $SiH_2Br_2$, $SiHBr_3$ and the like. These halides containing hydrogen atom can preferably be used as the starting material for introduction of halogen atoms, since hydrogen atoms (H) can be effectively introduced for controlling electrical or optical characteristics into the layer during formation of the upper layer simultaneously with introduction of halogen atoms (X).

As the starting material for introduction of carbon atoms in forming the upper layer, there may be mentioned saturated hydrocarbons having 1 to 4 carbon atoms, ethylenic hydrocarbons having 1 to 4 carbon atoms and acetylenic compounds having 2 to 3 carbon atoms. Typical examples are saturated hydrocarbons such as methane ($CH_4$), ethane ($C_2H_6$), propane ($C_3H_8$), n-butane (n—$C_4H_{10}$), pentane ($C_5H_{12}$) and the like; ethylenic hydrocarbons such as ethylene ($C_2H_4$), propylene ($C_3H_6$), butene-1 ($C_4H_8$), butene-2 ($C_4H_8$), isobutylene ($C_4H_8$), pentene ($C_5H_{10}$) and the like; and acetylenic hydrocarbons such as acetylene ($C_2H_2$), methylacetylene ($C_3H_4$), butyne ($C_4H_6$) and the like.

The starting material for incorporating oxygen atoms into the upper layer may include, for example, oxygen ($O_2$), ozone ($O_3$), carbon monoxide (CO), carbon dioxide ($CO_2$), nitrogen monoxide (NO), nitrogen dioxide ($NO_2$), dinitrogen monoxide ($N_2O$), and the like.

The starting material for incorporating nitrogen atoms into the upper layer may include compounds containing nitrogen as constituent as mentioned above in the starting material for incorporating oxygen atoms, and also include, for example, gaseous or gasifiable nitrogen compounds such as nitrogen, nitrides or azides constituted of nitrogen or nitrogen and hydrogen, as exemplified by nitrogen ($N_2$), ammonia ($NH_3$), hydrazine ($H_2NNH_2$), hydrogen azide ($HN_3$), ammonium azide ($NH_4N_3$), and the like.

In addition to those mentioned above, as the starting materials useful for formation of the upper layer, there are halogen-substituted paraffinic hydrocarbons such as $CCl_4$, $CHF_3$, $CH_2F_2$, $CH_3F$, $CH_3Cl$, $CH_3Br$, $CH_3I$, $C_2H_5Cl$, etc.; fluorinated sulfur compounds such as $SF_4$, $SF_6$, etc.; alkyl silicide such as $Si(CH_3)_4$, $Si(C_2H_5)$, etc; and halogen-containing alkyl silanes such as $SiCl(CH_3)_3$, $SiCl_2(CH_3)_2$, $SiCl_3CH_3$, etc.

These starting materials for forming the upper layer are suitably selected on forming so that the required atoms may be contained as constituent in the upper layer formed. For example, when using the glow discharge method, there may be employed a single gas such as $Si(CH_3)_4$ or $SiCl_2(CH_3)_2$ and the like, or a gas mixture such as $SiH_4$—$N_2O$ system, $SiH_4$—$O_2$(—Ar) system, $SiH_4$—$NO_2$ system, $SiH_4$—$O_2$—$N_2$ system, $SiH_4$—$NH_3$ system, $SiCl_4$—$NH_4$ system, $SiCl_4$—NO—$H_2$ system, $SiH_4$—$N_2$ system, $SiH_4$—$NH_3$—NO system, $Si(CH_3)_4$—$SiH_4$ system, $SiCl_2(CH_3)_2$—$SiH_4$ system, and the like as the starting material for formation of the upper layer.

Figure 3:
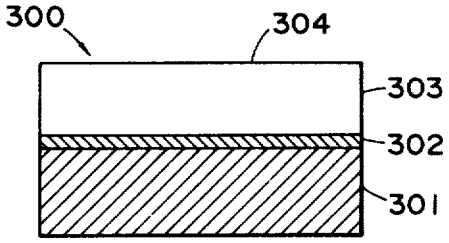

FIG. 3 shows a schematic sectional view for illustration of another basic embodiment of the photoconductive member of this invention.

The photoconductive member 300 as shown in FIG. 3 is one of the most basic embodiment, having a layer structure comprising a support 301 for photoconductive member, an intermediate layer 302 provided on said support and a photoconductive layer 303 provided in direct contact with said intermediate layer 302.

The support 301 and the photoconductive layer 303 are constituted of the same materials as described for the support 101 and the photoconductive layer 103 in FIG. 1, respectively.

The intermediate layer 302 is constituted of a non-photoconductive amorphous material containing silicon atoms (Si) and nitrogen atoms (N) as a matrix, and hydrogen atoms (H) [hereinafter referred to as a—$(Si_xN_{1-x})_y$:$H_{1-y}$, where $0<x<1$, $0<y<1$] and has the same function as of the intermediate layer 102 as described in FIG. 1.

The intermediate layer 302 constituted of a—$(Si_xN_{1-x})_y$:$H_{1-y}$ may be formed by a glow discharge method, a sputtering method, an ion implantation method, an ion plating method, an electron-beam method, or the like. These production methods are suitably selected, but it is preferred to use the glow discharge method or the sputtering method for the advantages of relatively easy control of the conditions for preparation of photoconductive members having desired characteristics as well as easy feasibleness of introduction of nitrogen atoms and hydrogen atoms together with silicon atoms into the intermediate layer 302 to be prepared.

Further, in the present invention, the glow discharge method and the sputtering method may be used in combination in the same apparatus system to form the intermediate layer 302.

For forming the intermediate layer 302 according to the glow discharge method, a starting gases for forming a—$(Si_xN_{1-x})_y$:$H_{1-y}$, which may optionally be mixed with a diluting gas at a predetermined ratio, are introduced into the deposition chamber for vacuum deposition in which the support 301 is placed, whereupon gas plasma is formed by exciting glow discharge of the gases introduced thereby to effect deposition of a—$(Si_xN_{1-x})_y$:$H_{1-y}$ on the aforesaid support 301.

As the starting gas to be used for formation of a—$(Si_xN_{1-x})_y$:$H_{1-y}$, most of gaseous substances or gassified products of gassifiable substances containing at least one of Si, N and H as constituent atoms may be available.

When a starting gas having Si as constituent atoms is used, it is possible to use a mixture of a starting gas having Si as constituent atoms, a starting gas having N as constituent atoms and a gas having H as constituent atoms at a desired mixing ratio. Alternatively, a mixture of a starting gas having Si as constituent atoms and a starting gas having N and H as constituent atoms at a desired mixing ratio can also be used.

As another method, it is also possible to use a mixture of a starting gas having Si and H as constituent atoms and a starting gas having N as constituent atoms.

In the present invention, the starting gas to be effectively used for forming the intermediate layer 302 is a silanes gas containing Si and H as constituent atoms, such as $SiH_4$, $Si_2H_6$, $Si_3H_8$, $Si_4H_{10}$ and the like, or a gaseous or gasifiable nitrogen compound containing N and H as constituent atoms such as nitrogen, nitrides and azides, including, for example, nitrogen ($N_2$), ammonia ($NH_3$), hydrazine ($H_2NNH_2$), hydrogen azide ($HN_3$), ammonium azide ($NH_4N_3$) and the like. In addition to these starting gases, $H_2$ can of course be effectively used as the starting gas for introduction of hydrogen atoms (H).

For forming the intermediate layer 302 by the sputtering method, they may be used a single crystalline or polycrystalline Si wafer, $Si_3N_4$ wafer or a wafer which is formed with a mixture composing of Si and $Si_3N_4$, as target, and effected sputtering of these in various gas atmospheres so that a desired intermediate layer may be formed. For example, when Si wafer is used as target, the starting gas for introduction of N and H, for example, $H_2$ and $N_2$ or $NH_3$, which may optionally be diluted with a diluting gas, if desired, may be introduced into the deposition chamber for sputtering to form a gas plasma of these gases and effect sputtering of the aforesaid Si wafer. As other methods, by use of separate targets of Si and $Si_3N_4$ or one sheet of a molded mixture of Si and $Si_3N_4$, sputtering can be effected in a gas atmosphere containing at least hydrogen atoms (H).

As the starting gases for introduction of nitrogen atoms (N) and hydrogen atoms (H), there may be employed the starting gases for forming the intermediate layer exemplified in the glow discharge method as effective gases also in the sputtering.

In the present invention, the diluting gas to be used in forming the intermediate layer by the glow discharge method or the sputtering method is preferably a so called rare gas such as He, Ne, Ar, and the like.

The intermediate layer 302 in the present invention is formed carefully so that the characteristics required may be given exactly as desired.

That is, a substance constituted of silicon atoms (Si), nitrogen atoms (C) and hydrogen atoms (H) can structurally take a form from a crystalline to amorphous state, exhibiting as electrical properties from eelectroconductive through semi-conductive to insulating, and from photoconductive to non-conductive, respectively. Hence, in the present invention, the conditions for preparation of a—$(Si_xN_{1-x})_y:H_{1-y}$ which must be non-conductive at least in the visible light region are severely selected.

Since the function of a—$(Si_xN_{1-x})_y:H_{1-y}$ constituting the intermediate layer 302 of this invention is to bar penetration of carriers from the side of the support 301 into the photoconductive layer 303, while permitting easily the photocarriers generated in the photoconductive layer 303 to be migrated and passed therethrough to the side of the support 303, it is preferable to be formed so as to exhibit insulating behaviors at least in the visible light regions. Also, a—$(Si_xN_{1-x})_y:H_{1-y}$ is prepared so as to have a mobility value with respect to passing carriers to the extent that passing of photocarriers generated in the photoconductive layer 303 may be passed smoothly through the intermediate layer 302.

As a critical element in the conditions for preparation of a—$(Si_xN_{1-x})_y:H_{1-y}$ having the above characteristics, there may be mentioned the support temperature during preparation thereof.

In other words, in forming an intermediate layer 302 constituted of a—$(Si_xN_{1-x})_y:H_{1-y}$ on the surface of the support 301, the support temperature during the layer formation is an important factor affecting the structure and characteristics of the layer formed. In the present invention, the support temperature during the layer formation is severely controlled so that the a—$(Si_xN_{1-x})_y:H_{1-y}$ having the intended characteristics may be prepared exactly as desired.

In order that the objects of the present invention may be achieved effectively, the support temperature during formation of the intermediate layer 302, which is selected conveniently within an optimum range depending on the method employed for formation of the intermediate layer 302, is generally 100° to 300° C. preferably 150° to 250° C.

For forming the intermediate layer 302, it is advantageous to adopt a glow discharge method or a sputtering method, since these methods can afford severe controlling of the atomic ratios constituting each layer or layer thickness with relative ease as compared with other methods, when forming continuously the photoconductive layer 303 on the intermediate layer 302 in the same system, and further a third layer formed on the photoconductive layer 303, if desired. In case of forming the intermediate layer 302 according to these layer forming methods, the discharging power and the gas pressure during layer formation may also be mentioned, similarly as the support temperature as described above, as the important factors influencing the characteristics of a—$(Si_xN_{1-x})_y:H_{1-y}$ to be prepared.

In such methods for preparation of the intermediate layer, the discharging power condition for preparing effectively with good productivity a—$(Si_xN_{1-x})_y:H_{1-y}$ having characteristics for accomplishment of the object of this invention is generally 1 W to 300 W, preferably 2 W to 100 W. The gas pressure in the deposition chamber according to the glow discharge method is generally in the range of from 0.01 to 5 Torr, preferably from 0.1 to 0.5 Torr, while according to the sputtering method it is generally in the range of from $1\times10^{-3}$-$5\times10^{-2}$ Torr, preferably from $8\times10^{-3}$-$3\times10^{-2}$ Torr.

The contents of the nitrogen (N) and hydrogen atoms (H) in the intermediate layer 302 in the photoconductive member 300 of this invention are also important factors for forming the intermediate layer 302 with desired characteristics to achieve the objects of this invention, similarly as the condition for preparation of the intermediate layer 302.

The content of nitrogen atoms (N) in the intermediate layer 302 of this invention is generally 25 to 35 atomic %, preferably 35 to 55 atomic %. As for the content of the hydrogen atoms (H), it is generally 2 to 35 atomic %, preferably 5 to 30 atomic %. The photoconductive member formed with the content of hydrogen atoms within the specified range can be sufficiently useful in practical applications.

That is, in terms of the representation a—$(Si_xN_{1-x})_y:H_{1-y}$ as previously indicated, x is generally 0.43 to 0.60, preferably 0.43 to 0.50, and y is generally 0.98 to 0.65, preferably 0.95 to 0.70.

The thickness of the intermediate layer 302 in the present invention is also another important factor to effectively achieve the objects of the present invention and it is desired to be within the same range as specified with respect to the intermediate layer 102 in FIG. 1.

Figure 4:
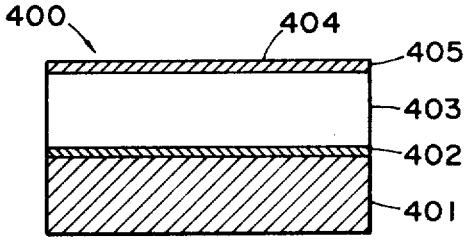

FIG. 4 shows a schematic sectional view of another embodiment in which the layer constitution of the photoconductive member as shown in FIG. 3 is modified.

The photoconductive member 400 shown in FIG. 4 has the same layer structure as of the photoconductive member 300 shown in FIG. 3, except that the upper layer 405 having the same function as of the intermediate layer 402 is provided on the photoconductive layer 403.

That is, the photoconductive member 400 has, provided on the same support 401 as the support 101, an intermediate layer 402 formed by use of a—$(Si_xN_{1-x})_y:H_{1-y}$ of the same material as the intermediate layer 302 so as to have a similar function, a photoconductive layer 403 constituted of a—Si:H like the photoconductive layer 103 or 203, and an upper layer 405 having a free surface 404 provided on said photoconductive layer 403.

The upper layer 405 has the functions similar to the upper layer 205 as shown in FIG. 2. Namely, the upper layer 405 has the function to permit readily passing of photocarriers or charges so that the photocarriers generated in the photoconductive layer 403 so that charges at the portion irradiated by an electromagnetic wave may undergo recombination.

The upper layer 405 may be constituted of a—$(Si_xN_{1-x})_y:H_{1-y}$ having the same characteristics as of the intermediate layer 402, or otherwise it may be constituted of matrix atoms for constituting the photoconductive layer of silicon atom (Si) and nitrogen atom (N) or oxygen atom (O) such as a—$Si_aC_{1-a}$, a—$(Si_aC_{1-a})_b:H_{1-b}$, a—$(Si_cO_{1-c})$, a—$(Si_cO_{1-c})_d:H_{1-d}$, and the like or an amorphous material containing these atoms as matrix and further containing hydrogen atoms (H), or such an amorphous material containing further halogen atoms (X), inorganic insulating materials such as $Al_2O_3$ etc., or organic insulating materials such as polyester, poly-p-xylene, polyurethane, and the like.

However, as the materials constituting the upper layer 405, in view of the productivity, capability of mass production as well as the electrical and environmental stabilities during usage, it is preferred to use the same material a—$(Si_xN_{1-x})_y:H_{1-y}$ as of the intermediate layer 402, or a—$Si_aC_{1-a}$, a—$(Si_aC_{1-a})_b:H_{1-b}$, a—$Si_cN_{1-c}$, a—$(Si_dC_{1-d})_e:X_{1-e}$, a—$(Si_fC_{1-f})_g:(H+X)_{1-g}$, a—$(Si_hN_{1-h})_i:X_{1-i}$, or a—$(Si_jN_{1-j})_k:(H+X)_{1-k}$.

In addition to those as mentioned above, there may be mentioned amorphous materials containing silicon atom (Si) and as matrix at least two atoms among C, N and O atoms and containing halogen atom (X) or halogen atom (X) and hydrogen atom (H) as suitable materials constituting the upper layer 405.

As the halogen atom (X), F, Cl and Br may be used, but among the amorphous materials mentioned above, those containing F are effective from a standpoint of thermal stability.

Figure 5:
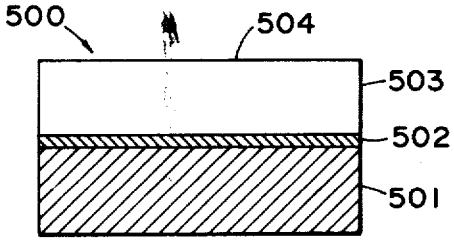

FIG. 5 shows a schematic sectional view of still another embodiment of the photoconductive member of this invention.

The photoconductive member 500 shown in FIG. 5 has a layer structure comprising a support 501 for photoconductive member, an intermediate layer 502 provided on said support and a photoconductive layer 503 provided in direct contact with said intermediate layer 502.

The support 501 and the photoconductive layer 503 are constituted, of the same materials as described for the support 101 and the photoconductive layer 103 in FIG. 1, respectively.

The intermediate layer 502 is constituted of a non-photoconductive amorphous material containing silicon atoms and nitrogen atoms as matrix, and also containing halogen atoms (X) [hereinafter referred to as a—$(Si_xN_{1-x})_y:X_{1-y}$, where $0>x>1$, $0>y>1$], and has the same function as those of intermediate layers described above.

The intermediate layer 502 may be formed according to the same method as described in formation of the intermediate layer 302 in FIG. 3, namely by the glow discharge, sputtering, ion imprantation, ion plating or electron beam method.

That is, for forming the intermediate layer 502 according to the glow discharge method, a starting gas for a—$(Si_xN_{1-x})_y:X_{1-y}$, which may optionally be mixed with a diluting gas at a predetermined ratio, is introduced into the deposition chamber for vacuum deposition in which the support 501 is placed, whereupon gas plasma is formed by exciting glow discharge of the gas introduced thereby to effect deposition of a—$(Si_xN_{1-x})_y:X_{1-y}$ on the aforesaid support 501. As the starting gas to be used for forming a—$(Si_xN_{1-x})_y:X_{1-y}$, most of gaseous substances or gasified products of gasifiable substances containing at least one of Si, N and X as constituent atoms may be available.

When a starting gas having Si as constituent atoms is to be used, it is possible to use a mixture of a starting gas having Si as constituent atoms, a starting gas having N as constituent atoms and a gas having X as constituent atoms at a desired mixing ratio. Alternatively, a mixture of a starting gas having Si as constituent atoms and a starting gas having N and X as constituent atoms at a desired mixing ratio may also be used.

As another method, it is also possible to use a mixture of a starting gas having Si and X as constituent atoms and a starting gas having N as constituent atoms.

In the present invention, desirable halogen atoms (X) are F, Cl, Br and I, preferably F and Cl.

In the present invention, the intermediate layer 502, which is constituted of a—$(Si_xN_{1-x})_y:X_{1-y}$, may further contain hydrogen atoms (H) incorporated therein. In the case of such a system of layer structure containing hydrogen atoms incorporated in the intermediate layer 502, a part of the starting gases can commonly be used in continuous formation of layers subsequent to the formation of the photoconductive layer 503 to a great advantage in production cost.

In the present invention, the starting gases which can effectively be used in formation of the intermediate layer 502 are those which are gaseous state at normal temperature under normal pressure or which can readily be gasified.

Such starting materials for formation of the intermediate layer may include, for example, nitrogen compounds such as nitrogen, nitrides, azides as mentioned above and also nitrogen fluoride, simple substances of halogen, hydrogen halides, interhalogen compounds, silicon halides, halo-substituted silanes, silanes, and the like. More specifically, there may be included nitrogen fluorides such as nitrogen trifluoride ($F_3N$), nitrogen tetrafluoride ($F_4N_2$) simple substances of halogen such as halogen gases of fluorine, chlorine, bromine and iodine; hydrogen halides such as HF, HI, HCl, HBr, and the like; interhalogen compounds such as BrF, ClF, $ClF_3$, $ClF_5$, $BrF_5$, $BrF_3$, $IF_7$, $IF_5$, ICl, IBr, and the like; silicon halides such as $SiF_4$, $Si_2F_6$, $SiCl_4$, $SiCl_3Br$, $SiCl_2Br_2$, $SiClBr_3$, $SiCl_3I$, $SiBr_4$; halogene-substituted silanes such as $SiH_2F_2$, $SiH_2Cl_2$, $SiHCl_3$, $SiH_3Cl$, $SiH_3Br$, $SiH_2Br_2$, $SiHBr_3$; and silanes such as $SiH_4$, $Si_2H_6$, $Si_3H_8$, $Si_4H_{10}$, and the like.

The starting materials for forming these intermediate layers are selected and used as desired so that the silicon atoms (Si), nitrogen atoms (N) and halogen atoms (X), and, if necessary, hydrogen atoms (H) may be contained at a predetermined ratio in the intermediate layer to be formed.

For example, an intermediate layer comprising a—$Si_xN_{1-x}:X:H$ can be formed by introducing $SiH_4$ or $Si_2H_6$, which can form readily the intermediate layer with desired characteristics and easily contain silicon atoms and hydrogen atoms; $N_2$ or $NH_3$ which is a source of nitrogen atom (N); and $SiF_4$, $SiH_2F_2$, $SiHCl_3$, $SiCl_4$, $SiH_2Cl_2$ or $SiH_3Cl$ which is a source of halogen atoms (X); at a predetermined mixing ratio in a gaseous state into the device, following by excitation of glow discharge therein.

Alternatively, it is also possible to form an intermediate layer constituted of a—$Si_xN_{1-x}:F$ by introducing a mixture of $SiF_4$ capable of incorporating silicon atom (Si) and halogen atom (X) and $N_2$ for incorporation of nitrogen atom (N) at a predetermined ratio, together with, if desired, a rare gas such as He, Ne, Ar, and the like, into a device system formation of an intermediate layer, followed by excitation of glow discharge therein.

For forming the intermediate layer 502 by the sputtering method, there may be used as target a single crystalline or polycrystalline Si wafer, $Si_3N_4$ wafer or a wafer containing Si and $Si_3N_4$ mixed therein, and effected sputtering of these in various gas atmospheres, containing halogen atoms and, if necessary, hydrogen atoms as constituent elements.

For example, when Si wafer is used as target, the starting gas for introduction of N and X, which may optionally be diluted with a diluting gas, if desired, are introduced into the deposition chamber for sputtering to form a gas plasma of these gases and effect sputtering of the aforesaid Si wafer. As other methods, by use of separate targets of Si and $Si_3N_4$ or one sheet of a molded mixture of Si and $Si_3N_4$, sputtering can be effected in a gas atmosphere containing at least halogen atoms.

As the starting gases for introduction of nitrogen atoms (N) and halogen atoms (X), if necessary, and hydrogen atoms there may be employed the starting gases exemplified in the glow discharge method as effective gases also in the sputtering.

In the present invention, the diluting gas to be used in forming the intermediate layer 502 by the glow discharge method or the sputtering method is preferably a so called rare gas such as He, Ne, Ar, and the like.

The intermediate layer 502 in the present invention is formed carefully so that the characteristics required may be given exactly as desired.

That is, a substance constituted of silicon atoms (Si), nitrogen atoms (N) and halogen atoms (x), if necessary, hydrogen atoms (H) can structurally take a form from a crystalline to amorphous state, exhibiting electrical properties from electroconductive through semi-conductive to insulating, and from photoconductive to non-conductive, respectively. Hence, in the present invention, the conditions for preparation are severely selected in order to accomplish the object of the invention so that the layer may exhibit non-conductive under the environment employed.

Since the function of the intermediate layer 502 is the same as of the intermediate layer described above, a—$(Si_xN_{1-x})_y:X_{1-y}$ constituting the intermediate layer 502 is formed so as to exhibit insulating behaviors.

As another critical element in the conditions for preparation of a—$(Si_xN_{1-x})_y:X_{1-y}$ so as to have a mobility value with respect to passing carriers to the extent that passing of photocarriers generated in the photoconductive layer 503 may be passed smoothly through the intermediate layer 502, there may be mentioned the support temperature during preparation thereof. In the present invention, the support temperature during the layer formation is severely controlled so that the a—$(Si_xN_{1-x})_y:X_{1-y}$ having the intended characteristics may be prepared exactly as desired.

In order that the objects of the present invention may be achieved effectively, the support temperature during formation of the intermediate layer 502, which is selected conveniently within an optimum range depending on the method employed for forming the intermediate layer 502, is generally 100° to 300° C., preferably 150° to 250° C.

For forming the intermediate layer 502, it is advantageous to adopt the glow discharge method or the sputtering method, since these methods can afford severe controlling of the atomic ratios constituting each layer or layer thickness with relative ease as compared with other methods, when forming continuously the photoconductive layer 503 on the intermediate layer 502 in the same system, and further a third layer formed on the photoconductive layer 503, if desired. In case of forming the intermediate layer 502 according to these layer forming methods, the discharging power during layer formation may also be mentioned, similarly as the support temperature as described above, as one of the important factors influencing the characteristics of a—$(Si_xN_{1-x})_y:X_{1-y}$ to be prepared.

In such methods for preparation of the intermediate layer, the discharging power condition for preparing effectively with good productivity a—$(Si_xN_{1-x})_y:X_{1-y}$ having characteristics for accomplishment of the object of this invention is generally 10 W to 300 W, preferably 20 W to 100 W. The gas pressure in the deposition chamber in forming said intermediate layer is generally in the range of from 0.01 to 5 Torr, preferably from 0.1 to 0.5 Torr, according to the glow discharge method, or generally in the range of from $1\times10^{-3}$ to $5\times10^{-2}$ Torr, preferably from $8\times10^{-3}$ to $3\times10^{-2}$ Torr according to the sputtering method.

The contents of the nitrogen atoms (N) and halogen atoms (X) in the intermediate layer 502 in the photoconductive member of this invention are also important factors for forming the intermediate layer 502 with desired characteristics to achieve the objects of this invention, similarly as the condition for preparation of the intermediate layer 502.

The content of nitrogen atoms (N) in the intermediate layer 502 of this invention is generally 30 to 60 atomic %, preferably 40 to 60 atomic %. As for the content of the halogen atoms (X), it is generally 1 to 20 atomic %, preferably 2 to 15 atomic %. The photoconductive member formed with the content of halogen atoms within the specified range can be sufficiently useful in practical application. As the content of hydrogen atoms (H) contained, if necessary, it is generally 19 atomic % or less, preferably 13 atomic % or less.

That is, in terms of the representation a—$(Si_xN_{1-x})_y:X_{1-y}$ as previously indicated, x is generally 0.43 to 0.60, preferably 0.49 to 0.43, and y is generally 0.99 to 0.80, preferably 0.98 to 0.85.

When both of halogen atoms and hydrogen atoms are contained, the numerical ranges for x and y in terms of representation of a—$(Si_xN_{1-x})_y:(H+X)_{1-y}$ are substantially the same as in the case of a—$(Si_xN_{1-x})_y:X_{1-y}$.

The layer thickness of the intermediate layer 502 in the present invention is also another important factor to effectively achieve the objects of the present invention and it is desired to be within the same numerical range as specified with respect to the intermediate layers previously described.

Figure 6:
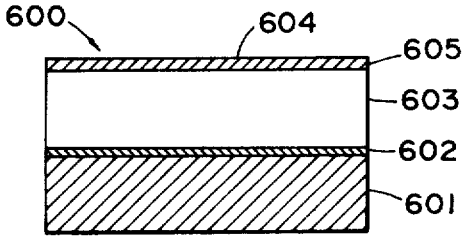

FIG. 6 shows a schematic sectional view of another embodiment in which the layer constitution of the photoconductive member as shown in FIG. 5 is modified.

The photoconductive member 600 shown in FIG. 6 has the same layer structure as the photoconductive member 500 as shown in FIG. 5, except that the upper layer 605 having the same function as the intermediate layer 602 is provided on the photoconductive layer 603.

That is, the photoconductive member 600 has an intermediate layer 602 on the support 601 of the same material as in the intermediate layer 502 so as to have the same function, a photoconductive layer 603 constituted of a—Si:H similar to the photoconductive layer 503, and the upper layer 605 having the free surface 604, which is provided on said photoconductive layer 603.

The upper layer 605 has the same function as of the upper layer 205 shown in FIG. 2 or the upper layer 405 shown in FIG. 4.

The upper layer 605 may be constituted of a—$(Si_xN_{1-x})_y:X_{1-y}$ which contains hydrogen atoms if necessary, having the same characteristics as the intermediate layer 602. Alternatively, it may constituted of an amorphous material consisting of silicon atoms (Si) and carbon atoms (C) or oxygen atoms (O), which are matrix atoms constituting the photoconductive layer 603 or constituted of these matrix atoms containing further hydrogen atoms, or/and halogen atoms, such as for example, a—$Si_aC_{1-a}$, (a—$Si_aC_{1-a})_b:H_{1-b}$, a—$(Si_aC_{1-a})_b:(H+X)_{1-b}$, a—$Si_cO_{1-c}$, a—$(Si_cO_{1-c})_d:H_{1-d}$, a—$(Si_cO_{1-c})_d:(H+X)_{1-d}$, etc.; an inorganic insulating material such as $Al_2O_3$, and the like; or an organic insulating material such as polyester, poly-po-xylylene, polyurethane and the like. However, in view of the productivity, mass productivity as well as the electrical and environmental stabilities during use, the material constituting the upper layer 605 is desirably a—$(Si_xN_{1-x})_y:X_{1-y}$ having the same characteristic as of the intermediate layer 602; a—$(Si_aC_{1-a})_b:H_{1-b}$, a—$(Si_aC_{1-a})_b:X_{1-b}$, a—$(Si_aC_{1-a})_b:(H+X)_{1-b}$, a—$(Si_eN_{1-e})_f:H_{1-f}$, a—$(Si_eN_{1-e})_f:X_{1-f}$, a—$(Si_eN_{1-e})_f:(H+X)_{1-f}$ or a—$Si_aC_{1-a}$ or a—$Si_eN_{1-e}$ containing no halogen atom (X) and hydrogen atom (H).

As the materials constituting the upper layer 605 in addition to those as mentioned above, there may preferably be used amorphous materials having silicon atom (Si) and at least two atoms of C, N and O as a matrix, and containing halogen atoms, or halogen atoms and hydrogen atoms. As the halogen atoms, there maybe mentioned F, Cl, or Br, but among the amorphous materials as mentioned above, those containing F are effective from a standpoint of thermal stability.

Figure 7:
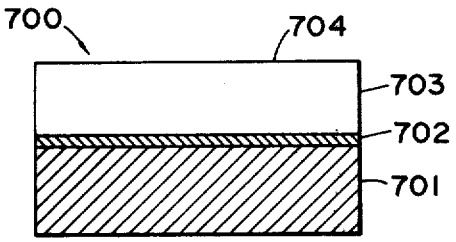

FIG. 7 shows a schematic sectional view for illustration of the basic embodiment of the photoconductive member of this invention.

The photoconductive member 700 shown in FIG. 7 is one of the most basic embodiment, having a layer structure comprising a support 701 for photoconductive member, an intermediate layer 702 provided on said support and a photoconductive layer 703 provided in direct contact with said intermediate layer 702.

The support 701 and the intermediate layer 702 are made of the same materials as of the support 101 and the intermediate layer 102 shown in FIG. 1, respectively, and can be prepared by the same method and under the same conditions.

In the present invention, in order to achieve its ojbects effectively, the photoconductive layer 703 laminated on the intermediate layer 702 is constituted of a—Si:X having the semi-conductor characteristics as shown below.

⑥ p-type a—Si:X—Containing only acceptor; or containing both donor and acceptor with higher concentration of acceptor (Na);

⑦ $p^-$-type a—Si:X—A type of ⑥, which contains acceptor at low concentration (Na), for example, being doped very lightly with so called p-type impurities;

⑧ n-type a—Si:X—Containing only donor; or containing both donor and acceptor with higher concentration of donor (Nd);

⑨ $n^-$-type a—Si:X—A type of ⑧, which contains donor at low concentration (Nd), and lightly doped with so called n-type impurities;

⑩ i-type a—Si:X—where $Na \simeq Nd \simeq O$ or $Na \simeq Nd$.

In the present invention, a—Si:X constituting the photoconductive layer 702, since it is provided through the intermediate layer 702 on the support, may be applicable for relatively lower electric resistivity than as usual. But, for obtaining better results, the dark resistivity of the photoconductive layer 703, formed may preferably be $5\times10^9$ Ωcm or more, most preferably $10^{10}$ Ωcm or more.

In particular, the numercial condition for the dark resistivity values is an important factor when using the prepared photoconductive member as an image forming member for electrophotography, as a high sensitive reading device or an image pick-up device to be used under low illuminance regions, or as a photoelectric converter.

In the present invention, typical examples of halogen atoms (X) incorporated in the photoconductive layer 703 may include fluorine, chlorine, bromine and iodine. Among them, fluorine and chlorine are particularly preferred.

The expression "X is incorporated in the layer" herein mentioned means the state, in which "X is bonded to Si", or in which "X is ionized to be incorporated in the layer", or in which "X is incorporated as $X_2$ in the layer" or the state in combination thereof.

In the present invention, the layer constituted of a—Si:X is formed by the vacuum deposition method, utilizing discharging phenomenon, such as the glow discharge method, the sputtering method or the ion plating method. For example, in order to form a—Si:X layer according to the glow discharge method, a starting gas for introduction of halogen atoms together with a Si-supply starting gas capable of generating Si are fed into a deposition chamber, which can be brought internally to reduce pressure, and glow discharging is excited in said deposition chamber thereby to form a layer of a—Si:X on the surface of the intermediate layer which is formed on the support previously placed at a predetermined position therein. When the layer is formed according to the sputtering method, a gas for introduction of halogen atoms may be introduced into the deposition chamber for sputtering when effecting sputtering of Si target in an atmosphere of an inert gas such as Ar or He, or a gas mixture principally composed of these gases.

The starting gas for supplying Si to be used in the present invention for forming the photoconductive layer 703 may include those as described above for forming the photoconductive layer 103 shown in FIG. 1.

In the present invention, the effective starting gases for introduction of halogen atoms in forming the photoconductive layer 703 may include a number of halogen compounds, preferably gaseous or gasifiable halogen compounds, such as, for example, halogen gases, halides, interhalogen compounds, halo-substituted silane derivatives and the like.

Further it is also possible to use effectively a silicon compound containing halogen atoms, which is capable of supplying silicon atoms (Si) and halogen atoms (X) simultaneously.

The halogen compounds preferably used in the present invention are halogen gases such as fluorine, chlorine, bromine and iodine; interhalogen compounds such as BrF, ClF, $ClF_3$, $ClF_5$, $BrF_3$, $IF_7$, $IF_5$, ICl, IBr, and the like.

As a silicon compound containing halogen atoms, namely so called halogen-substituted silane derivative, such as $SiF_4$, $Si_2F_6$, $SiCl_4$, $SiBr_4$ and the like, are preferred.

When the photoconductive layer 703 is formed according to the glow discharge method with using such a halogen-containing silicon compound, a photoconductive layer of a—$Si_x$:X may be formed on a predetermined support without use of a silane gas as a starting gas capable of supplying Si.

In forming the photoconductive layer constituted of a—Si:X according to the glow discharge method, the basically procedures comprises feeding a starting silicon halide gas for supplying Si together with a gas such as Ar, $H_2$, He, and the like at a predetermined mixing ratio in a suitable amount into the deposition chamber for forming the photoconductive layer of a—Si:X, followed by excitation of glow discharge to form a plasma atmosphere of these gases, thereby forming photoconductive layer of a—Si:X in contact with the intermediate layer formed on a support. It is also possible to mix further a gas of a silicon compound containing hydrogen atoms with these gases in a suitable amount.

Each of these gases may be either a single species or a mixture of plural species at a predetermined ratio. In forming the photoconductive layer of a—Si:X by the reactive sputtering method or the ion plating method, for example, in case of the reaction sputtering method, a target of Si can be used and sputtering effected in a plasma atmosphere. In case of the ion plating method, a polycrystalline silicon or a single crystalline silicon is placed as a source in a vapor deposition boat, which silicon source is vaporized by heating according to the resistance heating method, the electron beam method or the like, thereby permitting the vapors dissipated from the boat to pass through a gas plasma atmosphere.

In either of the sputtering method or the ion plating method, halogen atoms can be introduced into the layer formed by feeding a gas of the aforesaid halogen compound or the aforesaid halogen-containing silicon compound into the deposition chamber to form a plasma atmosphere of said gas therein.

In the present invention, the above halogen compounds or halogen-containing silicon compounds can effectively be used. Additionally, it is also possible to use as effective substance for forming the photoconductive layer a gaseous or a gasifiable halide containing hydrogen as one of the constituent elements, as exemplified by hydrogen halides such as HF, HCl, HBr, HI and the like; halogen-substituted silanes such as $SiH_2F_2$, $SiH_2Cl_2$, $SiHCl_3$, $SiH_2Br_2$, $SiHBr_3$, etc.

These halides containing hydrogen atoms may preferably be used as starting gases for introducing halogen atoms, since they can also introduce hydrogen atoms, which can very effectively control the electrical or photoconductive characteristics, simultaneously with introduction of halogen atoms into the photoconductive layer.

Alternatively, in order to incorporate hydrogen atoms structurally into the photoconductive layer of a—Si:X, it is also possible to use materials other than those as mentioned above, such as $H_2$ or a silane gas (e.g. $SiH_4$, $Si_2H_6$, $Si_3H_8$, $Si_4H_{10}$ and the like). Such a gas can be permitted to co-exist with a silicon compound for formation of a—Si in the deposition chamber for exciting discharging.

For example, in the reaction sputtering method, Si target is used, and a gas for introducing halogen atoms and $H_2$ gas together with, if necessary, an inert gas such as He, Ar, etc. are introduced into the deposition chamber to form a plasma atmosphere, thereby effecting sputtering of the aforesaid Si target, to form on the surface of a support a photoconductive layer constituted of a—Si:X having desired characteristics with hydrogen atoms incorporated therein.

Further, it is also possible to introduce a gas such as $B_2H_6$, $PH_3$, $PF_3$ and the like, so that doping of impurities may also concurrently be effected.

In the present invention, the content of halogen atoms (X) or the total contents of X and H in the photoconductive layer is generally 1 to 40 atomic %, preferably 5 to 30 atomic %. The content of H in the layer can be controlled by adjusting the depositing support temperature or/and the quantity of the starting material for incorporation of H to be introduced into the deposition device, discharging power or others.

In order to make the photoconductive layer 703 n-type, or p-type, it may be achieved by doping n-type impurity, p-type impurity or both into the layer in a controlled amount during formation of the layer by the glow discharge method or the reaction sputtering method.

As the impurity to be doped into the photoconductive layer 703, there may be mentioned preferably an element of the Group IIIA in the Periodic table, for example, B, Al, Ga, In, Tl, etc.

On the other hand, for obtaining a n-type, there may preferably be used an element of the Group VA, in the Periodic table, such as N, P, S, As, Sb, Bi, etc.

In addition, for example, it is also possible to control the layer to n-type by interstitial doping of Li or others through thermal diffusion or implantation. The amount of the impurity to be doped into the photoconductive layer 703, which is determined suitably depending on the electrical and optical characteristics desired, but in the range of, in case of an impurity of the Group IIIA in the Periodic table, generally from $10^{-6}$ to $10^{-3}$ atomic ratio, preferably from $10^{-5}$ to $10^{-4}$ atomic ratio, and, in case of an impurity of the Group VA in the Periodic table, generally from $10^{-8}$ to $10^{-3}$ atomic ratio, preferably from $10^{-8}$ to $10^{-4}$ atomic ratio.

Figure 8:
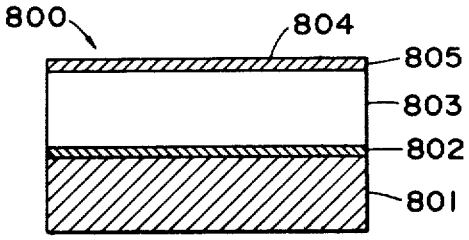

FIG. 8 shows a schematic sectional view of another embodiment of the photoconductive member of this invention in which the layer structure shown in FIG. 7 is modified. The photoconductive member 800 shown in FIG. 8 has the same layer structure as of the photoconductive member 700 shown in FIG. 7, except that the upper layer 805 having the same function as of the intermediate layer 802 is provided on the photoconductive layer 803.

That is, the photoconductive member 800 has an intermediate layer 802 formed on the support 801 so as to have the same function, a photoconductive layer 803 constituted of a—Si:X like the photoconductive layer 703 shown in FIG. 7, in which H may optionally be incorporated, and an upper layer 205 having a free surface 804 provided on said photoconductive layer 803.

The upper layer 805 has the same functions as described for the embodiments set forth above and is constituted of the same material.

Figure 9:
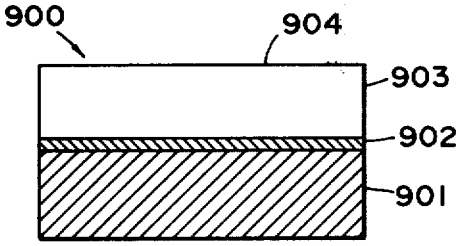

FIG. 9 shows a schematic sectional view of still another embodiment of the photoconductive member of this invention.

The photoconductive member 900 shown in FIG. 9 has a layer structure comprising a support 900 for photoconductive member, an intermediate layer 902 similar to the intermediate layer 302 shown in FIG. 3 provided on said support and a photoconductive layer 903 provided in direct contact with said intermediate layer 902.

The support 901 may be either electroconductive, electrical or insulating in nature as previously described for the support in the embodiments set forth above.

Figure 10:
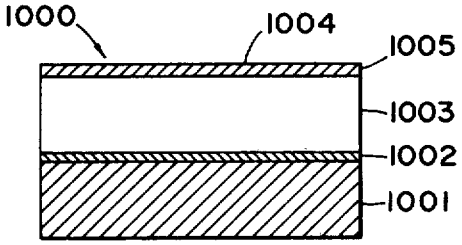

FIG. 10 shows a schematic sectional view of another embodiment in which the layer structure of the photoconductive member shown in FIG. 9 is modified.

The photoconductive member 1000 shown in FIG. 10 has the same layer structure as of the photoconductive member 900 shown in FIG. 9, except that the upper layer 1005 having the same function as of the intermediate layer 1002 is provided on the photoconductive layer 1003.

That is, the photoconductive member 1000 comprises an intermediate layer 1002 on the support 1001 similar to the support as previously described of the same material a—$(Si_xN_{1-x})_y:H_{1-y}$ as in the intermediate layer 902 so as to have the same function, a photoconductive layer 1003 constituted of a—Si:X similar to the photoconductive layer 703 shown in FIG. 7 further containing hydrogen atoms (H) if desired, and the upper layer 1005 having the free surface 1004, which is provided on said photoconductive layer 1003.

The upper layer 1005 may be constituted of a—$(Si_xN_{1-x})_y:H_{1-y}$ having the same characteristic as of the intermediate layer 1002. Alternatively, it may be constituted of the same material constituting the upper layers in the embodiments as set forth above.

Figure 11:
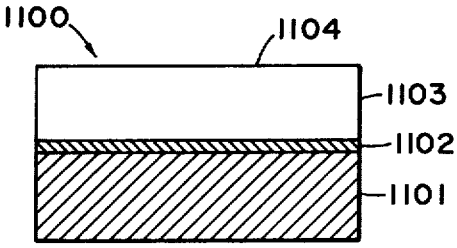

FIG. 11 shows a schematic sectional view of still another embodiment of the photoconductive member of this invention.

The photoconductive member 1100 as shown in FIG. 11 has a layer structure comprising a support 1101 for photoconductive member, an intermediate layer 1102 similar to the intermediate layer 502 shown in FIG. 5 provided on said support and a photoconductive layer 1103 similar to the intermediate layer 703 shown in FIG. 7 provided in direct contact with said intermediate layer 1102.

Figure 12:
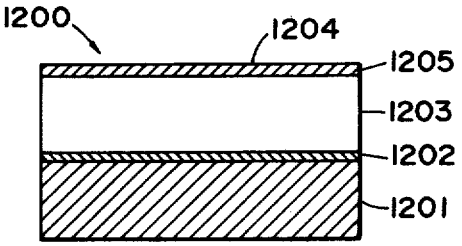

FIG. 12 shows a schematic sectional view of another embodiment in which the layer constitution of the photoconductive member as shown in FIG. 11 is modified.

The photoconductive member 1200 shown in FIG. 12 has the same structure as the photoconductive member 1100 shown in FIG. 11 except that the upper layer 1205 having the same function as the intermediate layer 1202 is provided on the photoconductive layer 1203.

That is, the photoconductive member 1200 has an intermediate layer 1202 on the support 1201 of the same material as in the intermediate layer 1102 so as to have the same function, a photoconductive layer 1203 constituted of a—Si:X similar to the photoconductive layer 703 shown in FIG. 7, further containing hydrogen atoms (H) if desired, and the upper layer 1205 having the free surface 1204, which is provided on said photoconductive layer 1203.

The upper layer 1205 has the following functions. For example, when the photoconductive member 1200 is used in a manner so as to form charge images by applying charging treatment on the free surface 1204, it functions to bar injection of charges to be retained on the free surface 1204 into the photoconductive layer 1203, and, when irradiated by an electromagnetic wave, also to permit easily passing the photocarriers generated in the photoconductive layer 1203 or the charges at portions irradiated by an electromagnetic wave so that the carriers may be recombined with the charges.

The upper layer 1205 may be constituted, similarly as those shown in the aforementioned embodiments, of a—$(SixN_{1-x})y:x_{1-y}$, containing hydrogen atoms (H) if it is required, and having the same characteristics as of the intermediate layer 1202. Alternatively, it may be constituted of an amorphous material consisting of silicon atoms (Si) and nitrogen atoms (N) or oxygen atoms (O), which are matrix atoms constituting the photoconductive layer, or constituted of these matrix atoms containing further hydrogen atoms or/and halogen atoms, such as, for example, a—$Si_aC_{1-a}$, a—$(Si_aC_{1-a})_b:H_{1-b}$, a—$(Si_aC_{1-a})_b:(H+X)_{1-b}$, a—$Si_cO_{1-c}$, a—$(Si_cO_{1-c})_d:H_{1-d}$ or a—$(Si_cO_{1-c})_d:(H+X)_{1-d}$, a—$Si_eN_{1-e}$, and the like; an inorganic insulating material such as $Al_2O_3$, etc.; or an organic insulating material such as polyester, poly-p-xylylene and polyurethane etc.

The layer thickness of the photoconductive member in this invention is determined suitably depending on the purposes of application such as reading devices, solid state image pickup devices or image forming members for electrophotography.

In the present invention, the layer thickness of the photoconductive member may be determined suitably in connection with the relation to the intermediate layer so that the functions of both photoconductive layer and intermediate layer can effectively be exhibited. Ordinarily, the thickness of the photoconductive layer is preferably more of some hundred to some thousand times as thick as the intermediate layer. More specifically, it is generally in the range of from 1 to 100μ, preferably from 2 to 50μ.

The material constituting the upper layer provided on the photoconductive layer as well as its thickness may be determined carefully so that generation of photocarriers may be effected with good efficiency by permitting the electromagnetic wave irradiated to reach the photoconductive layer in a sufficient quantity, when the photoconductive member is to be employed such that the electromagnetic wave to which the photoconductive layer is sensitive is irradiated from the side of the upper layer.

The thickness of the upper layer may suitably be determined depending on the material constituting the layer and the conditions for forming the layer so that the function as described above may be sufficiently exhibited. Ordinarily, it is in the range of 30 to 1000 Å, preferably from 50 to 600 Å.

When a certain kind of electrophotographic process is to be employed using with the photoconductive member of this invention as an image forming member for photography, it is also required to provide further a surface coating layer on the free surface of the photoconductive member according to the layer structure as shown in any of FIG. 1 to FIG. 12. Such a surface coating layer is required to be insulating and have a sufficient ability to retain electrostatic charges when subjected to charging treatment and also a thickness to some extent, when applied in an electrophotographic process like NP-system as disclosed in U.S. Pat. Nos. 3,666,363 and 3,734,609. On the other hand, when applied in an electrophotographic process such as Carlson process, the surface coating layer is required to have a very thin thickness, since the potential at the bright portions after formation of electrostatic charges is desired to be very small. The surface coating layer is required to have, in addition to satisfactory the desired electrical characteristics, no adverse influence, both physically and chemically on the photoconductive layer or the upper layer as well as good electrical contact and adhesion to the photoconductive layer or the upper layer. Further, humidity resistance, abrasion resistance, cleaning characteristic, etc. are also taken into consideration in forming the surface coating layer.

Typical examples of materials effectively used for forming the surface coating layer may include polyethylene terephthalate, polycarbonate, polypropylene, polyvinyl chloride, polyvinylidene chloride, polyvinyl alcohol, polystyrene, polyamide, polytetrafluoroethylene, polytrifluorochloroethylene, polyvinyl fluoride, polyvinylidene fluoride, copolymer of hexafluoropropylene-tetrafluoroethylene, copolymer of trifluoroethylene-vinylidene fluoride, polybutene, polyvinyl butyral, polyurethane, poly-p-xylylene and other organic insulating materials; and silicon nitrides, silicon oxides and other inorganic insulating materials. Among these materials, a synthetic resin or a cellulose derivative may be formed into a film, which is in turn laminated on the photoconductive layer or the upper layer. Alternatively, a coating solution of such a material may be prepared and coated on the photoconductive layer or the upper layer to form a layer. The thickness of the surface coating layer, which may be determined suitably depending on the characteristics desired or the material selected, may generally be about 0.5 to 70μ. In particular, when the protecting function as described above is required of the surface coating layer, the thickness is usually 10μ or less. On the contrary, when a function as an insulating layer is more desirable, a thickness of 10μ or more is usually used. However, a line of demarcation between thickness values distinguishing the protective layer from the electrical insulating layer is variable depending on the electrophotographic process to be applied and the structure of the image forming member for electrography designed. Therefore, the value of 10μ previously mentioned should not be appreciated as absolute.

The surface coating layer may also be endowed with a role as a reflection preventive layer by suitable selection of materials, whereby its function can further be enlarged.

The photoconductive member according to this invention, which has been described in detail above with reference to typical examples of layer structures, can overcome all the problems as described above and exhibit very excellent electrical, optical and photoconductive characteristics as well as good environmental characteristics during use.

Particularly, when applied for an image forming member for electrophotography or a photographic device, it has an advantageously good retentivity of electrostatic charges during charging treatment, with no influence of residual potential on image formation, having also stable electrical properties even in a highly humid atmosphere, with high sensitivity and high SN ratio, being also excellently resistant to optical fatigue or repeated uses, and can give a visible image of high quality and good resolving power, which is high in concentration and distinct in halftone.

Further, when a layer structure of photoconductive layer of prior art was applied as an image forming member for electrophotography, for example, a—Si:H and a—Si:X with high dark resistivity was low in photosensitivity, while a—Si:H and a—Si:X with high photosensitivity was low in dark resistivity, which was about $10^8$ Ωcm, thus failing to be poorly applicable for an image forming member for electrophotography. In contrast, according to the present invention, even Si:H or Si:X having a relatively low resistivity ($5\times10^9$ Ωcm or more) can constitute the photoconductive layer for electrophotography. Therefore, a—Si:H and a—Si:X with relatively lower dark resistivity but having a high sensitivity can satisfactorily be used to an advantage of freedom from restrictions with respect to characteristics of a—Si:H and a—Si:X.

EXAMPLE 1

Figure 13:
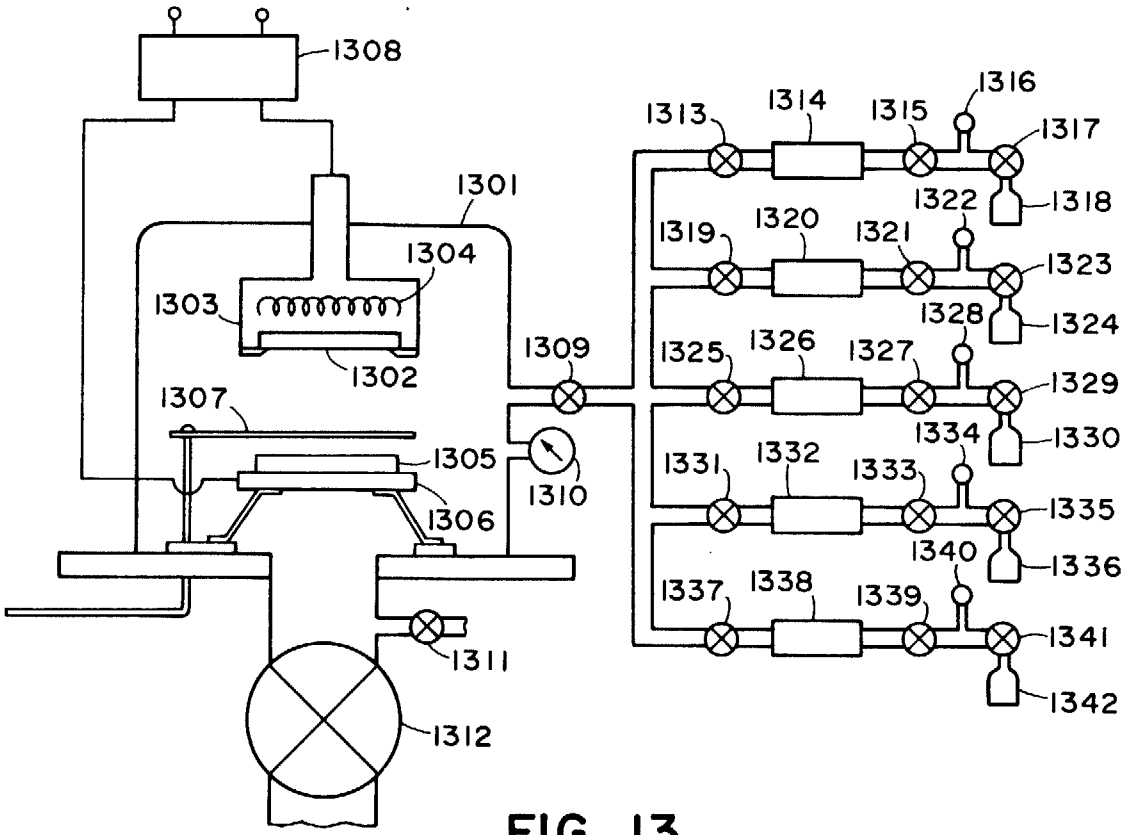
FIGS. 13 through 17 schematic flow charts for illustrating the devices for preparation of the photoconductive members according to the present invention, respectively.

Using a device, as shown in FIG. 13, placed in a clean room which had been completely shielded, an image forming member for electrophotography was prepared according to the following procedures.

A substrate 1302 of molybdenum of 10 cm square having a thickness of 0.5 mm, whose surface had been cleaned, was fixed firmly on a supporting member 1303 disposed at a predetermined position in a glow discharging deposition chamber 1301. The target 1305 was of a high purity polycrystalline silicon (99.999%). The substrate 1302 was heated with a heater 1304 within the supporting member 1303 with a precision of ±0.5° C. The temperature was measured directly at the backside of the substrate by an alumel-chromel thermocouple. Then, after confirming that all the valves in the system are closed, the main valve 1312 was opened to evacuate the chamber 1301 to $5\times10^{-6}$ torr. Then, the input voltage at the heater 1304 was changed, while detecting the molybdenum substrate temperature, until it was stabilized constantly at 200° C.

Subsequently, the auxiliary valve 1309, and then the outflow valves 1313, 1319, 1331 and 1337 and inflow valves 1315, 1321, 1333, 1339 were fully opened to sufficiently remove the gases in the flowmeters 1314, 1320, 1332, 1338. After the auxiliary valve 1309 and the valves 1313, 1319, 1331, 1337 were closed, respectively, the valve 1335 of the bomb 1336 containing $N_2$ gas (purity: 99.999%) and the valve 1341 of the bomb 1342 containing Ar gas (purity: 99.999%) were opened until reading on the outlet pressure gages 1334, 1340 were respectively adjusted to 1 kg/cm$^2$, and then the inflow valves 1333, 1339 were gradually opened thereby to permit $N_2$ and Ar gases to flow into the flowmeters 1332 and 1338. Subsequently, the outflow valves 1331, 1337 were gradually opened, followed by gradual opening of the auxiliary valve 1309. The inflow valves 1333 and 1339 were adjusted so that feed ratio of $N_2$/Ar might be 1:1. The opening of the auxiliary valve 1309 was adjusted, while carefully reading the Pirani gage 1310 until pressure in the chamber 1301 became $5\times10^{-4}$ torr. After an inner pressure in the chamber 1301 was stabilized, the main valve 1312 was gradually closed to throttle the opening until the indication on the Pirani gage became $1\times10^{-2}$ torr. After confirming that the gas feeding and the inner pressure were stabilized, the shutter 1307 was opened and then the high frequency power source 1308 was turned on to input an alternate current of 13.56 MHz between the silicon target 1305 and the supporting member 1303 to generate glow discharge in the chamber 1301 to provide an input power of 100 W. Under these conditions, discharging was continued for one minute to form an intermediate layer. Then, the high frequency power source 1308 was turned off for intermission of glow discharging.

Subsequently, the outflow valves 1331, 1337 and inflow valves 1333, 1339 were closed and the main valve 1312 fully opened to discharge the gas in the chamber 1301 until it was evacuated to $5\times10^{-7}$ torr. Then, the auxiliary valve 1309 and the outflow valves 1331, 1337 were opened fully to effect sufficiently degassing in the flowmeters 1332, 1338 to vacuo. After closing the auxiliary valve 1309 and the valves 1331, 1337, the valve 1317 of the bomb 1318 containing $SiH_4$ gas (purity: 99.999%) diluted with $H_2$ to 10 vol.% [hereinafter referred to as $SiH_4(10)/H_2$] and the valve 1323 of the bomb 1324 containing $B_2H_6$ gas diluted with $H_2$ to 50 vol. ppm [hereinafter referred to as $B_2H_6(50)/H_2$] were respectively opened to adjust the pressures at the outlet pressure gages 1316 and 1322, respectively, to 1 kg/cm$^2$, whereupon the inflow valves 1315, 1321 were gradually opened to permit $SiH_4(10)/H_2$ gas and $B_2H_6(50)/H_2$ gas to flow into the flowmeters 1314 and 1320, respectively. Subsequently, the outflow valves 1313 and 1319 were gradually opened, followed by opening of the auxiliary valve 1309. The inflow valves 1315 and 1321 were adjusted thereby so that the gas feed ratio of $SiH_4(10)/H_2$ to $B_2H_6(50)/H_2$ might be 50:1. Then, while carefully reading the Pirani gage 1310, the opening of the auxiliary valve 1309 was adjusted and it was opened to the extent until the inner pressure in the chamber became $1\times10^{-2}$ torr. After the inner pressure in the chamber was stabilized, the main valve 1312 was gradually closed to throttle its opening until the indication on the Pirani gage 1310 became 0.5 torr.

After the shutter 1307 was closed and, confirming that the gas feeding and the inner pressure were stable, the high frequency power source 1308 was turned on to input a high frequency power of 13.56 MHz between the electrodes 1303 and 1307, thereby generating glow discharge in the chamber 1301 to provide an input power of 10 W. After glow discharging was continued for 3 hours to form a photoconductive layer, the heater 1304 was turned off with the high frequency power source 1308 being also turned off, the substrate is left to cool to 100° C., whereupon the outflow valves 1313, 1319 and the inflow valves 1315, 1321 were closed, with the main valve 1312 fully opened, thereby to make the inner pressure in the chamber 1301 to less than $10^{-5}$ torr. Then, the main valve 1312 was closed and the inner pressure in the chamber 1301 was made atmospheric through the leak valve 1311, and the substrate was taken out. In this case, the entire thickness of the layers was about 9$\mu$. The thus prepared image forming member for electrophotography was placed in an experimental device for charging and exposure to light, and corona charging was effected at +6.0 KV for 0.2 sec., followed immediately by irradiation of a light image. The light image was irradiated through a transmission type test chart using a tunsten lamp as light source at an intensity of 1.0 lux.-sec.

Immediately thereafter, negatively charged developers (containing toner and carrier) were cascaded on the surface of the member to obtain a good toner image on the image forming member for electrophotography. When the toner image on the image forming member for electrography was copied on a copying paper by corona charging at +5.0 KV, there was obtained a clear image of high density which was excellent in resolution as well as in gradation reproducibility.

Next, the above image forming member was subjected to corona charging by means of a charging light-exposure experimental device at −5.5 KV for 0.2 sec., followed immediately image exposure to light at an intensity of 0.8 lux.-sec., and thereafter immediately positively charged developer was cascaded on the surface of the member. Then, by copying on a copying paper and fixing, there was obtained a very clear image.

As apparently seen from the above result, in combination with the previous result, the image forming member for electrophotography has the characteristics of a both-polarity image forming member having no dependency on the charged polarity.

EXAMPLE 2

The image forming members shown as Sample Nos. A1 through A8 were prepared under the same conditions and procedures as in Example 1 except that the sputtering time in forming the intermediate layer on the molybdenum substrate was varied as shown in Table 1 below, and image formation was effected by placing in entirely the same device as in Example 1 to obtain the results as also shown in Table 1.

TABLE 1

| Sample No. | A1 | A2 | A3 | A4 | A5 | A6 | A7 | A8 |
|---|---|---|---|---|---|---|---|---|
| Time for forming intermediate layer (sec.) | 10 | 30 | 50 | 150 | 300 | 500 | 1000 | 1200 |
| Image quality: | | | | | | | | |
| Charging polarity ⊕ | ○ | ○ | ⊙ | ⊙ | ⊙ | ○ | Δ | X |
| Charging polarity ⊖ | ○ | Δ | ⊙ | ⊙ | ⊙ | ○ | Δ | X |

Remarks:
Ranks for evaluation: ⊙ excellent; ○ good; Δ practically useable; X not good
Deposition speed of intermediate layer: 1 A/sec.

As apparently seen from the results shown in Table 1, it is necessary to form the intermediate layer constituted of a—$Si_xN_{1-x}$ to a thickness within the range of from 30 Å to 1000 Å.

EXAMPLE 3

The image forming members for electrophotography shown as Sample Nos. A9 through A15 were prepared under the same conditions and procedures as in Example 1 except that the feed ratio of $N_2$ to Ar in forming the intermediate layer on molybdenum substrate was varied as shown in Table 2 below, and image formation was effected by placing in the same device as in Example 1 to obtain the results also shown in Table 2. For only Sample Nos. A11 through A15, intermediate layers were analyzed by Auger electron spectroscopy to give the results as shown in Table 3. From the results shown in Table 3, it can be seen that the ratio x concerning the composition of Si and N in the intermediate layer should be 0.60 to 0.43 in order to achieve the objects of this invention.

TABLE 2

| Sample No. | A9 | A10 | A11 | A12 | A13 | A14 | A15 |
|---|---|---|---|---|---|---|---|
| $N_2$/Ar (feed ratio): | 1:25 | 1:12 | 1:8 | 1:6 | 1:4 | 1:1 | 1:0 |
| Copied image quality: | | | | | | | |
| Charging polarity ⊕ | X | X | X | Δ | ○ | ⊙ | ⊙ |
| Charging polarity ⊖ | X | X | X | Δ | ○ | ⊙ | ⊙ |

Remarks:
Ranks for evaluation:
⊙ excellent
○ good
Δ practically useable
X not good

TABLE 3

| $Si_xN_{1-x}$ Sample No. | A11 | A12 | A13 | A14 | A15 |
|---|---|---|---|---|---|
| x | 0.66 | 0.58 | 0.50 | 0.43 | 0.43 |

EXAMPLE 4

An intermediate layer constituting of $Si_xN_{1-x}$ was prepared on a molybdenum substrate according to the same procedures as in Example 1.

Then, the inflow valves 1333, 1339 were closed, and the auxiliary valve 1309, then the outflow valves 1331, 1337 were fully opened to degas thereby sufficiently also the flowmeters 1332, 1338 to vacuo. After the auxiliary valve 1309 and the valves 1331, 1337 were closed, the valve 1317 of the bomb 1318 containing $SiH_4$ gas diluted with $H_2$ to 10 vol.% [hereinafter referred to as $SiH_4(10)/H_2$ gas; purity: 99.999%] to adjust the pressure at the outlet pressure gage 1316 to 1 kg/cm$^2$, followed by gradual opening of the inflow valve 1315 to permit the $SiH_4(10)/H_2$ gas to flow into the flowmeter 1314. Subsequently, the outflow valve 1313 was gradually opened and then the auxiliary valve 1309 gradually opened. Then, while carefully reading the Pirani gage 1310, the opening of the auxiliary valve 1309 was adjust and it was opened until the chamber 1301 became $1\times10^{-2}$ torr. After the inner pressure in the chamber 1301 was stabilized, the main valve 1312 was gradually closed to throttle its opening until the indication on the Pirani gage 1310 became 0.5 torr. Confirming that the gas feeding and the inner pressure were stabilized, with the shutter 1307 closed, the high frequency power source 1308 was turned on to input a high frequency power of 13.56 MHz between the electrodes 1307 and 1303 to generate glow discharge in the chamber 1301 to provide an input power of 10 W. After glow discharging was continued for 3 hours to form a photoconductive layer, the heater 1304 was turned off. Upon cooling of the substrate to 100° C., the outflow valve 1313 and the inflow valve 1315 were closed, with full opening of the main valve 1312 to reduce the pressure in the chamber 1301 to less than $10^{-5}$ torr. Thereafter, the main valve 1312 was closed and the chamber 1301 was made atmospheric through the leak valve 1311, and the substrate was taken out. In this case, the entire thickness of the layers formed was about 9$\mu$.

When image formation was effected on a copying paper, using the thus prepared image forming member, according to the same procedures as in Example 1, image formation by −corona discharge was better in image quality obtained than that by +corona discharge. From this result, the image forming member prepared in this Example was found to have a dependency on the charging polarity.

EXAMPLE 5

After an intermediate layer was formed for one minute on a molybdenum substrate according to the same procedures under the same conditions as in Example 1, the deposition chamber was evacuated to $5\times10^{-7}$ torr, and the $SiH_4(10)/H_2$ gas was introduced into the chamber according to the same procedures as in Example 1. Then, from the gas bomb 1330 containing $PH_3$ gas diluted with $H_2$ to 25 mol. ppm [hereinafter referred to as $PH_3(25)/H_2$] through the valve 1327, the gas was fed at a pressure of 1 kg/cm$^2$ (reading on the outlet pressure gage 1328) and the opening of the outflow valve 1325 was determined so that the reading on the flowmeter 1326 reached to 1/50 of the feed rate of $SiH_4(10)/H_2$ gas, by controlling the inflow valve 1327 and the outflow valve 1325 and made them stable.

Subsequently, with the shutter 1307 closed, the high frequency power source 1308 was turned on again to recommence glow discharge. The input power was 10 W. After glow discharging was thus maintained for additional 4 hours to form a photoconductive layer, the heater 1304 was turned off, with the high frequency power source 1308 being also turned off. Upon cooling of the substrate temperature to 100° C., the outflow valves 1313, 1325 and the inflow valves 1315, 1327 were closed, with full opening of the main valve, to evacuate the chamber 1301 to less than $10^{-5}$ torr. Then, the main valve 1312 was closed, and the chamber 1301 was made atmospheric through the leak valve 1311, and thereafter the substrate was taken out. In this case, the entire thickness of the layers formed was about 11$\mu$.

When image formation was effected on a copying paper, using the thus prepared image forming member, according to the same procedures as in Example 1, image formation by ⊖ corona discharge was better in image quality obtain than that by ⊕ corona discharge. From this result, it can clearly be seen that the image forming member prepared in this Example has a dependency on the charging polarity.

EXAMPLE 6

After an intermediate layer was formed for one minute on a molybdenum substrate using conditions and procedures similar to Example 1, the deposition chamber was evacuated to $5\times10^{-7}$ torr, whereupon $SiH_4(10)/H_2$ gas was introduced into the chamber according to the same procedures as in Example 1. Thereafter, under the gas pressure at 1 kg/cm$^2$ (the outlet pressure reading on gage 1322) through the inflow valve 1321 from the bomb 1324 containing $B_2H_6$ gas diluted to 50 vol. ppm with $H_2$ [hereinafter referred to as $B_2H_6(50)/H_2$], the inflow valve 1321 and the outflow valve 1319 were adjusted to determine the opening of the outflow valve 1319 so that the reading on the flowmeter 1320 might be 1/10 of the feed amount of $SiH_4(10)/H_2$, followed by stabilization.

Subsequently, with the shutter 1307 closed and the high frequency power source 1308 turned on again, the glow discharge was recommenced. The input voltage applied thereby was 10 W. After glow discharge was maintained for additional 4 hours to form a photoconductive layer, the heater 1304 was turned off simultaneously turning off of the high frequency power source 1308. Upon cooling of the substrate temperature to 100° C., the outflow valves 1313, 1319 and the inflow valves 1315, 1321 were closed, with full opening of the main valve 1312, to evacuate the chamber 1301 to less than $10^{-5}$ torr. Thereafter, the main valve 1312 was closed and the chamber 1301 was made atmospheric through the leak valve 1311, and the substrate having formed respective layers thereon was taken out. In this case, the entire thickness of the layers formed was about 10$\mu$.

The thus formed image forming member was provided for use in image formation on a copying paper according to the same procedures under the same conditions as in Example 1, whereby the image formed by ⊕ corona discharge was more excellent and clear, as compared with that formed by ⊖ corona discharge. From this result, the image forming member prepared in this Example was recognized to have a dependency on the charging polarity, which dependency on the charging polarity was, however, opposite to those obtained in Examples 4 and 5.

EXAMPLE 7

After conducting formation of an intermediate layer for one minute and then formation of a photoconductive layer for 5 hours on a molybdenum substrate according to the same procedures under the same conditions as in Example 1, the high frequency power source 1308 was turned off for intermission of glow discharge. Under this state, the outflow valve 1313, 1319 were closed and the outflow valves 1331, 1337 were opened again with opening of the shutter 1307, thus creating the same conditions as in formation of the intermediate layer. Subsequently, the high frequency power source was turned on to recommence glow discharge. The input power was 100 W, which was also the same as in formation of the intermediate layer. Thus, glow discharge was continued for 2 minutes to form a upper layer on the photoconductive layer. Then, the high frequency power source was turned off and the substrate was left to cool. Upon reaching 100° C. or lower of the substrate temperature, the outflow valves 1331, 1337 and the inflow valves 1333, 1339 were closed, with full opening of the main valve 1312, thereby evacuating the chamber to less than $10^{-5}$ torr. Then, the main valve 1312 was closed to return the chamber 1301 to atmospheric through the leak valve 1311 so as to be ready to take out the substrate having formed respective layers.

The thus prepared image forming member for electrophotography was placed in the same charging-light exposure experimental device as used in Example 1, wherein corona charging was effected at ⊕6 KV for 0.2 sec., followed immediately by irradiation of a light image. Irradiation of the light image was effected through a transmission type test chart, using a tungsten lamp as light source, at an intensity of 1.0 lux.sec.

Immediately thereafter, negatively chargeable developers (containing toner and carrier) were cascaded on the surface of the member, whereby there was obtained a good image on the surface of the member. When the toner image on the member was copied on a copying paper by corona discharge at ⊕5.0 KV. As a result, a clear highly dense image was obtained with excellent resolution and good gradation reproducibility.

EXAMPLE 8

Example 1 was repeated except that the $Si_2H_6$ gas bomb without dilution was used in place of the $SiH_4(10)/H_2$ bomb, and a $B_2H_6$ gas bomb diluted with $H_2$ to 500 vol. ppm [hereinafter referred to as $B_2H_6(500)/H_2$] in place of the $B_2H_6(50)/H_2$ bomb 1324, thereby to form an intermediate layer and a photoconductive layer on a molybdenum substrate. Then, taking out from the deposition chamber 1301, the image forming member prepared was subjected to the test for image formation by placing in the same experimental device for charging and exposure to light similarly as in Example 1. As a result, in case of the combination of ⊖5.5 KV corona discharge with ⊕ charged developer as well as the combination of ⊕6.0 KV corona discharge with ⊖ charged developer, a toner image of very high quality with high contrast was obtained on a copying paper.

EXAMPLE 9

According to the same procedures under the same conditions as in Example 1, there were prepared 9 samples of image forming members having formed photoconductive layers thereon. Then on each of the photoconductive layers of these samples, upper layer was formed under various conditions A to I indicated in Table 4 to prepare 9 samples image forming members (Sample Nos. 16 to 24) having respective upper layers.

In forming the upper layer A according to the sputtering method, the target 1305 was changed to a polycrystalline silicon target having partially laminated a graphite target thereon; while in forming the upper layer E, the target was changed to $Si_3N_4$ target and the Ar gas bomb 1342 to the $N_2$ gas bomb containing $N_2$ gas diluted with Ar to 50%.

In forming the upper layer B according to the glow discharge method, the $B_2H_6(50)/H_2$ gas bomb 1324 was changed to the $C_2H_4$ gas bomb diluted with $H_2$ to 10 vol.%; in forming the upper layer C, the $B_2H_6(50)/H_2$ gas bomb 1324 to $Si(CH_3)_4$ bomb diluted to 10 vol.% with $H_2$; informing the upper layer D, the $B_2H_6(50)/H_2$ gas bomb 1324 to $C_2H_4$ gas bomb and the $PH_3(25)/H_2$ bomb 1330 to $SiH_4$ gas bomb containing 10 vol.% of $H_2$; informing upper layers F, G, the $PH_3(25)/H_2$ gas bomb 1330 to the $NH_3$ gas bomb diluted with $H_2$ to 10 vol.%; and in forming the upper layers H, I, the $PH_3(25)/H_2$ gas bomb 1330 to the $SiF_4$ gas bomb containing 10 vol.% of $H_2$ and the $B_2H_6(50)/H_2$ gas bomb 1324 to the $NH_3$ bomb diluted 10 vol.% with $H_2$, respectively.

Each of the thus prepared 9 image forming members having the upper layers A to I, respectively, was used for copying a visible image on a copying paper similarly as in Example 1, whereby there was obtained a very clear toner image without dependency on the charging polarity.

EXAMPLE 10

Previously, the polycrystalline Si target was changed to the $Si_3N_4$ target, and the intermediate layer was formed under the same conditions according to the same procedures as in Example 1, followed further by formation of the photoconductive layer similarly as in Example 1.

Then, the upper layers were formed on the photoconductive layers similarly as in Example 9. When each of the 9 image forming members having the upper layers A to I was used for image formation similarly as in Example 1, which was in turn copied on a copying paper to obtain a very clear image without dependency on the charging polarity.

TABLE 4

| Sample No. | Upper layer | Preparation conditions: Starting gas or Target | Feed gas ratio or Area ratio | Preparation method | Power (W) | Layer thickness (Å) |
|---|---|---|---|---|---|---|
| A16 | A | Polycrystalline Si target; graphite target | Si:C = 1:9 (area ratio) | Sputter | 100 | 120 |
| A17 | B | $SiH_4$ (dil. 10 vol % with $H_2$); $C_2H_4$ (dil. 10 vol % with $H_2$) | $SiH_4/H_2:C_2H_4/H_2$ = 1:9 | Glow | 3 | 120 |
| A18 | C | $Si(CH_3)_4$ (dil. 10 vol % with $H_2$) | — | Glow | 3 | 120 |
| A19 | D | $SiF_4$ (containing 10 vol % | $SiF_4/H_2:C_2H_4/H_2$ | Glow | 60 | 120 |

TABLE 4-continued

| Sample No. | Upper layer | Preparation conditions: Starting gas or Target | Feed gas ratio or Area ratio | Preparation method | Power (W) | Layer thickness (Å) |
|---|---|---|---|---|---|---|
| | | $H_2$); $C_2H_4$ (dil. 10 vol % with $H_2$) | = 1:9 | | | |
| A20 | E | $Si_3N_4$ target $N_2$ (dil. to 50 vol % with Ar) | — | Sputter | 100 | 200 |
| A21 | F | $SiH_4$ (dil. to 10 vol % with $H_2$) $N_2$ | $SiH_4/H_2:N_2$ = 1:10 | Glow | 3 | 120 |
| A22 | G | $SiH_4$ (dil. to 10 vol % with $H_2$) $NH_3$ (dil. to 10 vol % with $H_2$) | $SiH_4/H_2:NH_3/H_2$ = 1:2 | Glow | 3 | 120 |
| A23 | H | $SiF_4$ (containing 10 vol % $H_2$); $N_2$ | $SiF_4/H_2:N_2$ = 1:90 | Glow | 60 | 120 |
| A24 | I | $SiF_4$ (containing 10 vol % $H_2$); $NH_3$ (dil. to 10 vol % with $H_2$) | $SiF_4/H_2:NH_3/H_2$ = 1:20 | Glow | 60 | 120 |

EXAMPLE 11

Figure 14:
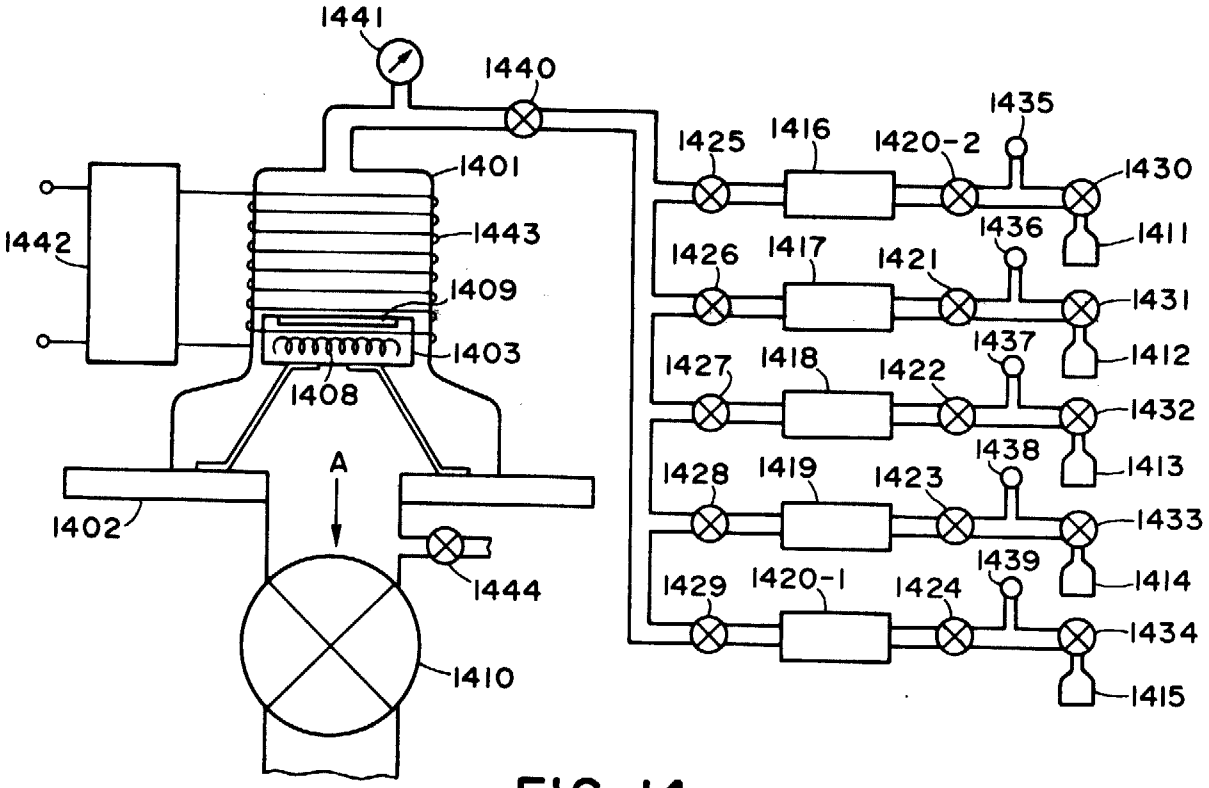

Using a device as shown in FIG. 14 placed in a clean room which had been completely shielded, an image forming member for electrophotography was prepared according to the following procedures.

A substrate 1409 of molybdenum of 10 cm square having a thickness of 0.5 mm, whose surface had been cleaned, was fixed firmly on a supporting member 1403, disposed at a predetermined position in a glow discharge deposition chamber 1401 placed on a supporting stand 1402. The substrate 1409 was heated by a heater 1408 within the supporting member 1403 with a precision of ±0.5° C. The temperature was measured directly at the backside of the substrate by an alumel-chromel thermocouple. Then, after confirming that all the valves in the system were closed, the main valve 1410 was fully opened, and evacuation of the chamber 1401 was effected to $5\times10^{-6}$ Torr. Thereafter, the input charge for the heater 1408 was elevated by varying the input voltage while detecting the substrate temperature until the temperature was stabilized constantly at 200° C.

Then, the auxiliary valve 1440, subsequently the outflow valves 1425, 1426, 1427 and the inflow valves 1402-2, 1421, 1422 were fully opened to effect degassing sufficiently in the flowmeters 1416, 1417, 1418 to vacuo. After closing the auxiliary valve 1440 and the valves 1425, 1426, 1427, 1420-2, 1421, 1422, the valve 1430 of the bomb 1411 containing $SiH_4$ gas (purity: 99.999%) diluted with $H_2$ to 10 vol.% [hereinafter referred to as $SiH_4(10)/H_2$] and the valve 1431 of the bomb 1412 containing $N_2$ gas (purity: 99.999%) were respectively opened to adjust the pressures at the output pressure gases 1435 and 1436, at 1 kg/cm$^2$ respectively, whereupon the inflow valves 1420-2 and 1421 were gradually opened to permit $SiH_4(10)/H_2$ gas and $N_2$ gas to flow into the flowmeters 1416 and 1417, respectively. Subsequently, the outflow valves 1425 and 1426 were gradually opened, followed by opening of the auxiliary valve 1440. The inflow valves 1420-2 and 1421 were adjusted thereby so that the gas feed ratio of $SiH_4(10)/H_2$ to $N_2$ was 1:10. Then, while carefully reading the Pirani gage 1441, the opening of the auxiliary valve 1440 was adjusted and the auxiliary valve 1440 was opened to the extent until the inner pressure in the chamber 1401 became $1\times10^{-2}$ Torr. After the inner pressure in the chamber 1401 was stabilized, the main valve 1410 was gradually closed to throttle its opening until the indication on the Pirani gage 1441 became 0.5 Torr. After confirming that the gas feeding and the inner pressure were stable, the high frequency power source 1442 was turned on to input a high frequency power of 13.56 MHz to the induction coil 1443, thereby generating glow discharge in the chamber 1401 at the coil portion (upper part of the chamber) to provide an input power of 3 W. The above conditions were maintained for one minute to deposit an intermediate layer a—$(Si_xN_{1-x})_y:H_{1-y}$ on the substrate. Then, with the high frequency power source 1442 turned off for intermission of the glow discharge, the outflow valve 1426 was closed, and thereafter, under the pressure of $B_2H_6(50)/H_2$ gas from the bomb 1413 through the inflow valve 1422 at 1 kg/cm$^2$ (reading on the outlet pressure gage), the inflow valve 1422 and the outflow valve 1427 were adjusted to determine the opening of the outflow valve 1427 so that the reading on the flowmeter 1418 was 1/50 of the flow rate of $SiH_4(10)/H_2$ gas, followed by stabilization. Subsequently, the high frequency power source was turned on to recommence glow discharge. The input power was 10 W. After glow discharge was continued for additional 3 hours to form a photoconductive layer, the heater 1408 was turned off with the high frequency power source 1442 being also turned off, the substrate was left to cool to 100° C., whereupon the outflow valves 1425, 1427 and the inflow valves 1420-2, 1422 were closed, with the main valve 1410 fully opened, thereby to make the inner pressure in the chamber 1401 to less than $10^{-5}$ Torr. Then, the main valve 1410 was closed and the inner pressure in the chamber was made atmospheric through the leak valve 1444, and the substrate having formed respective layers thereon was taken out. In this case, the entire thickness of the layers was about 9μ. The thus prepared image forming member for electrophotography was placed in an experimental device for charging and exposure to light, and corona charging was effected at ⊕6.0 KV for 0.2 sec., followed immediately by irradiation of a light image. The light image was irradiated through a transmission type test chart using a tungsten lamp as light source at an intensity of 1.0 lux.sec.

Immediately thereafter, negatively charged developers (containing toner and carrier) were cascaded on the surface of the member to obtain a good toner image on the image forming member for electrophotography. When the toner image on the image forming member for electrography was copied on a copying paper by corona charging at ⊕5.0 KV, there was obtained a clear image with high density which was excellent in resolving power as well as in gradation reproducibility.

Next, the above image forming member was subjected to corona charging by means of a charging light-exposure experimental device at ⊖5.5 KV for 0.2 sec., followed immediately image exposure to light at an intensity of 0.8 lux.sec., and thereafter immediately positively charged developer was cascaded on the surface of the member. Then, by copying on a copying paper and fixing, there was obtained a very clear image.

As apparently seen from the above result, in combination with the previous result, the image forming member for electrophotography has the characteristics of a both-polarity image forming member having no dependency on the charging polarity.

EXAMPLE 12

The image forming members shown as Sample Nos. B1 through B8 in Table 5 were prepared under the same conditions and procedures as in Example 11 except that the sputtering time in forming the intermediate layer on the molybdenum substrate was varied as shown also in Table 5, and image formation was effected by placing in entirely the same device as in Example 11 to obtain the results as shown in Table 5.

As apparently seen from the results shown in Table 5, it is necessary to form the intermediate layer constituted of a—SiC to a thickness within the range of from 30 Å to 1000 Å.

TABLE 5

| Sample No.: | B1 | B2 | B3 | B4 | B5 | B6 | B7 | B8 |
|---|---|---|---|---|---|---|---|---|
| Time for forming intermediate layer (sec.): | 10 | 30 | 50 | 180 | 420 | 600 | 1000 | 1200 |
| Image quality: | | | | | | | | |
| Charging polarity ⊕ | Δ | ○ | ⊙ | ⊙ | ⊙ | ○ | Δ | X |
| Charging polarity ⊖ | X | Δ | ⊙ | ⊙ | ⊙ | ○ | Δ | X |

Remarks:
Ranks for evaluation:
⊙ excellent
○ good
Δ practically useable
X not good
Deposition speed of intermediate layer: 1 Å/sec.

EXAMPLE 13

The image forming members for electrophotography as shown by Sample Nos. B9 through B15 in Table 6 were prepared under the same conditions and procedures as in Example 11 except that the feed ratio of $SiH_4(10)/H_2$ gas to $N_2$ was varied in forming the intermediate layer on a molybdenum substrate as shown in Table 6 below and image formation was effected by placing in the same device as in Example 11 to obtain the results shown also in Table 6. For only Sample Nos. B11 through B15, intermediate layers were analyzed by Auger electron spectroscopy to give the results as shown in Table 7.

As apparently seen from the results in Tables 6 and 7, the parameter x concerning the composition of Si and N in the intermediate layer of $Si_xN_{1-x}$ is required to be in the range from 0.60 to 0.43.

TABLE 6

| Sample No. | B9 | B10 | B11 | B12 | B13 | B14 | B15 |
|---|---|---|---|---|---|---|---|
| $SiH_4/N_2$ (feed/ratio) | 2:1 | 1:1 | 1:2 | 1:4 | 1:6 | 1:8 | 1:10 |

TABLE 6-continued

| Sample No. | B9 | B10 | B11 | B12 | B13 | B14 | B15 |
|---|---|---|---|---|---|---|---|
| Copied image quality: | | | | | | | |
| Charging polarity ⊕ | X | X | X | Δ | ⊙ | ⊙ | ⊙ |
| Charging polarity ⊖ | X | X | X | Δ | ⊙ | ⊙ | ⊙ |

Remarks:
Ranks for evaluation:
⊙ excellent
○ good
Δ practically useable
X not good

TABLE 7

| Sample No. | B11 | B12 | B13 | B14 | B15 |
|---|---|---|---|---|---|
| x in $Si_xN_{1-x}$ | 0.66 | 0.58 | 0.50 | 0.43 | 0.43 |

EXAMPLE 14

The molybdenum substrate was placed similarly as in Example 11, and the glow discharge deposition chamber 1401 shown in FIG. 14 was evacuated to $5\times10^{-6}$ Torr. After the substrate temperature had been maintained at 200° C., the auxiliary valve 1440, then the outflow valves 1425, 1426, and the inflow valves 1420-2, 1421 were fully opened to effect evacuation sufficiently also to the flowmeters 1416, 1417. After closing the auxiliary valve 1440 and the valves 1425, 1426, 1420, 1421, the valve 1430 of the bomb 1411 containing $SiH_4(10)/H_2$ gas and the valve 1431 of the $N_2$ gas bomb 1412 were opened and the pressures at the outlet pressure gages 1435, 1436 adjusted to 1 kg/cm², followed by opening gradually of the inflow valves 1420-2, 1421 to let in the $SiH_4(10)/H_2$ gas and $N_2$ gas into the flowmeters 1416, 1417, respectively. Subsequently, the outflow valves 1425, 1426, were opened gradually and then the auxiliary valve 1440 gradually opened. The inflow valves 1420-2 and 1421 were adjusted so that the feeding ratio of $SiH_4(10)/H_2$ gas to $N_2$ gas was 1:10. Next, while carefully reading the Pirani gage 1441, the opening of the auxiliary valve 1440 was adjusted and it was opened until the inner pressure in the chamber 1401 became $1\times10^{-2}$ Torr. After the inner pressure in the chamber 1401 was stabilized, the main valve 1410 was gradually closed to throttle its opening until the indication on the Pirani gage 1441 became 0.5 Torr. Confirming stabilization of gas feeding and of inner pressure, the high frequency power source 1442 was turned on to input a high frequency power of 13.56 MHz into the induction coil 1443, thereby generating glow discharge in the chamber 1401 at the coil portion (upper part of chamber), to provide an input power of 3 W. The above conditions were maintained for one minute to deposit an intermediate layer a—$(Si_xN_{1-x})_y:H_{1-y}$ on the substrate. Then, with the high frequency power source 1442 turned off for intermission of the glow discharge, the outflow valves 1426 was closed. Subsequently, the high frequency power source 1442 was turned on to recommence glow discharge. The input power was 10 W. Glow discharge was thus continued for additional 5 hours to form a photoconductive layer, and thereafter the heater 1408 was switched off, and also the high frequency power source 1442 turned off. Upon cooling of the substrate to a temperature of 100° C., the outflow valve 1425 and the inflow valves 1420-2, 1421 were closed, with full opening of the main valve 1410 to evacuate the chamber 1401 to $10^{-5}$ Torr or less. Thereafter, the main valve 1410 was closed, and the inner pressure in the chamber 1401 was returned to atmospheric through the leak valve 1444, and the substrate having formed respective layers was taken out. In this case, the entire thickness of the layers was found to be about 15μ. The thus prepared image forming member for electrophotography was subjected to image formation on a copying paper under the same condition according to the same procedures as in Example 11. As a result, the image formed by ⊖ corona discharge was better in quality and very clear, as compared with that formed by ⊕ corona discharge. This result shows that the image forming member prepared in this Example is dependent on the charging polarity.

EXAMPLE 15

After conducting formation of an intermediate layer for one minute on a molybdenum substrate according to the same procedures under the same conditions as in Example 11, the high frequency power source 1442 was turned off for intermission of glow discharge. Under this state, the outflow valve 1426 was closed. Then, under the pressure of $PH_3(25)/H_2$ gas from the bomb 1414 through the inflow valve 1423 at 1 kg/cm$^2$ (reading on the outlet pressure gage 1438), the inflow valve 1423 and the outflow valve 1428 were adjusted to determine the opening of the outflow valve 1428 so that the reading on the flowmeter 1419 was 1/50 of the flow rate of $SiH_4(10)/H_2$ gas, followed by stabilization.

Subsequently, the high frequency power source 1442 was turned on again to recommence glow discharge. The input voltage applied was increased to 10 W. Thus, glow discharge was continued for additional 4 hours to form a photoconductive layer on the intermediate layer. The heater 1408 and the high frequency power source 1442 were turned off and, upon cooling of the substrate to 100° C., the outflow valves 1425, 1428 and the inflow valves 1420-2, 1421 were closed, with full opening of the main valve 1410 to evacuate the chamber 1401 to $10^{-5}$ Torr. Then, the chamber 1401 was brought to atmospheric through the leak valve 1444 with closing of the main valve 1410, and the substrate having formed respective layers was taken out. In this case, the entire thickness of the layers formed was about 11μ.

The thus prepared image forming member for electrophotography was used for forming an image on a copying paper according to the same procedures and under the same conditions as in Example 11. As a result, the image formed by ⊖ corona discharge was more excellent in image quality and extremely clear, as compared with that formed by ⊕ corona discharge. This result shows that the image forming member obtained in this Example has a dependency on charging polarity.

EXAMPLE 16

After an intermediate layer was formed for one minute on a molybdenum substrate using conditions and procedures similar to Example 11, the high frequency power source 1442 was turned off, for intermission of glow discharge. Under this state, with closing of the outflow valve 1426 and under the gas pressure at 1 kg/cm$^2$ (the outlet pressure reading on gage 1437) through the inflow valve 1422 from bomb 1413 containing $B_2H_6(50)/H_2$, the inflow valve 1422 and the outflow valve 1427 were adjusted to determine the opening of the outflow valve 1427 so that the reading on the flowmeter 1418 may be 1/10 of the flow rate of $SiH_4(10)/H_2$, followed by stabilization.

Subsequently, with the high frequency power source 1442 turned on again, the glow discharge was recommended. The input voltage applied thereby was increased to 10 W. Thus, glow discharge was continued for additional 3 hours to form a photoconductive layer on the intermediate layer. The heater 1408 and the high frequency power source 1442 were then turned off, and, upon cooling of the substrate to 100° C., the outflow valves 1425, 1427 and the inflow valves 1420-2, 1422 were closed, with full opening of the main valve 1410 to evacuate the chamber 1401 to $10^{-5}$ Torr, followed by leaking of the chamber 1401 to atmospheric through the leak valve 1443 with closing of the main valve 1410. Under such a state, the substrate having formed layers thereon was taken out. In this case, the entire thickness of the layers formed was about 10μ.

The thus prepared image forming member for electrophotography was used for forming the image on a copying paper according to the same procedures under the same conditions as in Example 11, whereby the image formed by ⊕ corona discharge was more excellent and clear, as compared with that formed by ⊖ corona discharge. From this result, the image forming member prepared in this Example was recognized to have a dependency on the charging polarity, which dependency on the charging polarity was, however, opposite to those obtained in Examples 14 and 15.

EXAMPLE 17

After conducting formation of an intermediate layer for one minute and then formation of a photoconductive layer for 5 hours on a molybdenum substrate according to the same procedures under the same conditions as in Example 11, the high frequency power source 1442 was turned off for intermission of glow discharge. Under this state, the outflow valve 1427 was closed and the outflow valve 1426 was opened again, thus creating the same conditions as in formation of the intermediate layer. Subsequently, the high frequency power source was turned on to recommence glow discharge. The input power was 3 W, which was also the same as in formation of the intermediate layer. Thus, glow discharge was continued for 2 minutes to form a upper layer on the photoconductive layer. Then, the heater 1408 was turned off simultaneously with the high frequency power source and the substrate was left to cool. Upon reaching 100° C. of the substrate temperature, the outflow valves 1425, 1427 and the inflow valves 1420-2, 1421 were closed, with full opening of the main valve 1410, thereby evacuating the chamber 1401 to $1\times10^{-5}$. Then, the main valve 1410 was closed to return the chamber 1401 to atmospheric through the leak valve 1444 so as to be ready to take out the substrate having formed respective layers.

The thus prepared image forming member for electrophotography was placed in the same charging-light exposure experimental device as used in Example 11, wherein corona charging was effected at ⊕6.0 KV for 0.2 sec., followed immediately by irradiation of a light image. Irradiation of the light image was effected through a transmission type test chart, using a tungsten lamp as light source, at an intensity of 1.0 lux.sec.

Immediately thereafter, negatively charged developers (containing toner and carrier) were cascaded on the surface of the member, whereby there was obtained a good image on the surface of the member. When the toner image on the member was copied on a copying paper by corona discharge at ⊕5.0 KV. As a result, a distinct highly dense image was obtained with excellent resolving power and good gradation reproducibility.

EXAMPLE 18

Example 11 was repeated, except that the $Si_2H_6$ gas bomb without dilution was used in place of the $SiH_4(10)/H_2$ bomb, and the feed ratio of $Si_2H_6$ to $B_2H_6(50)/H_2$ set at 5:1 in forming the photoconductive layer, thereby to form an intermediate layer and a photoconductive layer on a molybdenum substrate. Then, taking out from the deposition chamber 1401, the image forming member prepared was subjected to the test for image formation by placing in the same experimental device for charging and exposure to light similarly as in Example 11. As a result, in case of the combination of ⊖5.5 KV corona discharge with ⊕ charged developer as well as the combination of ⊕6.0 KV corona discharge with ⊖ charged developer, a toner image of very high quality with high contrast was obtained on a copying paper.

1555 were respectively opened according to the conditions indicated in Table 8 to set the outlet pressure at 1 $kg/cm^2$ (the outlet pressure reading on gages 1534 through 1540), and the amount of gas flown through the flowmeters 1520 through 1526 was controlled to a desired value by the inflow valves 1527 through 1533 and the outflow valves 1513 through 1519, respectively. Then, the auxiliary valve 1509 was opened to permit each gas to flow into the chamber 1501, and the inner pressure in the chamber 1501 was controlled by the main valve 1512. After the flow amount (reading on the Pirani gage 1510) and the inner pressure in the chamber 1501 had been stabilized, the high frequency power source 1508 was turned on, with the shutter 1507 closed in case of glow discharge while with the shutter 1507 opened in case of sputtering, to generate glow discharging in the chamber 1501 to form a layer.

After formation of the layer for the requisite period of time, the high frequency power source 1508 and the heater 1504 were turned off, under which state the auxiliary valve 1509 was closed and the main valve fully opened. When the substrate was left to cool to 100° C.,

TABLE 8

| Sample No. | Upper layer | Preparation conditions: Starting gas or Target | Feed gas ratio or Area ratio | Preparation method | Power (W) | Layer thickness (Å) |
|---|---|---|---|---|---|---|
| B16 | A | Polycrystalline Si target; graphite target | Si:C = 1:9 (area ratio) | Sputter | 100 | 120 |
| B17 | B | $SiH_4$ (dil. to 10 vol % with $H_2$); $C_2H_4$ (dil. to 10 vol % with $H_2$) | $SiH_4/H_2:C_2H_4/H_2$ = 1:9 | Glow | 3 | 120 |
| B18 | C | $Si(CH_3)_4$ (dil. to 10 vol % with $H_2$) | — | Glow | 3 | 120 |
| B19 | D | $SiF_4$ (containing 10 vol % of $H_2$); $C_2H_4$ (dil. to 10 vol % with $H_2$) | $SiF_4/H_2:C_2H_4/H_2$ = 1:9 | Glow | 60 | 120 |
| B20 | E | $Si_3N_4$ target $N_2$ (dil. to 50 vol % with Ar) | — | Sputter | 100 | 200 |
| B21 | F | Polycrystalline Si target $N_2$ (dil. to 50 vol % with Ar) | — | Sputter | 100 | 200 |
| B22 | G | $SiF_4$ (containing $H_2$ in 10 vol %); $N_2$ | $SiF_4/H_2:N_2$ = 1:90 | Glow | 60 | 120 |
| B23 | H | $SiF_4$ (containing $H_2$ in 10 vol %); $NH_3$ (dil. to 10 vol % with $H_2$) | $SiF_4/H_2:NH_3H_2$ = 1:20 | Glow | 60 | 120 |

EXAMPLE 19

In accordance with the same conditions and procedures as in Example 11, an intermediate layer and a photoconductive layer were formed on a molybdenum substrate. Then, the substrate 1502 was fixed with the photoconductive layer downward onto the supporting member 1503 in the deposition chamber 1501 shown in FIG. 15. With the leak valve 1511 closed and the main valve 1512 opened, the chamber was evacuated to $5\times10^{-7}$ Torr. Thereafter, the auxiliary valve 1509, the outflow valves 1513 through 1519 and the inflow valves 1527 through 1533 were fully opened to discharge the gas in the system, followed by closing of the outflow valves 1513 through 1519 and the inflow valves 1527 through 1533. After the heater 1504 in the supporting member 1503 was turned on to set the temperature at a desired value, the outlet valves (1541 through 1548) of the gas bomb containing various gases 1549 through the main valve 1512 was closed and the chamber was brought to atmospheric through the leak valve 1511, whereupon the substrate was taken out.

In carrying out sputtering, the target 1505 was selected as desired from a polycrystalline Si, a polycrystalline Si on which graphite is partially laminated or $Si_3N_4$.

Figure 15:
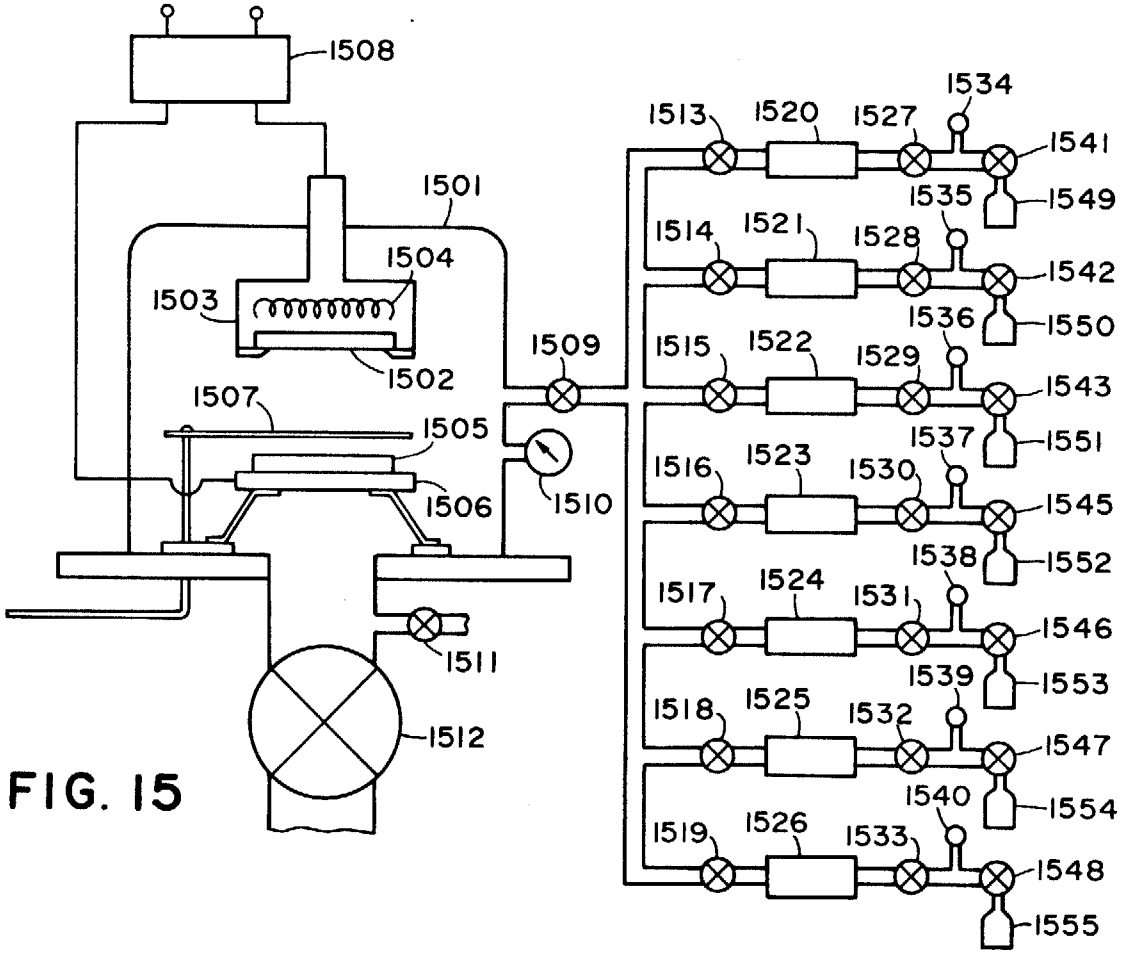

The gas species in respective bombs as shown in FIG. 15 are as follows:

Bomb 1549: $SiH_4$ gas (diluted to 10 vol.% with $H_2$), Bomb 1550: $SiF_4$ gas (containing $H_2$ in 10 vol.%), Bomb 1551: $Si(CH_3)_4$ gas (diluted to 10 vol.% with $H_2$), Bomb 1552: $C_2H_4$ gas (diluted to 10 vol.% with $H_2$), Bomb 1553: $NH_3$ gas (diluted to 10 vol.% with $H_2$), Bomb 1554: Ar gas, Bomb 1555: $N_2$ gas.

Using each of the thus prepared image forming members (Sample Nos. B16 to B 23), charging, exposure to light and copying were conducted similarly as in Example 11 with respect to both polarities ⊕ and ⊖, whereby no dependency on the polarity was recognized to give a very clear toner image in each case.

EXAMPLE 20

Following the procedures as described in Example 11, except for using $NH_3$ gas bomb previously diluted to 10 vol.% with $H_2$ [abridged as $NH_3(10)/H_2$] in place of $N_2$ gas bomb, an intermediate layer was formed with a feed ratio of $NH_3(10)/H_2$ gas to $SiH_4(10)/H_2$ gas of 2:1, followed by forming the photoconductive layer similarly as in Example 11. The resultant substrate was fixed on the supporting member in the device as shown in FIG. 15. According to the procedures similar to Example 19, the Sample Nos. B24 to B32 (upper layers I to Q) indicated in Table 9 were prepared. When charging, exposure to light and copying were conducted for each of these samples, no dependency on the charging polarity was observed and a very clear toner image was obtained in each case.

TABLE 9

| Sample No. | Upper layer | Preparation conditions: Starting gas or Target | Feed gas ratio or Area ratio | Preparation method | Power (W) | Layer thickness (Å) |
|---|---|---|---|---|---|---|
| B24 | I | Polycrystalline Si target; graphite target | Si:C = 1:9 (area ratio) | Sputter | 100 | 120 |
| B25 | J | $SiH_4$ (dil. to 10 vol % with $H_2$); $C_2H_4$ (dil. to 10 vol % with $H_2$) | $SiH_4/H_2:C_2H_4/H_2$ = 1:9 | Glow | 3 | 120 |
| B26 | K | $Si(CH_3)_4$ (dil. to 10 vol %) with $H_2$) | — | Glow | 3 | 120 |
| B27 | L | $SiF_4$ (containing $H_2$ in 10 vol %); $C_2H_4$ (dil. to 10 vol % with $H_2$) | $SiF_4/H_2:C_2H_4/H_2$ = 1:9 | Glow | 60 | 120 |
| B28 | M | $Si_3N_4$ target $N_2$ (dil. to 50 vol % with Ar) | — | Sputter | 100 | 200 |
| B29 | N | $SiH_4$ (dil. to 10 vol % with $H_2$) $N_2$ | $SiH_4/H_2:N_2$ = 1:10 | Glow | 3 | 120 |
| B30 | O | Polycrystalline Si target $N_2$ (dil. to 50 vol % with Ar) | — | Sputter | 100 | 200 |
| B31 | P | $SiF_4$ (containing $H_2$ in 10 vol %); $N_2$ | $SiF_4/H_2:N_2$ = 1:90 | Glow | 60 | 120 |
| B32 | Q | $SiF_4$ (containing $H_2$ in 10 vol %); $NH_3$ (dil. to 10 vol % with $H_2$) | $SiF_4H_2:NH_3/H_2$ = 1:20 | Glow | 60 | 120 |

EXAMPLE 21

Using a device as shown in FIG. 14 placed in a clean room which had been completely shielded, an image forming member for electrophotography was prepared according to the following procedures.

A substrate 1409 of molybdenum of 10 cm square having a thickness of 0.5 mm, whose surface had been cleaned, was fixed firmly on a supporting member 1403 disposed at a predetermined position in a deposition chamber 1401, mounted on a supporting stand 1402. The substrate 1409 was heated by a heater 1408 within the supporting member 1403 with a precision of ±0.5° C. The temperature was measured directly at the backside of the substrate by an alumel-chromel thermocouple. Then, after confirming that all the valves in the system were closed, the main valve 1410 was fully opened to discharge the gas in the chamber 1401 until it was evacuated to $5\times10^{-6}$ Torr. Thereafter, the input voltage for the heater 1408 was elevated by varying the input voltage while detecting the substrate temperature until the temperature was stabilized constantly at 200° C.

Then, the auxiliary valve 1440, subsequently the outflow valves 1425, 1426, 1427, 1429 and the inflow valves 1420-2, 1421, 1422, 1424, were opened fully to effect degassing sufficiently in the flowmeters 1416, 1417, 1418, 1420-1 to vacuo. After closing the auxiliary valve 1440 and the valves 1425, 1426, 1427, 1429, 1420-2, 1421, 1422, the valve 1430 of the bomb 1411 of $SiF_4$ gas (purity: 99.999%) containing 10 vol.% of $H_2$ [hereinafter referred to as $SiF_4/H_2(10)$] and the valve 1431 of the bomb containing $N_2$ gas (purity: 99.999%) were respectively opened to adjust the pressures at the output pressure gages 1435 and 1436, respectively. at 1 kg/cm$^2$, whereupon the inflow valves 1420-2 and 1421 were gradually opened to permit $SiF_4/H_2(10)$ gas and $N_2$ gas to flow into the flowmeters 1416 and 1417, respectively. Subsequently, the outflow valves 1425 and 1426 were gradually opened, followed by opening of the auxiliary valve 1440. The inflow valves 1420-2 and 1421 were adjusted thereby so that the gas feed ratio of $SiF_4/H_2(10)$ to $N_2$ was 1:90. Then, while carefully reading the Pirani gage 1441, the opening of the auxiliary valve 1440 was adjusted and the auxiliary valve 1440 was opened to the extent until the inner pressure in the chamber 1401 became $1\times10^{-2}$ Torr. After the inner pressure in the chamber 1401 was stabilized, the main valve 1410 was gradually closed to throttle its opening until the indication on the Pirani gage 1441 became 0.5 Torr. After confirming that the gas feeding and the inner pressure were stable, followed by turning on of the high frequency power source 1442, to input a high frequency power of 13.56 MHz into the induction coil 1443, thereby generating glow discharge in the chamber 1401 at the coil portion (upper part of chamber) to provide an input power of 60 W. The above conditions were maintained for one minute to deposit an intermediate layer on the substrate. Then, with the high frequency power source 1442 was turned off for intermission of the glow discharge, the outflow valves 1425 and 1426 were closed, and next the valve 1432 of the bomb 1413 containing $B_2H_6$ gas diluted with $H_2$ to 50 vol. ppm [hereinafter referred to as $B_2H_6(50)/H_2$] and the valve 1434 of the bomb 1415 containing $SiH_4$ gas diluted with $H_2$ to 10 vol.% [hereinafter referred to as $SiH_4(10)/H_2$] were respectively opened to adjust the pressures at the output pressure gages 1437 and 1439, respectively, at 1 kg/cm$^2$, whereupon the inflow valves 1422 and 1424 were gradually opened to permit $B_2H_6(50)/H_2$ gas and $SiH_4(10)/H_2$ gas to flow into the flowmeters 1418 and 1420-1, respectively. Subsequently, the outflow valves 1427 and 1429 were gradually opened. The inflow valves 1422 and 1424 were adjusted thereby so that the gas feed ratio of $B_2H_6(50)/H_2$ to $SiH_4(10)/H_2$ was 1:50. Then, as in formation of the intermediate layer, openings of the auxiliary valve 1440 and the main valve were adjusted so that the indication on the Pirani gage was 0.5 Torr, followed by stabilization.

Subsequently, the high frequency power source was turned on to recommence glow discharge. The input power was 10 W, which was reduced lower than before. After glow discharge was continued for 3 hours to form a photoconductive layer, the heater 1408 was turned off with the high frequency power source 1442 being also turned off, and the substrate is left to cool to 100° C., whereupon the outflow valves 1427, 1429 and the inflow valves 1420-2, 1421, 1422, 1424 were closed, with the main valve 1410 fully opened, thereby to make the inner pressure in the chamber 1401 to less than $10^{-3}$ Torr. Then, the main valve 1410 was closed and the inner pressure in the chamber 1401 was made atmospheric through the leak valve 1443, and the substrate was taken out. In this case, the entire thickness of the layers was about 9μ. The thus prepared image forming member for electrophotography was placed in an experimental device for charging and exposure to light, and corona charging was effected at ⊕6.0 KV for 0.2 sec., followed immediately by irradiation of a light image. The light image was irradiated through a transmission type test chart using a tungsten lamp as light source at an intensity of 0.8 lux.sec.

Immediately thereafter, negatively charged developers (containing toner and carrier) were cascaded on the surface of the member to obtain a good toner image on the image forming member for electrophotography. When the toner image on the image forming member for electrophotography was copied on a copying paper by corona charging at ⊖5.0 KV, there was obtained a clear image of high density which was excellent in resolving power as well as in gradation reproducibility.

Next, the above image forming member was subjected to corona charging by means of a charging light-exposure experimental device at ⊖5.5 KV for 0.2 sec., followed immediately by image exposure to light at an intensity of 0.8 lux.sec., and thereafter immediately positively charged developer was cascaded on the surface of the member. Then, by copying on a copying paper and fixing, there was obtained a very clear image.

As apparently seen from the above result, in combination with the previous result, the image forming member for electrophotography obtained in this Example has the characteristics of a both-polarity image forming member having no dependency on the charging polarity.

EXAMPLE 22

The image forming members shown as Sample Nos. C1 through C8 in Table 10 below were prepared under the same conditions and procedures as in Example 21 except that the glow discharge maintenance time in forming the intermediate layer on the molybdenum substrate was varied as shown in Table 10, and image formation was effected by placing in entirely the same device as in Example 21 to obtain the results as shown in Table 10.

As apparently seen from the results shown in Table 10, it is necessary to form the intermediate layer constituted of a—$Si_xN_{1-x}$ to a thickness within the range of from 30 Å to 1000 Å.

TABLE 10

| Sample No. | C1 | C2 | C3 | C4 | C5 | C6 | C7 | C8 |
|---|---|---|---|---|---|---|---|---|
| Time for forming intermediate layer (sec.) | 10 | 30 | 50 | 180 | 420 | 600 | 1000 | 1200 |
| Image quality: | | | | | | | | |
| Charging polarity ⊕ | Δ | ○ | ⊙ | ⊙ | ⊙ | ○ | Δ | X |
| Charging polarity ⊖ | X | Δ | ⊙ | ⊙ | ⊙ | ○ | Δ | X |

Remarks:
Ranks for evaluation:
⊙ excellent
○ good
Δ practically useable
X not good
Deposition speed of intermediate layer: 1 Å/sec.

EXAMPLE 23

The image forming members for electrophotography as shown by Sample Nos. C9 through C15 in Table 11 were prepared under the same conditions and procedures as in Example 21 except that the feed ratio of $SiF_4/H_2(10)$ gas to $N_2$ gas was varied as shown below in Table 11, and image forming was effected by placing in the same device as in Example 21 to obtain the results shown in Table 11. For only Sample Nos. C11 through C15, intermediate layers were analyzed by Auger electron spectroscopy to give the results as shown in Table 12.

As apparently seen from the results in Tables 11 and 12, it is desirable to form an intermediate layer in which the ratio x of Si to N is within the range of from 0.43 to 0.60.

TABLE 11

| Sample No. | C9 | C10 | C11 | C12 | C13 | C14 | C15 |
|---|---|---|---|---|---|---|---|
| $SiF_4/H_2(10):N_2$ (flow rate ratio) | 1:10 | 1:30 | 1:50 | 1:70 | 1:80 | 1:90 | 1:100 |
| Copies image quality: | | | | | | | |
| Charging polarity ⊕ | X | X | X | Δ | ○ | ⊙ | ⊙ |
| Charging polarity ⊖ | X | X | X | Δ | ○ | ⊙ | ⊙ |

Remarks:
Ranks for evaluation:
⊙ excellent
○ good
Δ practically useable
X not good

TABLE 12

| Sample No. | C11 | C12 | C13 | C14 | C15 |
|---|---|---|---|---|---|
| x in $Si_xN_{1-x}$ | 0.66 | 0.58 | 0.51 | 0.43 | 0.43 |

EXAMPLE 24

The molybdenum substrate was placed similarly as in Example 21, and the glow discharge deposition chamber 1401 was evacuated to $5\times10^{-6}$ Torr according to the same procedures as in Example 21. After the substrate temperature had been maintained at 200° C., the gas feeding systems for $SiF_4/H_2(10)$, $N_2$ and $SiH_4(10)/H_2$ were brought to vacuo of $5\times10^{-6}$ Torr according to the same procedures as in Example 21. Then, after closing the auxiliary valve 1440, the outflow valves 1425, 1426, 1429 and the inflow valves 1420-2, 1421, 1424, the valve 1430 of the bomb 1411 of $SiF_4/H_2(10)$ gas and the valve 1431 of the bomb 1412 of $N_2$ gas were respectively opened to adjust the pressures at the output pressure gages 1435 and 1436, respectively, at 1 kg/cm$^2$, whereupon the inflow valves 1420-2, 1421 were gradually opened to permit $SiF_4/H_2(10)$ gas and $N_2$ gas to flow into the flowmeters 1416 and 1417, respectively. Subsequently, the outflow valves 1425 and 1426 were gradually opened, followed by opening of the auxiliary valve 1440. The inflow valves 1420-2 and 1421 were adjusted thereby so that the gas feed ratio of $SiF_4/H_2(10)$ to $N_2$ was 1:90. Then, while carefully reading the Pirani gage 1441, the opening of the auxiliary valve 1440 was adjusted and the auxiliary valve 1440 was opened to the extent until the inner pressure in the chamber 1401 became $1\times10^{-2}$ Torr. After the inner pressure in the chamber 1301 was stabilized, the main valve 1410 was gradually closed to throttle its opening until the indication on the Pirani gage 1441 became 0.5 Torr. After the gas feeding was stabilized to give a constant inner pressure in the chamber and the substrate temperature stabilized to 200° C., the high frequency power source 1442 was turned on similarly as in Example 21 to commence glow discharging at an input power of 60 W, which condition was maintained for 1 minute to form an intermediate layer on the substrate. Then, the high frequency power source 1442 was turned off for intermission of glow discharging. Under this state, the outflow valves 1425, 1426, 1422 were closed, followed by opening of the valve 1434 of the $SiH_4(10)/H_2$ bomb 1415 to adjust the outlet pressure gage 1439 at 1 kg/cm$^2$, and the outflow valve 1424 was opened gradually to permit the $SiH_4(10)/H_2$ gas to flow into the flowmeter 1420-1. Subsequently, the outflow valve 1429 was gradually opened, and the openings of the auxiliary valve 1440 and the main valve 1410 adjusted and stabilized until the indication on the Pirani gage was 0.5 Torr, similarly as in formation of the intermediate layer.

Subsequently, by turning on of the high frequency power source 1442, glow discharging was recommenced at a reduced power of 10 W. After glow discharge was continued for additional 5 hours to form a photoconductive layer, the heater 1408 was turned off with the high frequency power source 1442 being also turned off, the substrate is left to cool to 100° C., whereupon the outflow valves 1429 and the inflow valves 1420-2, 1421 were closed, with the main valve 1410 fully opened, thereby to make the inner pressure in the chamber 1401 to less than $10^{-5}$ Torr. Then, the main valve 1410 was closed and the inner pressure in the chamber was made atmospheric through the leak valve 1444, and the substrate having formed each layer thereon was taken out. In this case, the entire thickness of the layers was about 15μ.

The thus prepared image forming member for electrophotography was used for forming the image on a copying paper according to the same procedures under the same conditions as in Example 21, whereby the image formed by ⊖ corona discharge was more excellent and clear, as compared with that formed by ⊕ corona discharge. From this result, the image forming member prepared in this Example was recognized to have a dependency on the charging polarity.

EXAMPLE 25

After conducting formation of an intermediate layer for one minute on a molybdenum substrate according to the same procedures under the same conditions as in Example 21, the high frequency power source 1442 was turned off for intermission of glow discharge. Under this state, the outflow valves 1425, 1426 were closed, and the valve 1433 of the bomb 1414 containing $PH_3$ diluted to 25 vol. ppm with $H_2$ [hereinafter referred to as $PH_3(25)/H_2$] and the valve 1434 of the bomb 1415 containing $SiH_4(10)/H_2$ gas were opened and the pressures at the outlet pressure gages 1438, 1439 were adjusted to 1 kg/cm$^2$, respectively, followed by opening gradually of the inflow valves 1423, 1424 to let in the $PH_3(25)/H_2$ gas and the $SiH_4(10)/H_2$ gas into the flowmeters 1419, 1420-1, respectively. Subsequently, the outflow valves 1428 and 1429 were opened gradually. The inflow valves 1423 and 1424 were thereby adjusted so that the flow rate ratio of $PH_3(25)/H_2$ gas to $SiH_4(10)/H_2$ was 1:50.

Next, the openings of the auxiliary valve 1440 and the main valve 1410 were adjusted and stabilized, similarly as in formation of the intermediate layer, until the indication on the Pirani gage was 0.5 Torr. Subsequently, the high frequency power source 1442 was turned on again to recommence glow discharge again with an input power of 10 W. After glow discharge was continued for additional 4 hours to form a photoconductive layer, the heater 1408 was turned off with the high frequency power source 1442 being also turned off, the substrate was left to cool to 100° C., whereupon the outflow valves 1428, 1429 and the inflow valves 1420-2, 1421, 1423, 1424 were closed, with the main valve 1410 fully opened, thereby to make the inner pressure in the chamber 1401 to less than $10^{-5}$ Torr. Then, the main valve 1410 was closed and the inner pressure in the chamber 1401 was made atmospheric through the leak valve 1444, and the substrate having formed each layer thereon was taken out. In this case, the entire thickness of the layers was about 11μ.

The thus prepared image forming member for electrophotography was subjected to image formation on a copying paper. As a result, the image formed by ⊖ corona discharge was better in quality and very clear, as compared with that formed by ⊕ corona discharge. This result shows that the image forming member prepared in this Examples is dependent on the charging polarity.

EXAMPLE 26

The intermediate layer and the photoconductive layer were formed on the molybdenum substrate under the same conditions according to the same procedures as in Example 21, except that, after formation of the intermediate layer on the molybdenum substrate, the flow rate ratio of $B_2H_6(50)/H_2$ gas to $SiH_4(10)/H_2$ gas was charged to 1:10 in forming the photoconductive layer.

The thus prepared image forming member for electrophotography was subjected to image formation on a copying paper. As a result, the image formed by ⊕ corona discharge was better in quality and very clear, as compared with that formed by ⊖ corona discharge. This result shows that the image forming member prepared in this Example is dependent on the charging polarity. But the charging polarity dependency was opposite to those of the image forming members obtained in Examples 24 and 25.

EXAMPLE 27

After conducting formation of an intermediate layer for one minute and then formation of a photoconductive layer for 5 hours on a molybdenum substrate according to the same procedures under the same conditions as in Example 21, the high frequency power source 1442 was turned off for intermission of glow discharge. Under this state, the outflow valves 1427, 1429 were closed and the outflow valves 1425, 1426 were opened again, thus creating the same conditions as in formation of the intermediate layer. Subsequently, the high frequency power source 1442 was turned on to recommence glow discharge. The input power was 60 W, which was also the same as in formation of the intermediate layer. Thus, glow discharge was continued for 2 minutes to form an upper layer on the photoconductive layer. Then, the heater 1408 and the high frequency power source 1442 were turned off and the substrate was left to cool. Upon reaching 100° C. of the substrate temperature, the outflow valves 1425, 1426 and the inflow valves 1420-2, 1421, 1422, 1424 were closed, with full opening of the main valve 1410, thereby evacuating the chamber 1401 to $1\times10^{-5}$. Then, the main valve 1410 was closed to return the chamber 1401 to atmospheric through the leak valve 1443, followed by taking out of the substrate having formed respective layers.

The thus prepared image forming member for electrophotography was placed in the same charging-light exposure experimental device as used in Example 21, wherein corona charging was feected at ⊕6.0 KW for 0.2 sec., followed immediately by irradiation of a light image. Irradiation of the light image was effected through a transmission type test chart, using a tungsten lamp as light source, at an intensity of 1.0 lux.sec.

Immediately thereafter, ⊖ charged developers (containing toner and carrier) were cascaded on the surface of the member, whereby there was obtained a good image on the surface of the member. When the toner image on the member was copied on a copying paper by corona discharge at ⊕5.0 KW. As a result, a clear highly dense image was obtained with excellent resolving power and good graduation reproducibility.

EXAMPLE 28

Prior to formation of the image forming member, the $N_2$ gas bomb 1412 shown in FIG. 14 was replaced with a bomb containing $NH_3$ gas (purity: 99.999%) diluted to 10 vol.% with $H_2$ [hereinafter referred to as $NH_3(10)/H_2$]. Then, Corning 7059 glass (1 mm thick, 4×4 cm, polished on both surfaces) with cleaned surfaces, having ITO on one surface in thickness of 1000 Å deposited by the electron beam vapor deposition method, was placed in the same device as used in Example 21 (FIG. 14) with the ITO-deposited surface as upper surface. Subsequently, according to the same procedures as described in Example 21, except that the $N_2$ gas bomb was changed to the $NH_3(10)/H_2$ gas bomb and the molybdenum substrate to the ITO substrate, the intermediate layer and the photoconductive layer were formed to prepare an image forming member. The thus prepared image forming member for electrophotography was placed in an experimental device for charging and exposure to light, and corona charging was effected at ⊕6.0 KV for 0.2 sec., followed immediately by irradiation of a light image. The light image was irradiated through a transmission type test chart using a tungsten lamp as light source at an intensity of 1.0 lux.sec.

Immediately thereafter, negatively charged developers (containing toner and carrier) were cascaded on the surface of the member to obtain a good toner image on the image forming member for electrophotography. When the toner image on the image forming member for electrography was copied on a copying paper by corona chaging at ⊕5.0 KV, there was obtained a clear image of high density which was excellent in resolving power as well as in gradation reproducibility.

When the corona charging polarity was changed to ⊖ and the polarity of the developer to ⊕, there was also obtained a clear and good image similarly as in Example 21.

EXAMPLE 29

Example 21 was repeated except that the $Si_2H_6$ gas bomb without dilution was used in place of the $SiH_4(10)/H_2$ bomb 1415, and a $B_2H_6$ gas bomb diluted with $H_2$ to 500 vol. ppm [hereinafter referred to as $B_2H_6(500)/H_2$] in place of the $B_2H_6(50)/H_2$ bomb 1413, thereby to form an intermediate layer and a photoconductive layer on a molybdenum substrate. Then, taking out from the deposition chamber 1401, the image forming member prepared was subjected to the test for image formation by placing in the same experimental device for charging and exposure to light similarly as in Example 21. As a result, in case of the combination of ⊖5.5 KV corona discharge with ⊕ charged developer as well as the combination of ⊕6.0 KV corona discharge with ⊖ charged developer, a toner image of very high quality with high contrast was obtained on a copying paper.

EXAMPLE 30

Figure 16:
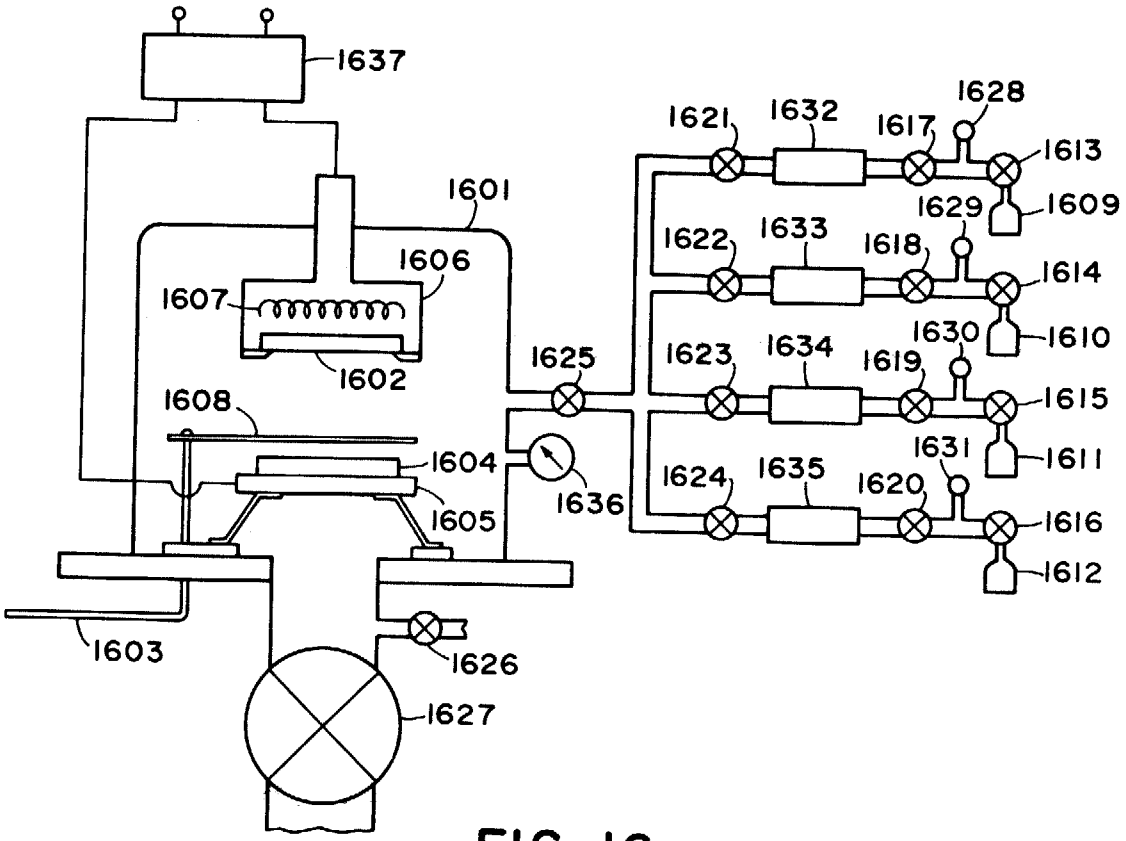

Using a device as shown in FIG. 16, an intermediate layer was formed on a molybdenum substrate according to the procedures described below.

A substrate 1602 of molybdenum of 10 cm square having a thickness of 0.5 mm, whose surface had been cleaned, was fixed firmly on a supporting member 1606 disposed at a predetermined position in deposition chamber 1601. The substrate 1602 was heated by a heater 1607 within the supporting member 1606 with a precision of ±0.5° C. The temperature was measured directly at the backside of the substrate by an alumel-chromel thermocouple. Then, after confirming that all the valves in the system were closed, the main valve 1627 was opened, and evacuation of the chamber 1601 was effected to $5\times10^{-6}$ Torr. Thereafter, the input voltage for the heater 1607 was elevated by varying the input voltage while detecting the substrate temperature until the temperature was stabilized constantly at 200° C.

Then, the auxiliary valve 1625, subsequently the outflow valves 1621, 1624 and the inflow valves 1617, 1620 were fully opened to effect degassing sufficiently also in the flowmeters 1632, 1635 to vacuo. After closing the auxiliary valve 1625 and the valves 1617, 1620, 1621, 1624, the valve 1616 of the bomb 1612 containing $F_3N$ gas (purity: 99.999%) and the valve 1613 of the bomb 1609 containing Ar gas were respectively opened to adjust the pressures at the output pressure gages 1628 and 1631, respectively, at 1 kg/cm$^2$, whereupon the inflow valves 1617 and 1620 were gradually opened to permit $F_3N$ gas and Ar gas to flow into the flowmeters 1632 and 1635, respectively. Subsequently, the outflow valves 1621 and 1624 were gradually opened, followed by opening of the auxiliary valve 1625. The inflow valves 1617 and 1620 were adjusted thereby so that the gas feed ratio of $F_3N$ to Ar was 1:1. Then, while carefully reading the Pirani gage 1636, the opening of the auxiliary valve 1625 was adjusted and the auxiliary valve 1625 was opened to the extent until the inner pressure in the chamber 1601 became $5\times10^{-4}$ Torr. After the inner pressure in the chamber 1601 was stabilized, the main valve 1627 was gradually closed to throttle its opening until the indication on the Pirani gage 1636 became $1\times10^{-2}$ Torr.

With the shutter 1608 being opened by operation of the shutter operating rod 1603, and after confirming that the flowmeters 1632, 1635 were stabilized, the high frequency power source 1637 was turned on to input as alternate current of 13.56 MHz, 100 W between the high purity polycrystalline silicon target 1603 and the supporting member 1606. Under these condition, the layer was formed while taking matching so as to continue a stable discharging. By continuing thus discharging for 2 minutes, there was formed an intermediate layer constituted of a—$Si_xN_{1-x}$:F having a thickness of 100 A. Then the high frequency power source 1637 was turned off for intermission of discharging. Subsequently, the outflow valves 1621, 1624 were closed, with full opening of the main valve 1627 to withdraw the gas in the chamber 1601 to vacuum of $5\times10^{-7}$ Torr. Then, the valve 1614 of the bomb 1610 containing $SiH_4$ gas (purity: 99.999%) diluted with $H_2$ to 10 vol.% [hereinafter referred to as $SiH_4(10)/H_2$] and the valve 1615 of the bomb 1611 containing $B_2H_6$ gas diluted with $H_2$ to 50 vol. ppm [hereinafter referred to as $B_2H_6(50)/H_2$] were respectively opened to adjust the pressures at the output pressure gages 1629 and 1630, respectively, at 1 kg/cm$^2$, whereupon the inflow valves 1618 and 1619 were gradually opened to permit $SiH_4(10)/H_2$ gas and $B_2H_6(50)/H_2$ gas to flow into the flowmeters 1633 and 1634, respectively. Subsequently, the outflow valves 1622 and 1623 were gradually opened, followed by opening of the auxiliary valve 1625. The inflow valves 1618 and 1619 were adjusted thereby so that the gas feed ratio of $SiH_4(10)/H_2$ to $B_2H_6(50)/H_2$ was 50:1. Then, while carefully reading the Pirani gage 1636, the opening of the auxiliary valve 1625 was adjusted and the auxiliary valve 1625 was opened to the extent until the inner pressure in the chamber 1601 became $1\times10^{-2}$ Torr. After the inner pressure in the chamber 1601 was stabilized, the main valve 1625 was gradually closed to throttle its opening until the indication on the Pirani gage 1636 became 0.5 Torr. After confirming that the gas feeding and the inner pressure were stable, the shutter 1608 was closed, followed by turning on of the high frequency power source 1637 to input a high frequency power of 13.56 MHz between the electrodes 1607 and 1608, thereby generating glow discharge in the chamber 1601 to provide an input power of 10 W. After glow discharge was continued for 3 hours to form a photoconductive layer, the heater 1607 was turned off with the high frequency power source 1637 being also turned off, the substrate was left to cool to 100° C., whereupon the outflow valves 1622, 1623 and the inflow valves 1618, 1619 were closed, with the main valve 1627 fully opened, thereby to make the inner pressure in the chamber 1601 to less than $10^{-5}$ Torr. Then, the main valve 1627 was closed and the inner pressure in the chamber was made atmospheric through the leak valve 1626, and the substrate having formed each layer thereon was taken out. In this case, the entire thickness of the layers was about 9μ. The thus prepared image forming member for electrophotography was placed in an experimental device for charging and exposure to light, and corona charging was effected at ⊕6.0 KV for 0.2 sec., followed immediately by irradiation of a light image. The light image was irradiated through a transmission type test chart using a tungsten lamp as light source at a dosage of 0.8 lux.sec.

Immediately thereafter, negatively charged developers (containing toner and carrier) were cascaded on the surface of the member to obtain a good toner image on the image forming member for electrophotography. When the toner image on the image forming member for electrography was copied on a copying paper by corona charging at ⊕5.0 KV, there was obtained a clear image of high density which was excellent in resolving power as well as in gradation reproducibility.

Next, the above image forming member was subjected to corona charging by means of a charging light-exposure experimental device at ⊖5.5 KV of 0.2 sec., followed immediately by image exposure to light at an intensity of 0.8 lux.sec., and thereafter immediately positively charged developer was cascaded on the surface of the member. Then, by copying on a copying paper and fixing, there was obtained a very clear image.

As apparently seen from the above result, in combination with the previous result, the image forming member for electrophotography has the characteristics of a both-polarity image forming member having no dependency on the charged polarity.

EXAMPLE 31

According to the same procedures under the same conditions as in Example 21, there were prepared 7 samples of image forming members and each sample was fixed with the photoconductive layer downward onto the supporting member 1606 in a device as shown in FIG. 16 to provide a substrate 1602.

Then, on each of the photoconductive layers of these samples, upper layer was formed under various conditions A to G indicated in Table 13 to prepare 7 samples (Sample Nos. C16 to C22) having respective upper layers.

In forming the upper layer A according to the sputtering method, the target 1604 was changed to a polycrystalline silicon target having partially laminated a graphite target thereon; while in forming the upper layer E, the target was changed to $Si_3N_4$ target and the Ar gas bomb 1609 to the $N_2$ gas bomb containing $N_2$ gas diluted with Ar to 50%.

In forming the upper layer B according to the glow discharge method, the $B_2H_6(50)/H_2$ gas bomb 1611 was changed to the $C_2H_4$ gas bomb diluted with $H_2$ to 10 vol.% [abridged as $C_2H_4(10)/H_2$]; in forming the upper layer C, the $B_2H_6(50)/H_2$ gas bomb 1611 to $Si(CH_3)_4$ bomb diluted to 10 vol.% with $H_2$; in forming the upper layer D, the $B_2H_6(50)/H_2$ gas bomb 1611 to $C_2H_4(10)/H_2$ gas bomb and the $F_3N$ gas bomb 1612 to $SiF_4$ gas bomb containing 10 vol.% of $H_2$; in forming upper layer G, the $N_2$ gas bomb to the $NH_3$ gas bomb diluted with $H_2$ to 10 vol.%.

Each of the thus prepared 7 image forming members having the upper layer A to G in Table 13, respectively, was used for copying a visible image on a copying paper, similarly as in Example 21, whereby there was obtained a very clear toner image without dependency on the charging polarity.

TABLE 13

| Sample No. | Upper layer | Preparation conditions: Starting gas or Target | Feed gas ratio or Area ratio | Preparation method | Power (W) | Layer thickness (Å) |
|---|---|---|---|---|---|---|
| C16 | A | Polycrystalline Si target; graphite target | Si:C = 1:9 (area ratio) | Sputter | 100 | 120 |
| C17 | B | $SiH_4$ (dil. to 10 vol % with $H_2$); $C_2H_4$ (dil. to 10 vol % with $H_2$) | $SiH_4/H_2:C_2H_4/H_2$ = 1:9 | Glow | 3 | 120 |
| C18 | C | $Si(CH_3)_4$ (dil. to 10 vol % with $H_2$) | — | Glow | 3 | 120 |
| C19 | D | $SiF_4$ (containing $H_2$ in 10 vol %); $C_2H_4$ (dil. to 10 vol % with $H_2$) | $SiF_4/H_2:C_2H_4/H_2$ = 1:9 | Glow | 60 | 120 |
| C20 | E | $Si_3N_4$ target $N_2$ (dil. to 50 vol % with Ar) | — | Sputter | 100 | 200 |
| C21 | F | $SiH_4$ (dil. to 10 vol % with $H_2$) $N_2$ | $SiH_4/H_2:N_2$ = 1:10 | Glow | 3 | 120 |
| C22 | G | $SiH_4$ (dil. to 10 vol % with $H_2$) $NH_3$ (dil. to 10 vol % with $H_2$) | $SiH_4/H_2:NH_3/H_2$ = 1:2 | Glow | 3 | 120 |

EXAMPLE 32

According to the same procedures under the same conditions as in Example 28, there were prepared 7 samples of image forming members, and each sample was fixed with the photoconductive layer downward onto the supporting member 1606 in a device as shown in FIG. 16 to provide a substrate 1602.

Then, on each of the photoconductive layers of these samples, upper layer (A to G) as shown in Table 13 was formed to prepare 7 samples of image forming members (Sample Nos. C23 to C29).

Each of the thus prepared 7 image forming members having the upper layers A to G, respectively, was used for forming a visible image and copying said image on a copying paper, similarly as in Example 21, whereby there was also obtained a very clear toner image without dependency on the charging polarity.

EXAMPLE 33

According to the same procedures under the same conditions as in Example 30, there were prepared 7 samples of image forming members, and each sample was fixed with the photoconductive layer downward onto the supporting member 1606 in a device as shown in FIG. 16 to provide a substrate 1602.

Then, on each of the photoconductive layers of these samples, upper layer (A to G) as shown in Table 13 was formed to prepare 7 samples of image forming members (Sample Nos. C30 to C36).

Each of the thus prepared 7 image forming members having the upper layers A to G, respectively, was used for forming a visible image and copying said image on a copying paper, similarly as in Example 21, whereby there was also obtained a very clear toner image without dependency on the charging polarity.

EXAMPLE 34

Using a device as shown in FIG. 13 placed in a clean room which had been completely shielded, an image forming member for electrophotography was prepared according to the following procedures.

A substrate 1302 of molybdenum of 10 cm square having a thickness of 0.5 mm, whose surface had been cleaned, was fixed firmly on a supporting member 1303 disposed at a predetermined position in a glow discharging deposition chamber 1301. The target 1305 was a high purity polycrystalline silicon (99.999%). The substrate 1302 was heated by a heater 1304 within the supporting member 1303 with a precision of ±0.5° C. The temperature was measured directly at the backside of the substrate by an alumel-chromel thermocouple. Then, after confirming that all the valves in the system are closed, the main valve 1312 was opened to evacuate the chamber 1301 to $5\times10^{-6}$ Torr. Then, the input voltage at the heater 1304 was changed, while detecting the molybdenum substrate temperature, until it was stabilized constantly at 200° C.

Subsequently, the supplemental valve 1309, and then the outflow valves 1313, 1319, 1331, 1337 and inflow valves 1315, 1321, 1333, 1339 were fully opened to remove sufficiently the gases in the flowmeters 1314, 1320, 1332, 1338. After the auxiliary valve 1309 and the valves 1313, 1319, 1331, 1337 were closed, respectively, the valve 1335 of the bomb 1336 containing $N_2$ gas (purity: 99.999%) and the valve 1341 of the bomb 1342 containing Ar gas (purity: 99.999%) were opened until the reading on the outlet pressure gages 1334, 1340 were respectively adjusted to 1 kg/cm$^2$, and then the inflow valves 1333, 1339 were gradually opened thereby to permit $N_2$ and Ar gases to flow into the flowmeters 1332 and 1338. Subsequently, the effluent valves 1331, 1337 were gradually opened, followed by gradual opening of the auxiliary valve 1309. The inflow valves 1333 and 1339 were adjusted so that $N_2/Ar$ feed ratio was 1:1. The opening of the auxiliary valve 1309 was adjusted, while reading carefully the Pirani gage 1310 until the pressure in the chamber 1301 became $5\times10^{-4}$ Torr. After the inner pressure in the chamber 1301 was stabilized, the main valve 1312 was gradually closed to throttle the opening until the indication on the Pirani gage became $1\times10^{-2}$ Torr. After confirming that the gas feeding and the inner pressure were stabilized, the shutter 1307 was opened and then the high frequency power source 1308 was turned on to input an alternate current of 13.56 MHz between the silicon target 1305 and the supporting member 1303 to generate glow discharge in the chamber 1301 to provide an input power of 100 W. Under these conditions, discharging was continued for one minute to form an intermediate layer of a—$Si_xN_{1-x}$ on the substrate. Then, the high frequency power source 1308 was turned off for intermission of glow discharging.

Subsequently, the outflow valves 1331, 1337 and inflow valves 1333, 1339 were closed and the main valve 1312 fully opened to discharge the gas in the chamber 1301 until it was evacuated to $5\times10^{-6}$ Torr. Then, the auxiliary valve 1309 and the outflow valves 1331, 1337 were opened fully to effect degassing sufficiently in the flowmeters 1332, 1338 to vacuo. After closing the auxiliary valve 1309 and the valves 1331, 1337, the valve 1317 of the bomb 1318 of $SiF_4$ gas (purity: 99.999%) containing 10 vol.% of $H_2$ [hereinafter referred to as $SiF_4/H_2(10)$] and the valve 1323 of the bomb 1324 containing $B_2H_6$ gas diluted with $H_2$ to 500 vol. ppm [hereinafter referred to as $B_2H_6(500)/H_2$] were respectively opened to adjust the pressures at the outlet pressure gages 1316 and 1322, respectively, to 1 kg/cm$^2$, whereupon the inflow valves 1315, 1321 were gradually opened to permit $SiF_4/H_2(10)$ gas and $B_2H_6(500)/H_2$ gas to flow into the flowmeters 1314 and 1320, respectively. Subsequently, the outflow valves 1313 and 1319 were gradually opened, followed by opening of the auxiliary valve 1309. The inflow valves 1315 and 1321 were adjusted thereby so that the gas feed ratio of $SiF_4/H_2(10)$ to $B_2H_6(500)/H_2$ was 70:1. Then, while carefully reading the Pirani gage 1310, the opening of the auxiliary valve 1309 was adjusted and it was opened to the extent until the inner pressure in the chamber became $1\times10^{-2}$ Torr. After the inner pressure in the chamber was stabilized, the main valve 1312 was gradually closed to throttle its opening until the indication on the Pirani gage 1310 became 0.5 Torr.

After the shutter 1307 (one of the electrodes) was closed and, confirming that the gas feeding and the inner pressure were stable, the high frequency power source 1308 was turned on to input a high frequency power of 13.56 MHz between the electrode 1303 and the shutter 1307, thereby generating glow discharge in the chamber 1301 to provide an input power of 60 W. After glow discharging was continued for 3 hours to form a photoconductive layer, the heater 1304 was turned off with the high frequency power source 1308 being also turned off, and the substrate was left to cool to 100° C., whereupon the outflow valves 1313, 1319 and the inflow valves 1315, 1321 were closed, with the main valve 1312 fully opened, thereby to make the inner pressure in the chamber 1301 to less than $10^{-5}$ Torr. Then, the main valve 1312 was closed and the inner pressure in the chamber 1301 was made atmospheric through the leak valve 1311, and the substrate was taken out. In this case, the entire thickness of the layers was about 9μ. The thus prepared image forming member for electrophotography was placed in an experimental device for charging and exposure to light, and corona charging was effected at ⊕6.0 KV for 0.2 sec., followed immediately by irradiation of a light image. The light image was irradiated through a transmission type test chart using a tungsten lamp as light source at an intensity of 1.0 lux.sec.

Immediately thereafter, negatively charged developers (containing toner and carrier) were cascaded on the surface of the member to obtain a good toner image on the image forming member for electrophotography. When the toner image on the image forming member for electrography was copied on a copying paper by corona charging at ⊕5.0 KV, there was obtained a clear image of high density which was excellent in resolution as well as in gradation reproducibility.

Next, the above image forming member was subjected to corona charging by means of a charging light-exposure experimental device at ⊖5.5 KV for 0.2 sec., followed immediately by image exposure to light at an intensity of 0.8 lux.sec., and thereafter immediately positively charged developer was cascaded on the surface of the member. Then, by copying on a copying paper and fixing, there was obtained a very clear image.

As apparently seen from the above result, in combination with the previous result, the image forming member for electrophotography has the characteristics of a both-polarity image forming member having no dependency on the charged polarity.

EXAMPLE 35

The image forming members shown as Sample Nos. D1 through D8 in Table 14 were prepared under the same conditions and procedures as in Example 34 except that the sputtering time in forming the intermediate layer on the molybdenum substrate was varied as shown in Table 14 below, and image formation was effected by placing in entirely the same device as in Example 34 to obtain the results as shown also in Table 14.

TABLE 14

| Sample No. | D1 | D2 | D3 | D4 | D5 | D6 | D7 | D8 |
|---|---|---|---|---|---|---|---|---|
| Time for forming intermediate layer (sec.) | 10 | 30 | 50 | 150 | 300 | 500 | 1000 | 1200 |
| Image quality: | | | | | | | | |
| Charging polarity ⊕ | Δ | ○ | ⊙ | ⊙ | ⊙ | ○ | Δ | X |
| Charging polarity ⊖ | X | Δ | ⊙ | ⊙ | ⊙ | ○ | Δ | X |

Remarks:
Ranks for evaluation:
⊙ excellent
○ good
Δ practically useable
X not good
Deposition speed of intermediate layer: 1 Å/sec.

As apparently seen from the results shown in Table 14, it is necessary to form the intermediate layer to a thickness within the range of from 30 Å to 1000 Å to achieve the objects of this invention.

EXAMPLE 36

The image forming members for electrophotography shown as Sample Nos. D9 through D15 were prepared under the same conditions and procedures as in Example 34 except that the feed ratio of $N_2$ gas to Ar gas in forming the intermediate layer was varied as shown below in Table 15, and image formation was effected by placing in the same device as in Example 34 to obtain the results shown in Table 15. For only Sample Nos. D11 through D15, intermediate layers were analyzed by Auger electron spectroscopy to give the results as shown in Table 16.

As apparently seen from the results shown in Table 16, it is desirable that x in $Si_xN_{1-x}$ concerning the composition ratio of Si and N in the intermediate layer should be 0.60 to 0.43, in order to achieve the objects of the invention.

TABLE 15

| Sample No. | D9 | D10 | D11 | D12 | D13 | D14 | D15 |
|---|---|---|---|---|---|---|---|
| $N_2$:Ar (feed ratio) | 1:25 | 1:12 | 1:8 | 1:6 | 1:4 | 1:1 | 1:0 |
| Copied image quality: | | | | | | | |
| Charging polarity ⊕ | X | X | X | Δ | ○ | ⊙ | ⊙ |
| Charging polarity ⊖ | X | X | X | Δ | ○ | ⊙ | ⊙ |

Remarks:
Ranks for evaluation:
⊙ excellent
○ good
Δ practically useable
X not good

TABLE 16

| Sample No. | D11 | D12 | D13 | D14 | D15 |
|---|---|---|---|---|---|
| x | 0.66 | 0.58 | 0.50 | 0.43 | 0.43 |

EXAMPLE 37

According to the same procedures as described in Example 34, an intermediate layer constituted of a—$Si_xN_{1-x}$ was provided on a molybdenum substrate.

Subsequently, the inflow valves 1333, 1339, were closed, and the auxiliary valve 1309 and then the outflow valves 1331, 1337 were fully opened to effect degassing sufficiently in the flowmeters 1332, 1338 to vacuo. After closing the auxiliary valve 1309 and the valves 1331, 1337, the valve 1317 of the $SiF_4/H_2(10)$ gas bomb 1318 was opened to adjust the pressure at the outlet pressure gage 1316 to 1 kg/cm$^2$, whereupon the inflow valve 1315 was gradually opened, followed by gradual opening of the auxiliary valve 1309. Then, while carefully reading the Pirani gage 1310, the opening of the auxiliary valve 1309 was adjusted and it was opened to the extent until the inner pressure in the chamber became $1\times10^{-2}$ Torr. After the inner pressure in the chamber was stabilized, the main valve 1312 was gradually closed to throttle its opening until the indication on the Pirani gage 1310 became 0.5 Torr.

After confirming that the gas feeding and the inner pressure were stable, the shutter 1307 was closed and the high frequency power source 1308 was turned on to input a high frequency power of 13.56 MHz between the electrodes 1303 and 1307, thereby generating glow discharge in the chamber 1301 to provide an input power of 60 W. After glow discharging was continued for 3 hours to form a photoconductive layer, the heater 1304 was turned off with the high frequency power source 1308 being also turned off, and the substrate was left to cool to 100° C., whereupon the outflow valves 1313, 1319 and the inflow valves 1315, 1321 were closed, with the main valve 1312 fully opened, thereby to make the inner pressure in the chamber 1301 to less than $10^{-5}$ Torr. Then, the main valve 1312 was closed and the inner pressure in the chamber 1301 was made atmospheric through the leak valve 1311, and the substrate having respective layers formed thereon was taken out. In this case, the entire thickness of the layers was about 9μ. The thus prepared image forming member for electrophotography was subjected to image formation on a copying paper. As a result, the image formed by ⊖ corona discharge was better in quality and very clear, as compared with that formed by ⊕ corona discharge. This result shows that the image forming member prepared in this Examples is depended on the charging polarity.

EXAMPLE 38

After an intermediate layer was formed for one minute on a molybdenum substrate using conditions and procedures similar to Example 34, the deposition chamber was evacuated to $5\times10^{-7}$ Torr, whereupon $SiF_4/H_2(10)$ gas was introduced into the deposition chamber according to the same procedures as in Example 34. Thereafter, under the gas pressure at 1 kg/cm$^2$ (reading on the outlet pressure gage 1328) through the inflow valve 1327 from the bomb 1330 containing $PF_5$ gas diluted with $H_2$ to 250 vol. ppm [hereinafter referred to as $PF_5(250)/H_2$], the inflow valve 1327 and the outflow valve 1325 were adjusted to determine the opening of the outflow valve 1325 so that the reading on the flowmeter 1326 may be 1/60 of the flow amount of $SiF_4/H_2(10)$, followed by stabilization.

Subsequently, with the shutter 1307 closed and the high frequency power source 1308 turned on, the glow discharge was recommenced. The input voltage applied thereby was 60 W. Thus, glow discharge was continued for additional 4 hours to form a photoconductive layer on the intermediate layer. The heater 1304 and the high frequency power source 1308 were then turned off, and, upon cooling of the substrate to 100° C., the outflow valves 1313, 1325 and the inflow valves 1315, 1317 were closed, with full opening of the main valve 1312 to evacuate the chamber 1301 to $10^{-5}$ Torr, followed by leaking of the chamber 1301 to atmospheric through the leak valve 1311 with closing of the main valve 1312. Under such a state, the substrate having formed layers thereon was taken out. In this case, the entire thickness of the layers formed was about 11μ.

The thus prepared image forming member for electrophotography was used for forming the image on a copying paper according to the same procedures under the same conditions as in Example 34, whereby the image formed by ⊖ corona discharge was more excellent and clear as compared with that formed by ⊕ corona discharge. From this result, the image forming member prepared in this Example was recognized to have a dependency on the charging polarity.

EXAMPLE 39

After an intermediate layer was formed for one minute on a molybdenum substrate according to the same procedures and under the same conditions as in Example 34, the deposition chamber was evacuated to $5\times10^{-7}$ Torr and $SiF_4/H_2(10)$ gas was introduced into the chamber 1301 according to the same procedures as in Example 34. Then, under the pressure of the gas from the bomb 1324 containing $B_2H_6$ diluted with $H_2$ to 500 vol. ppm [hereinafter referred to as $B_2H_6$ (500)/$H_2$] through the feed valve 1321 at 1 kg/cm$^2$ (reading on the outlet pressure gage 1322), the inflow valve 1321 and the outflow valve 1319 were adjusted to determine the opening of the outflow valve 1319 so that the reading on the flowmeter 1320 was 1/15 of the flow rate of $SiF_4/H_2(10)$ gas, followed by stabilization.

Subsequently, with the shutter 1307 closed, the high frequency power source 1308 was turned on again to recommence glow discharge. The input voltage applied was 60 W. Thus, glow discharge was continued for additional 4 hours to form a photoconductive layer on the intermediate layer. The heater 1304 and the high frequency power source 1308 were turned off and, upon cooling of the substrate to 100° C., the outflow valves 1313, 1319 and the inflow valves 1315, 1321 were closed, with full opening of the main valve 1312 to evacuate the chamber 1301 to $10^{-5}$ Torr. Then, the chamber 1301 was brought to atmospheric through the leak valve 1311 with closing of the main valve 1312, and the substrate having formed respective layers was taken out. In this case, the entire thickness of the layers formed was about 10$\mu$.

The thus prepared image forming member for electrophotography was used for forming an image on a copying paper according to the same procedures and under the same conditions as in Example 34. As a result, the image formed by ⊕ corona discharge was more excellent in image quality and extremely clear as compared with that formed by ⊖ corona discharge. This result shows that the image forming member obtained in this Example has a dependency on charging polarity, which dependency, however, was opposite to that in the image forming members obtained in Examples 37 and 38.

EXAMPLE 40

After conducting formation of an intermediate layer for one minute and then formation of a photoconductive layer for 5 hours on a molybdenum substrate according to the same procedures under the same conditions as in Example 34, the high frequency power source 1308 was turned off for intermission of glow discharge. Under this state, the outflow valves 1313, 1319 were closed and the outflow valves 1331, 1337 were opened again with opening of the shutter 1307 thus creating the same conditions as in formation of the intermediate layer. Subsequently, the high frequency power source was turned on to recommence glow discharge. The input power was 100 W, which was also the same as in formation of the intermediate layer. Thus, glow discharge was continued for 2 minutes to form an upper layer on the photoconductive layer. Then, the high frequency power source 1308 was turned off and the substrate was left to cool. Upon reaching 100° C. of the substrate temperature, the outflow valves 1331, 1337 and the inflow valves 1333, 1339 were closed, with full opening of the main valve 1313 thereby evacuating the chamber to $1\times10^{-5}$. Then, the main valve 1312 was closed to return the chamber 301 to atmospheric through the leak valve 1311, and the substrate having formed respective layers therein was taken out.

The thus prepared image forming member was placed in the same experimental device for charging and exposure to light as used in Example 34, and corona charging was effected at ⊕6.0 KV for 0.2 sec., followed immediately by irradiation of a light image. The light image was irradiated through a transmission type test chart using a tungsten lamp as light source as an intensity of 1.0 lux.sec.

Immediately thereafter, negatively charged developers (containing toner and carrier) were cascaded on the surface of the member to obtain a good toner image on the image forming member for electrophotography. When the toner image on the image forming member for electrography was copied on a copying paper by corona charging at ⊕5.0 KV, there was obtained a clear image of high density which was excellent in resolving power as well as in gradation reproducibility. In case of the combination of ⊖5.5 KV corona charging with ⊕ charged developer, there was also obtained a good image.

EXAMPLE 41

An intermediate layer and a photoconductive layer were formed on a molybdenum substrate according to the same procedures under the same conditions as in Example 37 except that the $SiF_4/H_2(10)$ bomb 1318 was replaced with the $SiF_4$ gas bomb diluted with Ar to 5 vol.% [abridged as $SiF_4(5)/Ar$]. Then, the substrate was taken out from the deposition chamber 1301 and placed in the same experimental device for charging and light exposure as used in Example 34 for performing the test of image formation. As a result, in case of the combination of ⊖5.5 KV corona discharge and ⊕ charged developer, there was obtained a toner image of very good quality with high contrast on a copying paper.

EXAMPLE 42

According to the same procedures under the same conditions as in Example 34, there were prepared 9 samples of image forming members having formed photoconductive layers thereon. Then on each of the photoconductive layers of these samples, upper layer was formed under various conditions (A to I) indicated in Table 17 to prepare 9 samples (Sample Nos. D16 to D24) having respective upper layers.

In forming the upper layer A according to the sputtering method, the target 1305 was changed to a polycrystalline silicon target having partially laminated a graphite target thereon; while in forming the upper layer E, the target was changed to $Si_3N_4$ target.

In forming the upper layer B according to the glow discharge method, the $SiF_4/H_2(10)$ gas bomb 1318 was changed to the $SiH_4/H_2$ gas bomb diluted to 10 vol.% with $H_2$ and the $B_2H_6(500)/H_2$ gas bomb to the $C_2H_4$ gas bomb diluted with $H_2$ to 10 vol.%; in forming the upper layer C, the $B_2H_6(500)/H_2$ gas bomb 1324 to $Si(CH_3)_4$ bomb diluted to 10 vol.% with $H_2$; in forming the upper layer D, the $B_2H_6(500)/H_2$ gas bomb 1324 to $C_2H_4(10)/H_2$ gas bomb similarly as in forming the upper layer B; in forming upper layers F, G, the $PF_5/H_2(10)$ gas bomb 1330 to the $NH_3$ gas bomb diluted with $H_2$ to 10 vol% and $SiF_4/H_2(10)$ gas bomb 1318 to $SiH_4(10)/H_2$ gas bomb; and in forming the upper layer I, the $B_2H_6(500)/H_2$ gas bomb 1324 to the $NH_3$ bomb diluted to 10 vol.% with $H_2$.

Each of the thus prepared 9 image forming members having the upper layers A to I, respectively, was used for forming a visible image and copying said image on a copying paper, similarly as in Example 34 whereby there was obtained a very clear toner image without dependency on the charging polarity.

TABLE 17

| Sample No. | Upper layer | Preparation conditions: Starting gas or Target | Feed gas ratio or Area ratio | Preparation method | Power (W) | Layer thickness (Å) |
|---|---|---|---|---|---|---|
| D16 | A | Polycrystalline Si target; graphite target | Si:C = 1:9 (area ratio) | Sputter | 100 | 120 |
| D17 | B | $SiH_4$ (dil. to 10 vol % with $H_2$); $C_2H_4$ (dil. to 10 vol % with $H_2$) | $SiH_4/H_2:C_2H_4/H_2$ = 1:9 | Glow | 3 | 120 |
| D18 | C | $Si(CH_3)_4$ (dil. to 10 vol % with $H_2$) | — | Glow | 3 | 120 |
| D19 | D | $SiF_4$ (containing $H_2$ in 10 vol %); $C_2H_4$ (dil. to 10 vol % with $H_2$) | $SiF_4/H_2:C_2H_4/H_2$ = 1:9 | Glow | 60 | 120 |
| D20 | E | $Si_3N_4$ target $N_2$ (dil. to 50 vol % with Ar) | — | Sputter | 100 | 200 |
| D21 | F | $SiH_4$ (dil. to 10 vol % with $H_2$) $N_2$ | $S_iH_4/H_2:N_2$ = 1:10 | Glow | 3 | 120 |
| D22 | G | $SiH_4$ (dil. to 10 vol % with $H_2$) $NH_3$ (dil. to 10 vol % with $H_2$) | $SiH_4/H_3:NH_3/H_2$ = 1:2 | Glow | 3 | 120 |
| D23 | H | $SiF_4$ (containing $H_2$ in 10 vol %); $N_2$ | $SiF_4/H_2:N_2$ = 1:90 | Glow | 60 | 120 |
| D24 | I | $SiF_4$ (containing $H_2$ in 10 vol %); $NH_3$ (dil. to 10 vol % with $H_2$) | $SiF_4/H_2:NH_3/H_2$ = 1:20 | Glow | 60 | 120 |

EXAMPLE 43

An intermediate layer was formed in accordance with the same conditions and the procedures as in Example 34, except for previously replacing the polycrystalline Si target with $Si_3N_4$ target, and further a photoconductive layer was formed thereon similarly as in Example 34.

Then, similarly as in Example 42, 9 image forming members having respective upper layers A to I as shown in Table 17 (Sample Nos. D25 to D33) were prepared and each sample was tested for image formation and copying of the image on a copying paper according to the same procedures and under the same conditions as described in Example 34. As a result, in each case, there was obtained a very clear image without dependency of the charging polarity.

EXAMPLE 44

Using a device as shown in FIG. 13 placed in a clean room which had been completely shielded, an image forming member for electrophotography was prepared according to the following procedures.

A substrate 1302 of molybdenum of 10 cm square having a thickness of 0.5 mm, whose surface had been cleaned, was fixed firmly on a supporting member 1303 disposed at a predetermined position in a glow discharging deposition chamber 1301. The substrate 1302 was heated by a heater 1304 within the supporting member 1303 with a precision of ±0.5° C. The temperature was measured directly at the backside of the substrate by an alumel-chromel thermocouple. Then, after confirming that all the valves in the system were closed, the main valve 1312 was fully opened to evacuate the chamber 1301 to $5\times10^{-6}$ Torr. Then, the input voltage at the heater 1304 was changed, while detecting the molybdenum substrate temperature, until it was stabilized constantly at 200° C.

Subsequently, the auxiliary valve 1309, and then the outflow valves 1313, 1319, 1331, 1337 and inflow valves 1315, 1321, 1333, 1339 were fully opened to remove also sufficiently the gases in the flowmeters 1314, 1320, 1332, 1338 to vacuo. After the auxiliary valve 1309 and the valves 1313, 1319, 1331, 1337 were closed, respectively, the valve 1335 of the bomb 1346 containing $SiH_4$ gas diluted with $H_2$ to 10 vol.% [hereinafter referred to as $SiH_4(10)/H_2$] and the valve 1341 of the bomb 1342 containing $N_2$ gas (purity: 99.999%) were opened until the reading on the outlet pressure gages 1334, 1340 were respectively adjusted to 1 kg/cm$^2$, and then the inflow valves 1333, 1339 were gradually opened thereby to permit $SiH_4(10)/H_2$ and $N_2$ gases to flow into the flowmeters 1332 and 1338, respectively. Subsequently, the outflow valves 1331, 1337 were gradually opened, followed by gradual opening of the auxiliary valve 1309. The inflow valves 1333 and 1339 were adjusted so that the feed ratio of $SiH_4(10)/H_2$ to $N_2$ to 1:10. The opening of the auxiliary valve 1309 was adjusted, while carefully reading the Pirani gage 1310 until the pressure in the chamber 1301 became $1\times10^{-2}$ Torr. After the inner pressure in the chamber 1301 was stabilized, the main valve 1312 was gradually closed to throttle the opening until the indication on the Pirani gage became 0.5 Torr. After confirming that the gas feeding and the inner pressure were stabilized, the shutter 1307 (which is also used as one of the electrodes) was opened and then the high frequency power source 1308 was turned on to input an alternate current of 13.56 MHz between the electrode 1303 and the shutter 1307 to generate glow discharge in the chamber 1301 to provide an input power of 3 W. Under these conditions, discharging was continued for one minute to form an intermediate layer by deposition of a—$(Si_xN_{1-x})_y$: $H_{1-y}$. Then, the high frequency power source 1308 was turned off for intermission of glow discharging, under which state the outflow valves 1331, 1337 and inflow valves 1333, 1339 were closed and the main valve 1312 fully opened to discharge the gas in the chamber 1301 until it was evacuated to $5\times10^{-7}$ Torr, followed by closing of the auxiliary valve 1309.

Next, the valve 1317 of the bomb 1318 containing $SiF_4$ gas (purity: 99.999%) containing 10 vol.% of $H_2$ [hereinafter referred to as $SiF_4/H_2(10)$] and the valve 1323 of the bomb 1324 containing $B_2H_6$ gas diluted with $H_2$ to 500 vol. ppm [hereinafter referred to as $B_2H_6(500)/H_2$] were respectively opened to adjust the pressures at the outlet pressure gages 1316 and 1322, respectively, to 1 kg/cm$^2$, whereupon the inflow valves 1315, 1321 were gradually opened to permit $SiF_4/H_2(10)$ gas and $B_2H_6(500)/H_2$ gas to flow into the flowmeters 1314 and 1320, respectively. Subsequently, the outflow valves 1313 and 1319 were gradually opened, followed by opening of the auxiliary valve 1309. The inflow valves 1315 and 1321 were adjusted thereby so that the gas feed ratio of $SiF_4/H_2(10)$ to $B_2H_6(500)/H_2$ was 70:1. Then, while carefully reading the Pirani gage 1310, the opening of the auxiliary valve 1309 was adjusted and it was opened to the extent until the inner pressure in the chamber became $1\times10^{-2}$ Torr. After the inner pressure in the chamber was stabilized, the main valve 1312 was gradually closed to throttle its opening until the indication on the Pirani gage 1310 became 0.5 Torr. After confirming that the gas feeding and the inner pressure were stable and also confirming that the shutter 1307 was closed, the high frequency power source 1308 was turned on to input a high frequency power of 13.56 MHz between the electrode 1303 and the shutter 1307, thereby generating glow discharge in the chamber 1301 to provide an input power of 60 W. After glow discharging was continued for 3 hours to form a photoconductive layer, the heater 1304 was turned off with the high frequency power source 1308 being also turned off, the substrate was left to cool to 100° C., whereupon the outflow valves 1313, 1319 and the inflow valves 1315, 1321 were closed, with the main valve 1312 fully opened, thereby to make the inner pressure in the chamber 1301 to less than $10^{-5}$ Torr. Then, the main valve 1312 was closed and the inner pressure in the chamber 1301 was made atmospheric through the leak valve 1311, and the substrate was taken out. In this case, the entire thickness of the layers was about 9μ. The thus prepared image forming member for electrophotography was placed in an experimental device for charging and exposure to light, and corona charging was effected at ⊕6.0 KV for 0.2 sec., followed immediately by irradiation of a light image. The light image was irradiated through a transmission type test chart using a tungsten lamp as light source at an intensity of 0.8 lux.sec.

Immediately thereafter, negatively charged developers (containing toner and carrier) were cascaded on the surface of the member to obtain a good toner image on the image forming member for electrophotography. When the toner image on the image forming member for electrography was copied on a copying paper by corona charging at ⊕5.0 KV, there was obtained a clear image of high density which was excellent in resolving power as well as in gradation reproducibility.

Next, the above image forming member was subjected to corona charging by means of a experimental device for charging and light-exposure at ⊖5.5 KV for 0.2 sec., followed immediately by image exposure to light at an intensity of 0.8 lux.sec., and thereafter immediately positively charged developer was cascaded on the surface of the member. Then, by copying on a copying paper and fixing, there was obtained a very clear image.

As apparently seen from the above result, in combination with the previous result, the image forming member for electrophotography has the characteristics of a both-polarity image forming member having no dependency on the charged polarity.

EXAMPLE 45

The image forming members as shown by Sample Nos. E1 through E8 were prepared under the same conditions and procedures as in Example 44 except that the sputtering time in forming the intermediate layer on the molybdenum substrate was varied as shown in Table 18 below, and image formation was effected by placing in entirely the same device as in Example 44 to obtain the results as shown in Table 18.

TABLE 18

| Sample No. | E1 | E2 | E3 | E4 | E5 | E6 | E7 | E8 |
|---|---|---|---|---|---|---|---|---|
| Time for forming intermediate layer (sec.) | 10 | 30 | 50 | 180 | 420 | 600 | 1000 | 1200 |
| Image quality: | | | | | | | | |
| Charging polarity ⊕ | Δ | ○ | ⊙ | ⊙ | ⊙ | ○ | Δ | X |
| Charging polartiy ⊖ | X | Δ | ⊙ | ⊙ | ⊙ | ○ | Δ | X |

Remarks:
Ranks for evaluation:
⊙ excellent
○ good
Δ practically useable
X not good
Film deposition speed of intermediate layer: 1 Å/sec.

As apparently seen from the results shown in Table 18, it is necessary to form the intermediate layer to a thickness within the range of from 30 Å to 1000 Å.

EXAMPLE 46

The image forming members for electrophotography shown as Sample Nos. E9 through E15 were prepared under the same conditions and procedures as in Example 44 except that the gas feed ratio of $SiH_4(10)/H_2$ to $N_2$ was varied as shown in Table 19, and image formation was effected by placing in the same device as in Example 44 to obtain the results shown in Table 19. For only Sample Nos. E11 through E15, intermediate layers were analyzed by Auger electron spectroscopy to give the results as shown in Table 20.

As apparently seen from the results in Tables 19 and 20, it is desirable to form an intermediate layer in which the x concerning the composition ratio of Si to N is within the range of from 0.60 to 0.43.

TABLE 19

| Sample No. | E9 | E10 | E11 | E12 | E13 | E14 | E15 |
|---|---|---|---|---|---|---|---|
| $SiH_4(10)/H_2:N_2$ (feed ratio) | 2:1 | 1:1 | 1:2 | 1:4 | 1:6 | 1:8 | 1:10 |
| Copied image quality: | | | | | | | |
| Charging polarity ⊕ | X | X | X | Δ | ⊙ | ⊙ | ⊙ |
| Charging | | | | | | | |

TABLE 19-continued

| Sample No. | E9 | E10 | E11 | E12 | E13 | E14 | E15 |
|---|---|---|---|---|---|---|---|
| polarity ⊖ | X | X | X | Δ | ◎ | ◎ | ◎ |

Remarks:
Ranks for evaluation:
◎ excellent
○ good
Δ practically useable
X not good

TABLE 20

| Sample No. | E11 | E12 | E13 | E14 | E15 |
|---|---|---|---|---|---|
| x | 0.66 | 0.58 | 0.50 | 0.43 | 0.43 |

EXAMPLE 47

After an intermediate layer was formed following the conditions and procedures as in Example 44, the valve 1335 of the bomb 1336 and the valve 1341 of the bomb 1342 were closed, and the chamber 1301 was evacuated to $5\times10^{-7}$ Torr. Thereafter, the auxiliary valve 1309 and then the outflow values 1331, 1337 and the inflow valves 1333, 1339 were closed. Then, the valve 1317 of the bomb 1318 containing $SiF_4/H_2(10)$ was opened and the pressure at the outlet pressure gage was adjusted to 1 kg/cm$^2$, followed by opening gradually of the inflow valve 1315 to let in the $SiF_4/H_2(10)$ gas into the flowmeter 1314. Subsequently, the outflow valve 1313 was opened gradually and then the auxiliary valve 1309 gradually opened.

Next, while carefully reading the Pirani gage 1310, the opening of the auxiliary valve 1309 was adjusted and it was opened until the inner pressure in the chamber 1301 became $1\times10^{-2}$. After the inner pressure in the chamber was stabilized, the main valve 1312 was gradually closed to throttle its opening until the indication on the Pirani gage 1310 became 0.5 Torr. Confirming stabilization of gas feeding and of inner pressure, the shutter 1307 was closed, followed by turning on the high frequency power source 1308 to input a high frequency power of 13.56 MHz between the electrodes 1307 and 1303, thereby generating glow discharge in the chamber 1301, to provide an input power of 60 W. Glow discharge was continued for 3 hours to form a photoconductive layer, and thereafter the heater 1304 was turned off, and also the high frequency power source 1308 turned off. Upon cooling of the substrate to a temperature to 100° C., the outflow valve 1313 and the inflow valve 1315 were closed, with full opening of the main valve 1312 to evacuate the chamber 1301 to $10^{-5}$ Torr or less. Thereafter, the main valve 1312 was closed, and the inner pressure in the chamber 1301 to atmospheric through the leak valve 1311, and the substrate having formed respective layers was taken out. In this case, the entire thickness of the layers was found to be about 9μ. The thus prepared image forming member for electrophotography was subjected to image formation on a copying paper according to the same procedures and under the same conditions as described in Example 34. As a result, the image formed by ⊖ corona discharge was better in quality and very clear, as compared with that formed by ⊕ corona discharge. This result shows that the image forming member prepared in this Examples is dependent on the charging polarity.

EXAMPLE 48

After conducting formation of an intermediate layer for one minute and then formation of a photoconductive layer for 5 hours on a molybdenum substrate according to the same procedures under the same conditions as in Example 44, the high frequency power source 1308 was turned off for intermission of glow discharge. Under this state, the outflow valves 1313, 1319 were closed and the outflow valves 1331, 1337 were opened again, thus creating the same conditions as in formation of the intermediate layer. Subsequently, the high frequency power source was turned on the recommence glow discharge. The input power was 3 W, which was also the same as in formation of the intermediate layer. Thus, glow discharge was continued for 2 minutes to form an upper layer on the photoconductive layer. Then, the heater 1304 and the high frequency power source 1308 were turned off and the substrate was left to cool. Upon reaching 100° C. of the substrate temperature, the outflow valves 1331, 1337 and the inflow valves 1333, 1339 were closed, with full opening of the main valve 1312, thereby evacuating the chamber to $1\times10^{-5}$. Then, the main valve 1312 was closed to return the chamber 1301 to atmospheric through the leak valve 1311 so as to be ready to take out the substrate having formed respective layers.

The thus prepared image forming member for electrophotography was placed in the same charging-light exposure experimental device as used in Example 44, wherein corona charging was effected at ⊕6 KV for 0.2 sec., followed immediately by irradiation of a light image. Irradiation of the light image was effected through a transmission type test chart, using a tungsten lamp as light source, at an intensity of 1.0 lux.sec.

Immediately thereafter, ⊖ charged developers (containing toner and carrier) were cascaded on the surface of the member, whereby there was obtained a good image on the surface of the member. When the toner image on the member was copied on a copying paper by corona discharge at ⊕5.0 KV. As a result, a clear highly dense image was obtained with excellent resolving power and good gradation reproducibility. Similarly, good image was obtained by combination of ⊖5.5 KV corona charging with ⊕ charged developer.

EXAMPLE 49

After an intermediate layer was formed for one minute on a molybdenum substrate using conditions and procedures similar to Example 44, the deposition chamber was evacuated to $5\times10^{-7}$ Torr, whereupon $SiF_4/H_2(10)$ gas was introduced into the deposition chamber according to the same procedures as in Example 44. Thereafter, under the gas pressure at 1 kg/cm$^2$ (reading on the outlet pressure gage 1322) through the inflow valve 1321 from $B_2H_6(500)/H_2$ bomb 1324, the inflow valve 1321 and the outflow valve 1319 were adjusted to determine the opening of the outflow valve 1319 so that the reading on the flowmeter 1320 may be 1/15 of the flow rate of $SiF_4/H_2(10)$, followed by stabilization.

Subsequently, with the shutter 1307 closed and the high frequency power source 1308 turned on, the glow discharge was recommenced. The input voltage applied thereby was 60 W. Thus, glow discharge was continued for additional 4 hours to form a photoconductive layer on the intermediate layer. The heater 1304 and the high frequency power source 1308 were then turned off, and, upon cooling of the substrate to 100° C., the outflow valves 1313, 1319 and the inflow valves 1315, 1321 were closed, with full opening of the main valve 1312 to evacuate the chamber to 1301 to $10^{-5}$ Torr, followed by leaking of the chamber 1301 to atmospheric through the leak valve 1311 with closing of the main valve 1312. Under such a state, the substrate having formed layers thereon was taken out. In this case, the entire thickness of the layers formed was about 10μ.

The thus prepared image forming member for electrophotography was used for forming the image on a copying paper according to the same procedures under the same conditions as in Example 44, whereby the image formed by ⊕ corona discharge was more excellent and clear as compared with that formed by ⊖ corona discharge. From this result, the image forming member prepared in this Example was recognized to have a dependency on the charging polarity.

EXAMPLE 50

After an intermediate layer was formed for one minute on a molybdenum substrate according to the same procedures and the same conditions as in Example 44, the deposition chamber was evacuated to $5\times10^{-7}$ Torr and $SiF_4/H_2(10)$ gas was introduced into the chamber 1301 according to the same procedures as in Example 44. Then, under the pressure of $PF_5$ gas diluted to 250 vol. ppm with $H_2$ [$PF_5(250)/H_2$; purity 99.999%] from the bomb 1330 through the inflow valve 1327 at 1 kg/cm$^2$ (reading on the outlet pressure gage 1328), the inflow valve 1327 and the outflow valve 1325 were adjusted to determine the opening of the outflow valve 1325 so that the reading on the flowmeter 1326 was 1/60 of the flow rate of $SiF_4/H_2(10)$ gas, followed by stabilization.

Subsequently, with the shutter 1307 closed, the high frequency power source 1308 was turned on again to recommence glow discharge. The output voltage applied was 60 W. Thus, glow discharge was continued for additional 4 hours to form a photoconductive layer on the intermediate layer. The heater 1304 and the high frequency power source 1308 were turned off and, upon cooling of the substrate to 100° C., the outflow valves 1313, 1325 and the inflow valves 1313, 1327 were closed, with full opening of the main valve 1312 to evacuate the chamber to $10^{-5}$ Torr. Then, the chamber 1301 was brought to atmospheric through the leak valve 1311 with closing of the main valve 1312, and the substrate having formed respective layers was taken out. In this case, the entire thickness of the layers formed was about 11μ.

The thus prepared image forming member for electrophotography was used for forming an image on a copying paper according to the same procedures and under the same conditions as in Example 44. As a result, the image formed by ⊖ corona discharge was more excellent in image quality and extremely clear, as compared with that formed by ⊕ corona discharge. This result shows that the image forming member obtained in this Example has a dependency on charging polarity.

EXAMPLE 51

In place of molybdenum substrate, there was used Corning 7059 glass (1 mm thick, 4×4 cm, polished on both surfaces) with cleaned surfaces, having ITO on one surface in thickness of 1000 A deposited by the electron beam vapor deposition method, which was placed on the support 1303 in the same device as used in Example 44 (FIG. 13) with the ITO-deposited surface as upper surface.

The $N_2$ gas bomb 1342 was also replaced with the $NH_3$ gas bomb containing $NH_3$ diluted with $H_2$ to 10 vol.% [hereinafter referred to as $NH_3(10)/H_2$]. The feed ratio of $SiH_4(10)/H_2$ to $NH_3(10)/H_2$ in forming the intermediate layer was adjusted to 1:20. Under otherwise the same conditions as in Example 47, the intermediate layer and the photoconductive layer were formed on the ITO substrate, and thereafter the image forming member thus prepared was taken out from the deposition chamber 1301. Image forming test was conducted by placing the member in an experimental device for charging light-exposure similarly as in Example 44. As a result, very good toner image with high contrast was obtained on a copying paper by combination of ⊖5.5 KV corona charging with ⊕ charged developer.

EXAMPLE 52

According to the same procedures under the same conditions as in Example 44, there were prepared 9 samples of image forming members having formed photoconductive layers thereon. Then, on each of the photoconductive layers of these samples, upper layer was formed under various conditions A to I indicated in Table 21 to prepare 9 samples (Sample Nos. E16 to E24) having respective upper layers.

In forming the upper layer A according to the sputtering method, the target 1305 was changed to a polycrystalline silicon target having partially laminated a graphite target thereon and further the $N_2$ gas bomb 1342 to Ar gas bomb; while in forming the upper layer E, the target was changed to $Si_3N_4$ target and the $N_2$ gas bomb 1342 to the $N_2$ gas bomb containing $N_2$ gas diluted with Ar to 50%.

In forming the upper layer B according to the glow discharge method, the $B_2H_6(500)/H_2$ gas bomb 1324 was changed to the $C_2H_4$ gas bomb diluted with $H_2$ to 10 vol.%; in forming the upper layer C, the $B_2H_6(500)/H_2$ gas bomb 1324 to $Si(CH_3)_4$ bomb diluted to 10 vol.% with $H_2$; in forming the upper layer D, the $B_2H_6(500)/H_2$ gas bomb 1324 to $C_2H_4(10)/H_2$ gas bomb similarly as in formation of the upper layer B; in forming the upper layer G, the $PF_5(250)/H_2$ gas bomb 1330 to the $NH_3$ gas bomb diluted with $H_2$ to 10 vol.%; and in forming the upper layer I, the $PF_5(250)/H_2$ gas bomb 1330 to the $NH_3$ bomb diluted to 10 vol.% with $H_2[NH_3(10)/H_2]$.

Each of the thus prepared 9 image forming members having the upper layers A to I, respectively, was used for forming a visible image and copying said image on a copying paper, similarly as in Example 44, whereby there was obtained a very clear toner image without dependency on the charging polarity.

TABLE 21

| Sample No. | Upper layer | Preparation conditions: Starting gas or Target | Feed gas ratio or Area ratio | Preparation method | Power (W) | Layer thickness (Å) |
|---|---|---|---|---|---|---|
| E16 | A | Polycrystalline Si target; graphite target | Si:C = 1:9 (area ratio) | Sputter | 100 | 120 |
| E17 | B | $SiH_4$ (dil. to 10 vol % | $SiH_4/H_2:C_2H_4/H_2$ = | Glow | 3 | 120 |

TABLE 21-continued

| Sample No. | Upper layer | Preparation conditions: Starting gas or Target | Feed gas ratio or Area ratio | Preparation method | Power (W) | Layer thickness (A) |
|---|---|---|---|---|---|---|
| | | with $H_2$); $C_2H_4$ (dil. to 10 vol % with $H_2$) | 1:9 | | | |
| E18 | C | $Si(CH_3)_4$ (dil. to 10 vol % with $H_2$) | — | Glow | 3 | 120 |
| E19 | D | $SiF_4$ (containing $H_2$ in 10 vol %); $C_2H_4$ (dil. to 10 vol % with $H_2$) | $SiF_4/H_2:C_2H_4/H_2$ = 1:9 | Glow | 60 | 120 |
| E20 | E | $Si_3N_4$ target $N_2$ (dil. to 50 vol % with Ar) | — | Sputter | 100 | 200 |
| E21 | F | $SiH_4$ (dil. to 10 vol % with $H_2$) $N_2$ | $SiH_4/H_2:N_2$ = 1:10 | Glow | 3 | 120 |
| E22 | G | $SiH_2$ (dil. to 10 vol % with $H_2$) $NH_3$ (dil. to 10 vol % with $H_2$) | $SiH_4/H_2:NH_3/H_2$ = 1:2 | Glow | 3 | 120 |
| E23 | H | $SiF_4$ (containing $H_2$ in 10 vol %); $N_2$ | $SiF_4/H_2:N_2$ = 1:90 | Glow | 60 | 120 |
| E24 | I | $SiF_4$ (containing $H_2$ in 10 vol %); $NH_3$ (dil. to 10 vol % with $H_2$ | $SiF_4/H_2:NH_3/H_2$ = 1:20 | Glow | 60 | 120 |

EXAMPLE 53

Using a device as shown in FIG. 14 placed in a clean room which had been completely shielded, an image forming member for electrophotography was prepared according to the following procedures.

A substrate 1409 of molybdenum of 10 cm square having a thickness of 0.5 mm, whose surface had been cleaned, was fixed firmly on a supporting member 1402 disposed at a predetermined position in a deposition chamber 1401. The substrate 1409 was heated by a heater 1408 within the supporting member 1403 with a precision of ±0.5° C. The temperature was measured directly at the backside of the substrate by an alumel-chromel thermocouple. Then, after confirming that all the valves in the system were closed, the main valve 1410 was fully opened to discharge the gas in the chamber 1401 until it was evacuated to $5\times10^{-6}$. Thereafter, the input voltage for the heater 1408 was elevated by varying the input voltage while detecting the substrate temperature until the temperature was stabilized constantly at 200° C.

Then, the supplemental valve 1440, subsequently the outflow valves 1425, 1426, 1427 and the inflow valves 1420-2, 1421, 1422, were opened fully to effect degassing sufficiently in the flowmeters 1416, 1417, 1418 to vacuo. After closing the auxiliary valve 1440 and the valves 1425, 1426, 1427, 1420-2, 1421, 1422, the valve 1430 of the bomb 1411 containing $SiF_4$ gas (purity: 99.999%) with $H_2$ content of 10 vol.% [hereinafter referred to as $SiF_4/H_2(10)$] and the valve 1431 of the bomb 1412 containing $N_2$ gas (purity: 99.999%) were respectively opened to adjust the pressures at the outlet pressure gages 1435 and 1436, respectively, at 1 kg/cm$^2$, whereupon the inflow valves 1420-2 and 1421 were gradually opened to permit $SiF_4/H_2(10)$ gas and $N_2$ gas to flow into the flowmeters 1416 and 1417, respectively. Subsequently, the outflow valves 1425 and 1426 were gradually opened, followed by opening of the auxiliary valve 1440. The inflow valves 1420-2 and 1421 were adjusted thereby so that the gas feed ratio of $SiF_4/H_2(10)$ to $N_2$ was 1:90. Then, while carefully reading the Pirani gage 1441, the opening of the auxiliary valve 1440 was adjusted and the auxiliary valve 1440 was opened to the extent until the inner pressure in the chamber 1401 became $1\times10^{-2}$ Torr. After the inner pressure in the chamber 1401 was stabilized, the main valve 1410 was gradually closed to throttle its opening until the indication on the Pirani gage 1441 became 0.5 Torr. After confirming that the gas feeding and the inner pressure were stable, the high frequency power source 1442 was turned on to input a high frequency power of 13.56 MHz into the induction coil 1443, thereby generating glow discharge in the chamber 1401 at the coil portion (upper part of chamber) to provide an input power of 60 W. The above conditions were maintained for one minute to deposit an intermediate layer on the substrate.

Then, with the high frequency power source 1442 turned off for intermission of the glow discharge, the outflow valves 1425 and 1426 were closed, and the valve 1432 of the bomb 1413 containing $B_2H_6$ gas diluted with $H_2$ to 500 vol. ppm [hereinafter referred to as $B_2H_6(500)/H_2$] was opened to adjust the pressure at the outlet pressure gage 1437 at 1 kg/cm$^2$, whereupon the feed valve 1422 was gradually opened to permit $B_2H_6(500)/H_2$ gas to flow into the flowmeters 1418. Subsequently, the outflow valve 1427 was gradually opened. The inflow valves 1420-2 and 1422 were adjusted so that the gas feed ratio $B_2H_6(500)/H_2$ to $SiF_4/H_2(10)$ gas 1:70. Then, similarly as in formation of the intermediate layer, openings of the auxiliary valve 1440 and the main valve 1410 were adjusted so that the indication on the Pirani gage was 0.5 Torr, followed by stabilization.

Subsequently, the high frequency power source was turned on to recommence glow discharge. The input power was 60 W, as was the same as before.

After glow discharge was continued for 3 hours to form a photoconductive layer, the heater 1408 was turned off with the high frequency power source 1442 being also turned off, the substrate was left to cool to 100° C., whereupon the outflow valves 1425, 1427 and the inflow valves 1420-2, 1422 were closed, with the main valve 1410 fully opened, thereby to make the inner pressure in the chamber 1401 to less than $10^{-5}$ Torr. Then the main valve 1410 was closed and the inner pressure in the chamber was made atmospheric through the leak valve 1443, and the substrate having formed respective layers thereon was taken out. In this case, the entire thickness of the layers was about 9μ. The thus prepared image forming member for electrophotography was placed in an experimental device for charging and exposure to light, and corona charging was effected at ⊕6.0 KV for 0.2 sec., followed immediately by irradiation of a light image. The light image was irradiated through a transmission type test chart using a tungsten lamp as light source at a dosage of 0.8 lux.sec.

Immediately thereafter, negatively charged developers (containing toner and carrier) were cascaded on the surface of the member to obtain a good toner image on the image forming member for electrophotography. When the toner image on the image forming member for electrophotography was copied on a copying paper by corona charging at ⊕0.5 KV, there was obtained a clear image of high density which was excellent in resolving power as well as in gradation reproducibility.

Next, the above image forming member was subjected to corona charging by means of a charging light-exposure experimental device at ⊖5.5 KV for 0.2 sec., followed immediately by image exposure to light at an intensity 0.8 lux.sec., and thereafter immediately positively charged developer was cascaded on the surface of the member. Then, by copying on a copying paper and fixing, there was obtained a very clear image.

As apparently seen from the above results, the image forming member for electrophotography obtained in this Example has the characteristics of a both-polarity image forming member having no dependency on the charged polarity.

EXAMPLE 54

The image forming members shown as Sample Nos. G1 through G8 in Table 22 were prepared under the same conditions and procedures as in Example 53 except that the glow discharge maintenance time in forming the intermediate layer on the molybdenum substrate was varied as shown in Table 22 below, and image formation was effected by placing in entirely the same device as in Example 53 to obtain the results as shown in Table 22.

TABLE 22

| Sample No. | G1 | G2 | G3 | G4 | G5 | G6 | G7 | G8 |
|---|---|---|---|---|---|---|---|---|
| Time for forming intermediate layer (sec.) | 10 | 30 | 50 | 180 | 420 | 600 | 1000 | 1200 |
| Image quality: | | | | | | | | |
| Charging polarity ⊕ | Δ | ○ | ⊙ | ⊙ | ⊙ | ○ | Δ | X |
| Charging polarity ⊖ | X | Δ | ⊙ | ⊙ | ⊙ | ○ | Δ | X |

Remarks:
Ranks for evaluation:
⊙ excellent
○ good
Δ practically useable
X not good
Film deposition speed of intermediate layer: 1 A/sec.

As apparently seen from the results shown in Table 22, it is necessary to form the intermediate layer to a thickness within the range of from 30 Å to 1000 Å.

EXAMPLE 55

The image forming members for electrophotography shown as Sample Nos. G9 through G15 were prepared under the same conditions and procedures as in Example 53 except that the feed gas ratio of $SiF_4/H_2(10)$ to $N_2$ was varied as shown in Table 23 below, and image formation was effected by placing in the same device as in Example 53 to obtain the results shown in Table 23. For only Sample Nos. G11 through G15, intermediate layers were analyzed by Auger electron spectroscopy to give the results as shown in Table 24.

As apparently seen from the results in Tables 23 and 24, in order to achieve the objects of this invention, it is necessary to form the intermediate layer so that the composition ratio x of Si to N may be in the range from 0.43 to 0.60.

TABLE 23

| Sample No. | G9 | G10 | G11 | G12 | G13 | G14 | G15 |
|---|---|---|---|---|---|---|---|
| $SiF_4/H_2(10):N_2$ (feed ratio) | 1:10 | 1:30 | 1:50 | 1:70 | 1:80 | 1:90 | 1:100 |
| Copied image quality: | | | | | | | |
| Charging polarity ⊕ | X | X | X | Δ | ⊙ | ⊙ | ○ |
| Charging polarity ⊖ | X | X | X | Δ | ⊙ | ⊙ | ○ |

Remarks:
Ranks for evaluation:
⊙ excellent
○ good
Δ practically useable
X not good

TABLE 24

| Sample No. | G11 | G12 | G13 | G14 | G15 |
|---|---|---|---|---|---|
| x | 0.66 | 0.58 | 0.51 | 0.43 | 0.43 |

EXAMPLE 56

The molybdenum substrate was placed similarly as in Example 53, and the glow discharge deposition chamber 1401 shown in FIG. 14 was evacuated to $5\times10^{-6}$ Torr. After the substrate temperature had been maintained at 200° C., the gas feeding systems for $SiF_4/H_2(10)$ and $N_{22}$ were brought to vacuo of $5\times10^{-6}$ Torr according to the same procedures as in Example 53. Then, the auxiliary valve 1440 and the outflow valves 1425, 1426 and the inflow valves 1420-2, 1421 were closed and then, the valve 1430 of the bomb 1411 of $SiF_4/H_2(10)$ gas and the valve 1431 of $N_2$ gas bomb were respectively opened to adjust the pressures at the outlet pressure gages 1435 and 1436, respectively, at 1 kg/cm$^2$, whereupon the inflow valves 1420-2 and 1421 were gradually opened to permit $SiF_4/H_2(10)$ gas and $N_2$ gas to flow into the flowmeters 1416 and 1417, respectively. Subsequently, the outflow valves 1425 and 1426 were gradually opened, followed by opening of the auxiliary valve 1440. The inflow valves 1420-2 and 1421 were adjusted thereby so that the gas inflow ratio of $SiF_4/H_2(10)$ to $N_2$ was 1:90. Then, while carefully reading the Pirani gage 1441, the opening of the auxiliary valve 1440 was adjusted and the auxiliary valve 1440 was opened to the extent until the inner pressure in the chamber 1401 became $1\times10^{-2}$ Torr. After the inner pressure in the chamber 1401 was stabilized, the main valve 1410 was gradually closed to throttle its opening until the indication on the Pirani gage 1441 became 0.5

Torr. After the gas feeding was stabilized to give a constant inner pressure in the chamber and the substrate temperature stabilized to 200° C., the high frequency power source 1442 was turned on similarily as in Example 53 to commence glow discharging at an input power of 60 W, which condition was maintained for 1 minute to form an intermediate layer on the substrate. Then, the high frequency power source 1442 was turned off for intermission of glow discharging. Under this state, the outflow valve 1426 was closed. Then, according to the same procedures for formation of the photoconductive layer as in Example 53 except that no $B_2H_6(500)/H_2$ gas was flown at all, $SiF_4/H_2(10)$ gas was introduced into the chamber 1401.

Subsequently, by turning on of the high frequency power source 1442 to recommence glow discharge. The input power was 60 W similarly as before. After glow discharge was continued for 5 hours to form a photoconductive layer, the heater 1408 was turned off with the high frequency power source 1442 being also switched off, the substrate was left to cool to 100° C., whereupon the outflow valve 1425 and the inflow valves 1420-2, 1421 were closed, with the main valve 1410 fully opened, thereby to make the inner pressure in the chamber 1401 to less than $10^{-5}$ Torr. Then, the main valve 1410 was closed and the inner pressure in the chamber was made atmospheric through the leak valve 1444, and the substrate having formed each layer thereon was taken out. In this case, the entire thickness of the layers was about 15μ.

The thus prepared image forming member for electrophotography was used for forming the image on a copying paper according to the same procedures under the same conditions as in Example 53, whereby the image formed by ⊖ corona discharge was more excellent and clear, as compared with that formed by ⊕ corona discharge. From this result, the image forming member prepared in this Example was recognized to have a dependency on the charging polarity.

EXAMPLE 57

After conducting formation of an intermediate layer for one minute on a molybdenum substrate according to the same procedures under the same conditions as in Example 53, the high frequency power source 1442 was turned off for intermission of glow discharge. Under this state, the outflow valve 1426 was closed, and the valve 1433 of the bomb 1414 containing $PH_3$ gas diluted to 250 vol. ppm with $H_2$ [hereinafter referred to as $PH_3(250)/H_2$] and the pressure at the outlet pressure gage 1438 was adjusted to 1 kg/cm$^2$, followed by gradually opening the feed valve 1423 to let in the $PH_3(250)/H_2$ gas into the flowmeter 1419. Subsequently, the outflow valve 1428 was opened gradually. The feed valves 1420-2 and 1423 were thereby adjusted so that the feed gas ratio of $PH_3(250)/H_2$ to $SiF_4/H_2(10)$ might be 1:60.

Next, the openings of the auxiliary valve 1440 and the main valve 1410 were adjusted and stabilized, similarly as in formation of the intermediate layer, until the indication on the Pirani gage 1441 was 0.5 Torr. Subsequently, the high frequency power source 1442 was turned on again to recommence glow discharge with an input power of 60 W. After glow discharge was continued for additional 4 hours to form a photoconductive layer, the heater 1408 was turned off with the high frequency power source 1442 being also turned off, the substrate was left to cool to 100° C., whereupon the outflow valves 1425, 1428 and the inflow valves 1420-2, 1421, 1423 were closed, with the main valve 1410 fully opened, thereby to make the inner pressure in the chamber 1401 to less than $10^{-5}$ Torr. Then, the main valve 1410 was closed and the inner pressure in the chamber 1401 was made atmospheric through the leak valve 1444, and the substrate having formed respective layers thereon was taken out. In this case, the entire thickness of the layers was about 11μ.

The thus prepared image forming member for electrophotography was subjected to image formation on a copying paper according to the same procedures and under the same conditions as described in Example 53. As a result, the image formed by ⊖ corona discharge was better in quality and very clear, as compared with that formed by ⊕ corona discharge. This result shows that the image forming member prepared in this Examples is dependent on the charging polarity.

EXAMPLE 58

The intermediate layer and the photoconductive layer were formed on the molybdenum substrate under the same conditions according to the same procedures as in Example 53, except that, after forming the intermediate layer on the molybdenum substrate, the feed gas ratio of $B_2H_6(500)/H_2$ gas to $SiF_4/H_2(10)$ gas was changed to 1:15 in forming the photoconductive layer.

The thus prepared image forming member for electrophotography was subjected to image formation on a copying paper. As a result, the image formed by ⊕ corona discharge was better in quality and very clear as compared with that formed by ⊖ corona discharge. This result shows that the image forming member prepared in this Example is dependent on the charging polarity. But the charging polarity dependency was opposite to those of the image forming members obtained in Examples 56 and 57.

EXAMPLE 59

After conducting formation of an intermediate layer for one minute and then formation of a photoconductive layer for 5 hours on a molybdenum substrate according to the same procedures under the same conditions as in Example 53, the high frequency power source 1442 was turned off for intermission of glow discharge. Under this state, the outflow valve 1427 was closed and the outflow valve 1426 was opened again, thus creating the same conditions as in forming the intermediate layer. Subsequently, the high frequency power source was turned on to recommence glow discharge. The input power was 60 W, which was also the same as in formation of the intermediate layer. Thus, glow discharge was continued for 2 minutes to form an upper layer on the photoconductive layer. Then, the heater 1408 and the high frequency power source 1442 were turned off and the substrate was left to cool. Upon reaching 100° C. of the substrate temperature, the outflow valves 1425, 1426 and the inflow valves 1420-2, 1421, 1422 were closed, with full opening of the main valve, thereby evacuating the chamber 1401 to $1\times10^{-5}$. Then, the main valve 1410 was closed to return the chamber 1401 to atmospheric through the leak valve 1444, and the substrate having formed respective layers thereon was taken out.

The thus prepared image forming member for electrophotography was placed in the same charging-light exposure experimental device as used in Example 53, wherein corona charging was effected at ⊕6 KV for 0.2 sec., followed immediately by irradiation of a light image. Irradiation of the light image was effected through a transmission type test chart, using a tungsten lamp as light source, at an intensity of 1.0 lux.sec.

Immediately thereafter, ⊖ charged developers (containing toner and carrier) were cascaded on the surface of the member, whereby there was obtained a good toner image on the surface of the member. When the toner image on the member was copied on a copying paper by corona discharge at ⊕5.0 KV, a clear and highly dense image was obtained with excellent resolving power and good gradation reproducibility. Similarly, good image was obtained by combination of ⊖5.5 KV corona charging with ⊕ charged developer.

EXAMPLE 60

A substrate having ITO on one surface in thickness of 1000 Å deposited by the electron beam vapor deposition method, was placed on the supporting member 1403 in the same device as used in Example 53 (FIG. 14) with the ITO-deposited surface as upper surface. Subsequently, according to the same procedures as described in Example 53, the glow discharge deposition chamber 1401 was evacuated to $5\times10^{-6}$ Torr, and the substrate temperature was maintained at 150° C. Then, the auxiliary valve 1440, subsequently the outflow valves 1425, 1427, 1429 and the inflow valves, 1420-2, 1422, 1424, were fully opened to effect degassing sufficiently also in the flowmeters 1416, 1418, 1420-1 to vacuo. After closing the auxiliary valve 1440 and the valves 1426, 1427, 1429, 1417, 1418, 1420-2, the valve 1434 of the bomb 1415 containing $NH_3$ diluted with $H_2$ to 10 vol.% [hereinafter referred to as $NH_3(10)/H_2$; purity: 99.999%] and the valve 1430 of the $SiF_4/H_2(10)$ gas bomb 1411 were opened to adjust the pressures at the outlet pressure gages at 1 kg/cm$^2$, whereupon the inflow valves 1420-2 and 1424 were gradually opened to permit $SiF_4/H_2(10)$ gas and $NH_3(10)/N_2$ gas, respectively, to flow into the flowmeters 1416 and 1420-1, followed by gradual opening of the auxiliary valve 1440. The inflow valves 1420-2 and 1424 were adjusted so that the feed ratio of $SiF_4/H_2(10)$ gas to $NH_3(10)/H_2$ gas was 1:20. Then, while carefully reading the Pirani gage 1441, the opening of the auxiliary valve 1440 was adjusted and the auxiliary valve 1440 was opened to the extent until the inner pressure in the chamber 1401 became $1\times10^{-2}$ Torr. After the inner pressure in the chamber 1401 was stabilized, the main valve 1410 was gradually closed to throttle its opening until the indication on the Pirani gage 1441 became 0.5 Torr. After confirming that the gas feeding and the inner pressure were stable, the high frequency power source 1442 was turned on to input a high frequency power of 13.56 MHz into the induction coil 1443, thereby generating glow discharge in the chamber 1401 at the coil portion (upper part of chamber) to provide an input power of 60 W. The above conditions were maintained for one minute to deposit an intermediate layer on the substrate. Then, with the high frequency power source 1442 turned off for intermission of the glow discharge, the outflow valve 1429 and the inflow valve 1424 were closed, followed by the valve operation similarly as in formation of the intermediate layer to adjust the inner pressure in the chamber 1401 to 0.5 Torr.

Subsequently, the high frequency power source was turned on to recommence glow discharge. The input power was 60 W, as was the same as in formation of the intermediate layer. Glow discharge was thus continued for additional 3 hours to form a photoconductive layer, and thereafter the heater 1408 was turned off, and also the high frequency power source 1442 turned off. Upon cooling of the substrate to a temperature of 100° C., the outflow valve 1425 and the inflow valves 1420-2, 1424 were closed, with full opening of the main valve 1410 to evacuate the chamber 1401 to $10^{-5}$ Torr or less. Thereafter, the main valve 1410 was closed, and the inner pressure in the chamber 1401 to atmospheric through the leak valve 1444, and the substrate having formed respective layers was taken out. In this case, the entire thickness of the layers was found to be about 9μ. The thus prepared image forming member for electrophotography was placed in an experimental device for charging and exposure to light, and corona charging was effected at ⊖5.5 KV for 0.2 sec., followed immediately by irradiation of a light image. The light image was irradiated through a transmission type test chart using a tungsten lamp as light source at an intensity of 1.0 lux.sec.

Immediately thereafter, ⊕ charged developers (containing toner and carrier) were cascaded on the surface of the member to obtain a good toner image on the image forming member for electrophotography. When the toner image on the image forming member for electrography was copied on a copying paper by corona charging at ⊖5.0 KV, there was obtained a clear image of high density which was excellent in resolving power as well as in gradation reproducibility.

EXAMPLE 61

Figure 17:
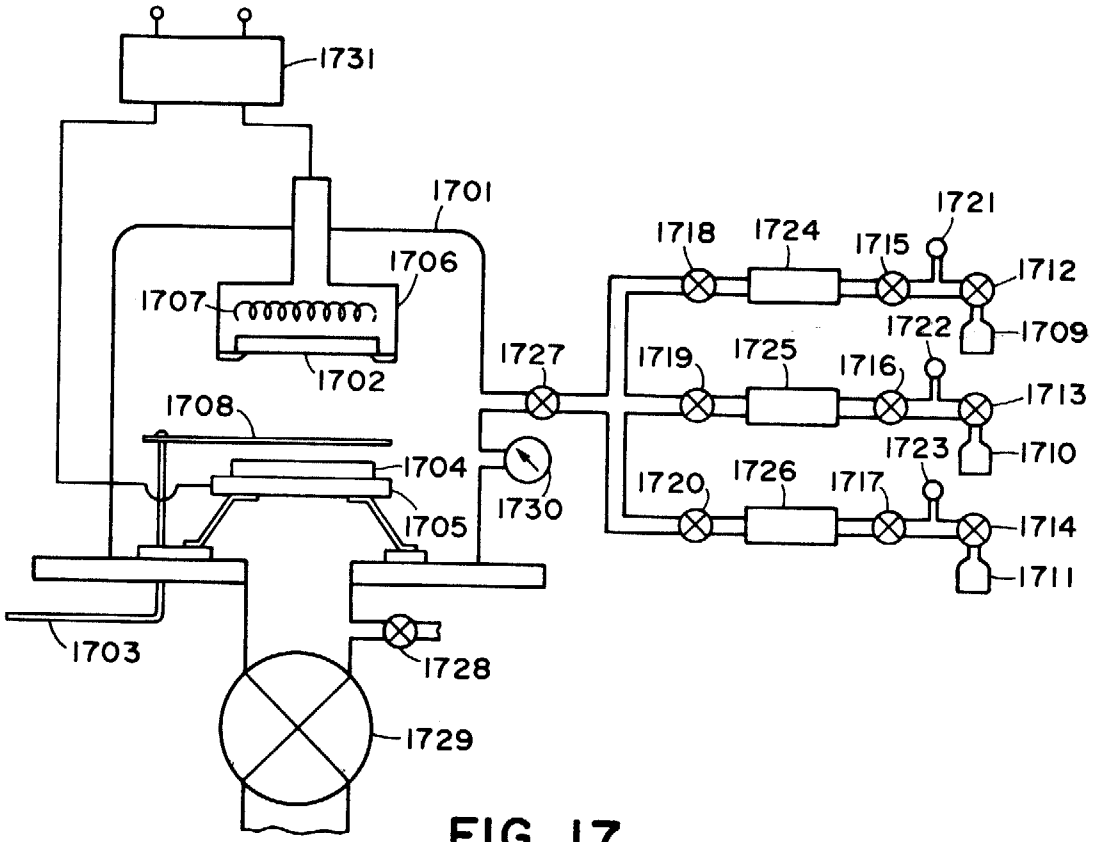

Using a device shown in FIG. 17 an intermediate layer was formed on a molybdenum substrate according to the following procedures.

A substrate 1702 of molybdenum of 10 cm square having a thickness of 0.5 mm, whose surface has been cleaned, was fixed firmly on a supporting member 1706 disposed at a predetermined position in a deposition chamber 1701. The substrate 1702 was heated by a heater 1707 within the supporting member 1706 with a precision of ±0.5° C. The temperature was measured directly at the backside of the substrate by an alumel-chromel thermocouple. Then, after confirming that all the valves in the system are closed, the main valve 1729 was fully opened, and evacuation was effected to $5\times10^{-6}$ Torr. Thereafter, the input voltage for the heater 1707 was elevated by varying the input voltage while detecting the substrate temperature until the temperature was stabilized constantly at 200° C.

Then, the auxiliary valve 1727 subsequently the effluent valves 1718, 1719, 1720 and the feed valves 1715, 1716, 1717, were fully opened to effect degassing sufficiently of the flowmeters 1724, 1725, 1726 to vacuo. After closing the auxiliary valve 1727 and the valves 1718, 1719, 1720, 1715, 1716, 1711, the valve 1713 of the bomb 1710 containing $SiF_4$ gas (purity: 99.999%) and the valve 1712 of the Ar gas bomb 1709 were respectively opened to adjust the pressures at the outlet pressure gages 1722 and 1721, respectively, at 1 kg/cm$^2$, whereupon the feed valves 1716 and 1715 were gradually opened to permit $SiF_4$ gas and Ar gas to flow into the flowmeters 1725 and 1724, respectively. Subsequently, the outflow valves 1719, 1718 were gradually opened, followed by opening of the auxiliary valve 1727. The inflow valves 1716 and 1715 were adjusted thereby so that the gas feed ratio of $SiF_4$ to Ar was 1:20. Then, while carefully reading the Pirani gage 1730, the opening of the auxiliary valve 1727 was adjusted and the auxiliary valve 1727 was opened to the extent until the inner pressure in the chamber 1701 became $1\times10^{-4}$ Torr. After the inner pressure in the chamber 1701 was stabilized, the main valve 1729 was gradually closed to throttle its opening until the indication on the Pirani gage 1730 became $1\times10^{-2}$ Torr.

With the shutter 1708 opened by operation of the shutter rod 1703, and confirming that the flowmeters 1725 and 1724 were stabilized, the high frequency power 1731 was turned on to apply an alternate current power of 13.56 MHz and 100 W between the target 1704 of a high purity polycrystalline $Si_3N_4$ and the supporting member 1706. Under these conditions, an intermediate layer was formed while taking matching so as to continue stable discharging. In this manner, discharging was continued for 2 minutes to form an intermediate layer constituted of a—$Si_xN_{1-x}$:F. Then, the high frequency power source 1731 was turned off for intermission of glow discharge. The valves 1712, 1713 of the bombs were respectively closed, with full opening of the main valve 1729, to evacuate the chamber 1701 and the flowmeters 1724, 1725 to $10^{-5}$ Torr, followed by closing of, the auxiliary valve 1725, the effluent valves 1718, 1719 and the feed valves 1715, 1716. Next, the $SiF_4$ gas bomb 1710 was replaced with the bomb of $SiF_4$ gas (99.999%) containing 10 vol.% of $H_2$ [hereinafter referred to as $SiF_4/H_2(10)$]. After the feed valve 1716, outflow valve 1719 and auxiliary valve 1727 were opened to evacuate the chamber 1701 to $5\times10^{-7}$ Torr, the feed valve 1716 and outflow valve 1719 were closed and the valve 1713 of the bomb 1710 was opened to adjust the outlet pressure gage 1722 at 1 kg/cm$^2$, followed by gradual opening of the feed valve 1716 to let in the $SiF_4/H_2(10)$ gas into the flowmeter 1725. Subsequently, the outflow valve 1719 was gradually opened. Subsequently, the valve 1714 of the bomb 1711 containing $B_2H_6$ gas diluted to 500 vol. ppm with $H_2$ [hereinafter referred to as $B_2H_6(500)/H_2$] was opened and, with adjustment of the outlet pressure gage 1723 at 1 kg/cm$^2$, the feed valve 1717 was gradually opened to permit the $B_2H_6(500)/H_2$ gas to flow into the flowmeter 1726. Then, the outflow valve 1720 was gradually opened, followed by gradually opening the auxiliary valve 1727. The feed valves 1716, 1717 were thereby adjusted so that the feed gas ratio of $SiF_4/H_2(10)$ to $B_2H_6(500)/H_2$ may be 70:1. Then, while carefully reading the Pirani gage 1730, the openings of the supplemental valve 1727 and the main valve 1729 were adjusted and throttle until the indication on the Pirani gage became 0.5 Torr. After confirming that the gas feeding and the inner pressure were stable, the shutter 1708 (being also the electrode) was closed by operation of the shutter rod 1703 followed by turning on of the high frequency power source 1737, to input a high frequency power of 13.56 MHz between the electrode 1707 and the shutter 1708, thereby generating glow discharge in the chamber 1701 to provide an input power of 60 W. After glow discharge was continued for 3 hours to form a photoconductive layer, the heater 1707 was turned off and the substrate was left to cool to 100° C., whereupon the outflow valves 1719, 1720 and the inflow valves 1715, 1716, 1717 were closed, with the main valve 1729 fully opened, thereby to make the inner pressure in the chamber 1701 to less than $10^{-5}$ Torr. Then, the main valve 1729 was closed and the inner pressure in the chamber 1701 was made atmospheric through the leak valve 1728, and the substrate having formed respective layers thereon was taken out. In this case, the entire thickness of the layers was about 9μ. The thus prepared image forming member for electrophotography was placed in an experimental device for charging and exposure to light, and corona charging was effected at ⊕6.0 KV for 0.2 sec., followed immediately by irradiation of a light image. The light image was irradiated through a transmission type test chart using a tungsten lamp as light source at a dosage of 0.8 lux.sec.

Immediately thereafter, negatively charged developers (containing toner and carrier) were cascaded on the surface of the member to obtain a good toner image on the image forming member for electrophotography. When the toner image on the image forming member for electrography was copied on a copying paper by corona charging at ⊕5.0 KV, there was obtained a clear image of high density which was excellent resolving power as well as in gradation reproducibility.

Next, the above image forming member was subjected to corona charging by means of a charging light-exposure experimental device at ⊖5.5 KV for 0.2 sec., followed immediately image exposure to light at an intensity of 0.8 lux.sec., and thereafter immediately positively charged developer was cascaded on the surface of the member. Then, by copying on a copying paper and fixing, there was obtained a very clear image.

As apparently seen from the above result, in combination with the previous result, the image forming member for electrophotography has the characteristics of a both-polarity image forming member having no dependency on the charged polarity.

EXAMPLE 62

After formation of an intermediate layer according to the same procedures and conditions as in Example 61 for 2 minutes, the high frequency power source 1731 and the heater 1707 were turned off, and the outflow valves 1718, 1719 and the inflow valves 1715, 1716 were closed. Upon reaching 100° C. of the substrate temperature, the auxiliary valve 1727 and the main valve 1729 were closed. Subsequently, the leak valve 1728 was opened to leak the deposition chamber 1701 to atmospheric. Under these conditions, the target 1704 of high purity $Si_3N_4$ was replaced with a high purity polycrystalline silicon target.

Thereafter, with the leak valve 1728 closed, the deposition chamber 1701 was evacuated to $5\times10^{-7}$ Torr, and then the auxiliary valve 1727, and the outflow valves 1718, 1719 opened to effect thoroughly evacuation of the flowmeters 1724, 1725, followed by closing of the effluent valves 1718, 1719 and the auxiliary valve 1727. The substrate 1702 was again maintained at 200° C. by turning on the heater 1707. And the valve 1713 of the bomb 1710 containing $SiF_4$ gas (purity: 99.999%) and the valve 1712 of the Ar gas bomb 1709 were opened, to adjust the pressures at the outlet gages 1722, 1721 at 1 kg/cm$^2$, respectively, and the inflow valves 1716, 1715 were gradually opened to permit $SiF_4$ gas and Ar gas to flow into the flowmeters 1725, 1724, respectively, followed by gradual opening of the auxiliary valve 1727. The inflow valves 1716, 1715 were adjusted thereby so that the feed ratio of $SiF_4$ gas to Ar gas was 1:20. Then, while carefully reading the Pirani gage 1730, the opening of the auxiliary valve 1727 was adjusted and the auxiliary valve 1727 was opened to the extent until the inner pressure in the chamber 1701 became $1\times10^{-4}$ Torr. After the inner pressure in the chamber 1701 was stabilized, the main valve 1729 was gradually closed to narrow its opening until the indication on the Pirani gage 1730 became $1\times10^{-2}$ Torr.

After confirming that the flowmeters 1725, 1724 were stable, with the shutter 1708 opened, the high frequency power source 1731 was turned on to input alternate current power of 13.56 MHz, 100 W between the high purity polycrystalline Si target 1704 and the support member 1706. While taking matching so as to continue stable discharging, formation of layer was carried out. Discharging was thus continued for 3 hours to form a photoconductive layer. Thereafter, the heater 1707 and the high frequency power source 1731 were turned off. Upon reaching 100° C. of the substrate temperature, the outflow valves 1718, 1719 and the inflow valves 1715, 1716, were closed, with full opening of the main valve 1729 to evacuate the chamber 1701 to less than $10^{-5}$ Torr. Then, the main valve 1729 was closed and the chamber 1701 was made atmospheric through the leak valve 1728, and the substrate having formed respective layers was taken out. In this case, the entire thickness of the layers was about 9μ. The thus prepared image forming member for electrophotography was placed in an experimental device for charging and exposure to light, and corona charging was effected at ⊖5.5 KV for 0.2 sec., followed immediately by irradiation of a light image. The light image was irradiated through a transmission type test chart using a tungsten lamp as light source at an intensity of 0.8 lux.sec.

Immediately thereafter, ⊕ charged developers (containing toner and carrier) were cascaded on the surface of the member to obtain a good toner image on the image forming member for electrophotography. When the toner image on the image forming member for electrography was copied on a copying paper by corona charging at ⊕6.0 KV, there was obtained a clear image of high density which was excellent in resolving power as well as in gradation reproducibility.

EXAMPLE 63

According to the same procedures and under the same conditions as in Example 53, there were prepared 7 samples of image forming members, and each sample was fixed with the photoconductive layer downward onto the supporting member 1706 in a device shown in FIG. 17 to provide a substrate 1702.

Then, on each of the photoconductive layers of these samples, upper layer was formed under various conditions A to G indicated in Table 25 to prepare 7 samples (Sample Nos. G16 to G22) having respective upper layers.

In forming the upper layer A according to the sputtering method, the target 1704 was changed to a polycrystalline silicon target having partially laminated a graphite target thereon; while in forming the upper layer E, the target was changed to $Si_3N_4$ target and the Ar gas bomb 1709 to the $N_2$ gas bomb containing $N_2$ gas diluted with Ar to 50%.

In forming the upper layer B according to the glow discharge method, the Ar gas bomb 1709 was changed to $SiH_4$ gas bomb diluted with $H_2$ to 10 vol.%; and the $B_2H_6$(500)/$H_2$ gas bomb 1711 to the $C_2H_4$ gas bomb diluted with $H_2$ to 10 vol.% [abridged as $C_2H_4$(10)/$H_2$]; in forming the upper layer C, the $B_2H_6$(500)/$H_2$ gas bomb 1711 to $Si(CH_3)_4$ bomb diluted to 10 vol.% with $H_2$; in forming the upper layer D, the $B_2H_6$(500)/$H_2$ gas bomb 1711 to $C_2H_4$(10)/$H_2$ gas bomb and the Ar gas bomb 1709 to $SiF_4$ gas bomb containing 10 vol.% of $H_2$; in forming upper layer F, and G, the $SiF_4$ gas bomb 1710 to the $SiH_4$ gas bomb diluted with $H_2$ to 10 vol.%, and the Ar gas bomb 1709 to $N_2$ gas bomb and $NH_3$ gas bomb diluted with $H_2$ to 10 vol.%, respectively.

Each of the thus prepared 7 image forming members having the upper layers A to G, respectively, was used for forming a visible image and copying said image on a copying paper, similarly as in Example 53 whereby there was obtained a very clear toner image.

TABLE 25

| Sample No. | Upper layer | Preparation conditions: Starting gas or Target | Feed gas ratio of Area ratio | Preparation method | Power (W) | Layer thickness (Å) |
|---|---|---|---|---|---|---|
| G16 | A | Polycrystalline Si target; graphite target | Si:C = 1:9 (area ratio) | Sputter | 100 | 120 |
| G17 | B | $SiH_4$ (dil. to 10 vol % with $H_2$); $C_2H_4$ (dil. to 10 vol % with $H_2$) | $SiH_4/H_2:C_2H_4/H_2$ = 1:9 | Glow | 3 | 120 |
| G18 | C | $Si(CH_3)_4$ (dil. to 10 vol % with $H_2$) | — | Glow | 3 | 120 |
| G19 | D | $SiF_4$ (containing $H_2$ in 10 vol %); $C_2H_4$ (dil. to 10 vol % with $H_2$) | $SiF_4/H_2:C_2H_4/H_2$ = 1:9 | Glow | 60 | 120 |
| G20 | E | $Si_3N_4$ target | — | Sputter | 100 | 200 |
| G21 | F | $SiH_4$ (dil. to 10 vol % with $H_2$) $N_2$ | $SiH_4/H_2:N_2$ = 1:10 | Glow | 3 | 120 |
| G22 | G | $SiH_4$ (dil. to 10 vol % with $H_2$) $NH_3$ (dil. to 10 vol % with $H_2$) | $SiH_4/H_2:NH_3/H_2$ = 1:2 | Glow | 3 | 120 |

EXAMPLE 64

According to the same procedures under the same conditions as in Example 60, there were prepared 7 samples of image forming members, and each sample was fixed with the photoconductive layer downward onto the supporting member 1706 in a device shown in FIG. 17 to provide a substrate 1702.

Then, on each of the photoconductive layers of these samples, upper layer (A to G) as shown in Table 25 was formed to prepare 7 samples of image forming members (Sample Nos. G23 to G29).

Each of the thus prepared 7 image forming members having the upper layers A to G, respectively, was used for forming a visible image and copying said image on a copying paper, similarly as in Example 63, whereby there was obtained a very clear toner image.

EXAMPLE 65

According to the same procedures under the same conditions as in Example 62, there were prepared 7 samples of image forming members, and each sample was fixed with the photoconductive layer downward onto the supporting member 1706 in a device shown in FIG. 17 to provide a substrate 1702.

Then, on each of the photoconductive layers of these samples, upper layer (A to G) as shown in Table 25 was formed to prepare 7 samples of image forming members (Sample Nos. G30 to G36).

Each of the thus prepared 7 image forming members having the upper layers A to G, respectively, was used for forming a visible image and copying said image on a copying paper, similarly as in Example 63, whereby there was obtained a very clear toner image without dependency on the charging polarity.

What we claim is:

1. A photoconductive member comprising: a support, a photoconductive layer constituted of an amorphous material containing silicon atoms as matrix and containing hydrogen atoms or halogen atoms, and an intermediate layer provided between them, said intermediate layer having a function to bar penetration of carriers from the side of the support into the photoconductive layer and to permit passage from the photoconductive layer to the support of photocarriers generated in the photoconductive layer by projection of electromagnetic waves and movement of the photocarriers toward the side of the support, and said intermediate layer being constituted of an amorphous material containing silicon atoms and nitrogen atoms as constituents and wherein said intermediate layer is non-photoconductive in the visible light region and is from 30 to 1,000 Angstroms in thickness.

2. A photoconductive member according to claim 1, wherein said amorphous material constituting the intermediate layer contains nitrogen atoms in the range of 43–60 atomic percent based on silicon atoms.

3. A photoconductive member according to claim 1, wherein said amorphous material constituting the intermediate layer further contains hydrogen atoms as a constituent.

4. A photoconductive member according to claim 3, wwherein said amorphous material contains hydrogen atoms in the range of 2–35 atomic percent.

5. A photoconductive member according to claim 1, wherein said amorphous material constituting the intermediate layer contains nitrogen atoms in the range of 25–55 atomic percent and further hydrogen atoms 2–35 atomic percent as a constituent.

6. A photoconductive member according to claim 1, wherein said amorphous material constituting the intermediate layer further contains halogen atoms as a constituent.

7. A photoconductive member according to claim 6, wherein said amorphous material contains halogen atoms in the range of 1–20 atomic percent.

8. A photoconductive member according to claim 1, wherein said amorphous material constituting the intermediate layer further contains hydrogen atoms and halogen atoms as constituents.

9. A photoconductive member according to claim 8, wherein said amorphous material contains halogen atoms in the range of 1–20 atomic percent and hydrogen atoms up to 19 atomic percent.

10. A photoconductive member according to claim 1, wherein said intermediate layer is electrically insulative.

11. A photoconductive member according to claim 1, wherein said photoconductive layer has resistance of at least $5\times10^9$ $\omega$cm.

12. A photoconductive member according to claim 1, wherein said photoconductive layer is 1–100 microns in thickness.

13. A photoconductive member according to claim 1, wherein said photoconductive layer contains hydrogen atoms in the range of 1–40 atomic percent.

14. A photoconductive member according to claim 1, wherein said photoconductive layer contains halogen atoms in the range of 1–40 atomic percent.

15. A photoconductive member according to claim 1, wherein said photoconductive layer contains hydrogen atoms and halogen atoms in the range of 1–40 atomic percent in total.

16. A photoconductive member according to claim 1, wherein said photoconductive layer contains n-type impurity.

17. A photoconductive member according to claim 16, wherein said n-type impurity is an element in Group V-A of the periodic table.

18. A photoconductive member according to claim 17, wherein said element in Group V-A of the periodic table is one member selected from N, P, As, Sb and Bi.

19. A photoconductive member according to claim 16, wherein said photoconductive layer contains n-type impurity in the range of $10^{-8}$–$10^{-3}$ atomic ratio to silicon atoms.

20. A photoconductive member according to claim 1, wherein said photoconductive layer contains p-type impurity.

21. A photoconductive member according to claim 20, wherein said p-type impurity is an element in Group III-A of the periodic table.

22. A photoconductive member according to claim 21, wherein said element in Group III-A is one member selected from B, Al, Ga, In and Tl.

23. A photoconductive member according to claim 20, wherein said photoconductive layer contains p-type impurity in the range of $10^{-6}$–$10^{-3}$ atomic ratio.

24. A photoconductive member according to claim 1, wherein an upper layer is provided on the upper surface of said photoconductive layer.

25. A photoconductive member according to claim 24, wherein said upper layer is composed of an amorphous material containing silicon atoms as matrix.

26. A photoconductive member according to claim 25, wherein said amorphous material further contains as constitution element at least one member selected from the group consisting of carbon, oxygen and nitrogen atoms.

27. A photoconductive member according to claim 25 or 26, wherein said amorphous material further contains at least one of hydrogen atoms and halogen atoms as a constituent.

28. A photoconductive member according to claim 26, wherein said amorphous material contains nitrogen atoms in the range of 43–60 atomic percent based on silicon atoms.

29. A photoconductive member according to claim 25, wherein said upper layer contains nitrogen atoms in the range of 25–55 atomic percent and hydrogen atoms in the range of 2–35 atomic percent.

30. A photoconductive member according to claim 25, wherein said upper layer contains nitrogen atoms in the range of 30-60 atomic percent, halogen atoms in the range of 1-20 atomic percent and hydrogen atoms up to 19 atomic percent.

31. A photoconductive member according to claim 24, wherein said upper layer is 30-1000 A in thickness.

32. A photoconductive member according to claim 24, wherein said upper layer is composed of inorganic insulating materials.

33. A photoconductive member according to claim 24, wherein said upper layer is composed of organic insulating materials.

34. A photoconductive member according to claim 24, wherein said upper layer is non-photoconductive with respect to visible rays.

35. A photoconductive member according to claim 24, wherein said upper layer is electrically insulative.

36. A photoconductive member according to claim 1 or 26, wherein said photoconductive member further comprises a surface coating layer of 0.5-70 microns in thickness.

37. A photoconductive member according to claim 1, wherein said intermediate layer contains nitrogen atoms in the range of 30-60 atomic percent, and further halogen atoms in the range of 1-20 atomic percent and hydrogen atoms up to 19 atomic percent.

38. A photoconductive member according to claim 1, wherein halogen atom is one member selected from F, Cl and Br.

39. A photoconductive member having a support, a photoconductive layer constituted of an amorphous material containing silicon atoms as matrix and containing at least one of hydrogen atoms and halogen atoms as a constituent, and an intermediate layer provided between said support and said photoconductive layer, characterized in that said intermediate layer is constituted of an amorphous material containing silicon atoms and nitrogen atoms as constitution elements and wherein said intermediate layer is non-photoconductive in the visible light region and is from 30 to 1,000 Angstroms in thickness.

40. A photoconductive member according to claim 39, wherein said amorphous material constituting the intermediate layer contains nitrogen atoms in the range of 43-60 atomic percent.

41. A photoconductive member according to claim 39, wherein said amorphous material constituting the intermediate layer further contains hydrogen atoms as a constituent.

42. A photoconductive member according to claim 41, wherein said amorphous material contains hydrogen atoms in the range of 2-35 atomic percent.

43. A photoconductive member according to claim 39, wherein said amorphous material constituting the intermediate layer contains nitrogen atoms in the range of 25-55 atomic percent and further hydrogen atoms 2-35 atomic percent as a constituent.

44. A photoconductive member according to claim 39, wherein said amorphous material constituting the intermediate layer further contains halogen atoms as a constituent.

45. A photoconductive member according to claim 44, wherein said amorphous material contains halogen atoms in the range of 1-20 atomic percent.

46. A photoconductive member according to claim 39, wherein said amorphous material constituting the intermediate layer further contains hydrogen atoms and halogen atoms as constituents.

47. A photoconductive member according to claim 46, wherein said amorphous material contains halogen atoms in the range of 1-20 atomic percent and hydrogen atoms up to 19 atomic percent.

48. A photoconductive member according to claim 39, wherein said intermediate layer is electrically insulative.

49. A photoconductive member according to claim 39, wherein said photoconductive layer has resistance of at least $5\times10^9$ Ωcm.

50. A photoconductive member according to claim 39, wherein said photoconductive layer is 1-100 microns in thickness.

51. A photoconductive member according to claim 39, wherein said photoconductive layer contains hydrogen atoms in the range of 1-40 atomic percent.

52. A photoconductive member according to claim 39, wherein said photoconductive layer contains halogen atoms in the range of 1-40 atomic percent.

53. A photoconductive member according to claim 39, wherein said photoconductive layer contains hydrogen atoms and halogen atoms in the range of 1-40 atomic percent in total.

54. A photoconductive member according to claim 39, wherein said photoconductive layer contains n-type impurity.

55. A photoconductive member according to claim 54, wherein said n-type impurity in an element in Group V-A of the periodic table.

56. A photoconductive member according to claim 59, wherein said element in Group V-A of the periodic table is selected from N, P, As, Sb and Bi.

57. A photoconductive member according to claim 54, wherein said photoconductive layer contains n-type impurity in the range of $10^{-8}$-$10^{-3}$ atomic ratio.

58. A photoconductive member according to claim 39, wherein said photoconductive layer contains p-type impurity.

59. A photoconductive member according to claim 62, wherein said p-type impurity is an element in Group III-A of the periodic table.

60. A photoconductive member according to claim 59, wherein said element in Group III-A is one member selected from B, Al, Ga, In and Tl.

61. A photoconductive member according to claim 58, wherein said photoconductive layer contains p-type impurity in the range of $10^{-6}$-$10^{-3}$ atomic ratio.

62. A photoconductive member according to claim 39, wherein an upper layer is provided on the upper surface of said photoconductive layer.

63. A photoconductive member according to claim 62, wherein said upper layer is composed of an amorphous material containing silicon atoms as matrix.

64. A photoconductive member according to claim 63, wherein said amorphous material further contains at least one element selected from the group consisting of carbon, oxygen and nitrogen atoms as a constituent.

65. A photoconductive member according to claim 63 or 64, wherein said amorphous material further contains at least one of hydrogen atoms and halogen atoms as a constituent.

66. A photoconductive member according to claim 64, wherein said amorphous material contains nitrogen atoms in the range of 43-60 atomic percent based on silicon atoms.

67. A photoconductive member according to claim 63, wherein said upper layer contains nitrogen atoms in the range of 25-55 atomic percent and hydrogen atoms in the range of 2-35 atomic percent.

68. A photoconductive member according to claim 63, wherein said upper layer contains nitrogen atoms in the range of 30-60 atomic percent, halogen atoms in the range of 1-20 atomic percent and hydrogen atoms up to 19 atomic percent based on silicon atoms.

69. A photoconductive member according to claim 62, wherein said upper layer is 30-1000 A in thickness.

70. A photoconductive member according to claim 62, wherein said upper layer is composed of inorganic insulating materials.

71. A photoconductive member according to claim 62, wherein said upper layer is composed of organic insulating materials.

72. A photoconductive member according to claim 62, wherein said upper layer is non-photoconductive with respect to visible rays.

73. A photoconductive member according to claim 62, wherein said upper layer is electrically insulative.

74. A photoconductive member according to claim 39 or 62, wherein said photoconductive member further comprises a surface coating layer of 0.5-70 microns in thickness.

75. A photoconductive member according to claim 39, wherein said intermediate layer contains nitrogen atoms in the range of 30-60 atomic percent, and further halogen atoms in the range of 1-20 atomic percent and hydrogen atoms up to 19 atomic percent.

76. A photoconductive member having a support, a photoconductive layer constituted of an amorphous material containing silicon atoms as matrix and containing hydrogen atoms or halogen atoms as a constituent, and a non-photoconductive layer in the visible light region constituted of an amorphous material containing silicon atoms and nitrogen atoms as constitution elements in contact with said photoconductive layer, wherein the non-photoconductive layer is from 30 to 1,000 Angstroms in thickness.

77. A photoconductive member according to claim 76, wherein the amount of nitrogen atoms in said amorphous material of the non-photoconductive layer ranges from 43-60 atomic percent.

78. A photoconductive member according to claim 76, wherein said amorphous material of the non-photoconductive layer contains hydrogen atoms as a constituent.

79. A photoconductive member according to claim 78, wherein said hydrogen atoms are present in the range of 2-35 atomic percent.

80. A photoconductive member according to claim 76, wherein said amorphous material of the non-photoconductive layer contains nitrogen atoms in the range of 25-55 atomic percent and hydrogen atoms in the range of 2-35 atomic percent.

81. A photoconductive member according to claim 76, wherein said amorphous material of the non-photoconductive layer containing nitrogen atoms further contains halogen atoms as a constituent.

82. A photoconductive member according to claim 81, wherein said halogen atoms are present in the range of 1-20 atomic percent.

83. A photoconductive member according to claim 76, wherein said amorphous material of the non-photoconductive layer further contains hydrogen atoms and halogen atoms as constituents.

84. A photoconductive member according to claim 83, wherein said halogen atoms are present in the range of 1-20 atomic percent and said hydrogen atoms are present up to 19 atomic percent.

85. A photoconductive member according to claim 76, wherein said non-photoconductive layer is electrically insulative.

86. A photoconductive member according to claim 76, wherein said photoconductive layer has resistance of at least $5\times10^9$ ohm cm.

87. A photoconductive member according to claim 76, wherein said photoconductive layer is 1-100 microns in thickness.

88. A photoconductive member according to claim 76, wherein said photoconductive layer contains hydrogen atoms in the range of 1-40 atomic percent.

89. A photoconductive member according to claim 76, wherein said photoconductive layer contains halogen atoms in the range of 1-40 atomic percent.

90. A photoconductive member according to claim 76, wherein said photoconductive layer contains hydrogen atoms and halogen atoms in the range of 1-40 atomic percent in total.

91. A photoconductive member according to claim 76, wherein said photoconductive layer contains N-type impurity.

92. A photoconductive member according to claim 91, wherein said N-type impurity is an element in Group V A of the Periodic Table.

93. A photoconductive member according to claim 92, wherein said element in Group V A of the Periodic Table is selected from N, P, As, Sb and Bi.

94. A photoconductive member according to claim 91, wherein said photoconductive layer contains N-type impurity in the range of $10^{-8}$ to $10^{-3}$ atomic ratio.

95. A photoconductive member according to claim 76, wherein said photoconductive layer contains P-type impurity.

96. A photoconductive member according to claim 95, wherein said P-type impurity is an element in Group III A of the Periodic Table.

97. A photoconductive member according to claim 96, wherein said element in Group III A is selected from B, Al, Ga, In and Tl.

98. A photoconductive member according to claim 95, wherein said photoconductive layer contains P-type impurity in the range of $10^{-6}$ to $10^{-3}$ atomic ratio.

* * * * *